US008205919B2

(12) United States Patent
Flory

(10) Patent No.: US 8,205,919 B2
(45) Date of Patent: Jun. 26, 2012

(54) SASH LOCK WITH FORCED ENTRY RESISTANCE

(75) Inventor: Edward C. Flory, Crown Point, IN (US)

(73) Assignee: Newell Operating Company, Huntersville, NC (US)

( * ) Notice: Subject to any disclaimer, the term of this patent is extended or adjusted under 35 U.S.C. 154(b) by 1063 days.

(21) Appl. No.: 12/110,614

(22) Filed: Apr. 28, 2008

(65) Prior Publication Data

US 2009/0265996 A1 Oct. 29, 2009

(51) Int. Cl.
*E05C 3/04* (2006.01)
*E05C 3/00* (2006.01)

(52) U.S. Cl. ..... 292/241; 292/DIG. 20; 292/DIG. 47; 70/89; 70/90

(58) Field of Classification Search ..... 292/241, 292/DIG. 20, DIG. 47; 70/89, 90
See application file for complete search history.

(56) References Cited

U.S. PATENT DOCUMENTS

| | | | |
|---|---|---|---|
| 115,781 | A | 6/1871 | Steele |
| 201,146 | A | 3/1878 | Adler |
| 215,125 | A | 5/1879 | Hunter |
| 234,387 | A | 11/1880 | Burgess et al. |
| 284,993 | A | 9/1883 | Abele |
| 336,302 | A | 2/1886 | Dudgeon |
| 353,287 | A | 11/1886 | Chumard |
| 480,148 | A | 8/1892 | Theby |
| 564,426 | A | 7/1896 | Hubbard |
| 587,424 | A | 8/1897 | Bonine |
| 708,406 | A | 9/1902 | Robison |
| 743,716 | A | 11/1903 | Hadka |
| 744,755 | A | 11/1903 | Hasenpflug |
| 756,559 | A | 4/1904 | Arens |
| 878,206 | A | 2/1908 | Johnson |
| 900,079 | A | 10/1908 | Bittorf |
| 910,850 | A | 1/1909 | Petrie |
| 928,408 | A | 7/1909 | Taube |
| 1,041,803 | A | 10/1912 | Kilburn |
| 1,059,999 | A | 4/1913 | James et al. |

(Continued)

FOREIGN PATENT DOCUMENTS

CA 2192746 A1 12/1997

(Continued)

OTHER PUBLICATIONS

Home Protection Hardware Catalog Price List, dated Jul. 1986, p. 21.

*Primary Examiner* — Carlos Lugo
(74) *Attorney, Agent, or Firm* — Taft Stettinius & Hollister LLP

(57) ABSTRACT

A sash lock mechanism includes a handle, a housing adapted to be supported by a sash window assembly, the housing having an opening receiving the handle therethrough, and a rotor coupled to the handle. The rotor is moveable between at least a locked position and an unlocked position by movement of the handle. The sash lock mechanism also includes a locking mechanism that contains a pivotable member pivotably connected to the housing. The pivotable member is pivotable between a first position and a second position. When the rotor is in the locked position and the pivotable member is in the first position, the pivotable member confronts the rotor to prevent movement of the rotor to the unlocked position. When the pivotable member is in the second position, the pivotable member does not prevent movement of the rotor.

6 Claims, 32 Drawing Sheets

U.S. PATENT DOCUMENTS

| | | | | | |
|---|---|---|---|---|---|
| 1,122,026 | A | | 12/1914 | O'Rourke | |
| 1,148,712 | A | | 8/1915 | Overand | |
| 1,156,004 | A | | 10/1915 | Fuller | |
| 1,247,182 | A | | 11/1917 | Tueckmantel | |
| 1,253,810 | A | | 1/1918 | Gianninoto | |
| 1,338,250 | A | | 4/1920 | Parkes | |
| 1,338,416 | A | | 4/1920 | Bellinger | |
| 1,339,362 | A | | 5/1920 | L'Heureux | |
| 1,393,628 | A | | 10/1921 | Leichter | |
| 1,550,532 | A | | 8/1925 | French | |
| 1,619,031 | A | * | 3/1927 | Ostrosky | 292/240 |
| 1,692,579 | A | | 11/1928 | Schrader | |
| 1,704,946 | A | | 3/1929 | Lindgren | |
| 1,790,816 | A | | 2/1931 | Hiering | |
| 1,900,936 | A | | 3/1933 | Huttger | |
| 1,901,974 | A | | 3/1933 | Macy | |
| 2,537,736 | A | | 1/1951 | Carlson | |
| 2,605,125 | A | | 7/1952 | Emerson | |
| 2,613,526 | A | | 10/1952 | Holmsten | |
| 2,758,862 | A | | 8/1956 | Endter | |
| 3,027,188 | A | | 3/1962 | Eichstadt | |
| 3,135,542 | A | | 6/1964 | Wilkinson | |
| 3,144,688 | A | | 8/1964 | Nielsen | |
| 3,377,093 | A | | 4/1968 | Macoicz | |
| 3,405,962 | A | | 10/1968 | Sushan | |
| 3,438,153 | A | | 4/1969 | Lemme | |
| 3,645,573 | A | | 2/1972 | Strang | |
| 3,655,230 | A | | 4/1972 | Armstrong | |
| 3,706,467 | A | | 12/1972 | Martin | |
| 3,709,540 | A | | 1/1973 | Beilis | |
| 3,811,718 | A | | 5/1974 | Bates | |
| 3,907,348 | A | | 9/1975 | Bates et al. | |
| 4,059,298 | A | | 11/1977 | Van Klompenburg | |
| 4,095,827 | A | | 6/1978 | Stavenau | |
| 4,095,829 | A | | 6/1978 | Van Klompenburg | |
| 4,102,546 | A | | 7/1978 | Costello | |
| 4,130,311 | A | | 12/1978 | Sushan | |
| 4,223,930 | A | | 9/1980 | Costello et al. | |
| 4,227,345 | A | | 10/1980 | Durham, Jr. | |
| 4,235,465 | A | | 11/1980 | Costello | |
| 4,261,602 | A | | 4/1981 | Anderson | |
| 4,305,612 | A | | 12/1981 | Hunt et al. | |
| D268,643 | S | | 4/1983 | Anderson | |
| 4,558,174 | A | | 12/1985 | Massey | |
| 4,621,847 | A | | 11/1986 | Paulson et al. | |
| 4,736,972 | A | | 4/1988 | Mosch | |
| 4,801,164 | A | | 1/1989 | Mosch | |
| 4,813,725 | A | | 3/1989 | Mosch | |
| D302,651 | S | | 8/1989 | Mosch | |
| 4,961,286 | A | | 10/1990 | Bezubic | |
| D316,509 | S | | 4/1991 | Nolte | |
| 5,042,855 | A | | 8/1991 | Bennett et al. | |
| 5,072,464 | A | | 12/1991 | Draheim et al. | |
| 5,076,015 | A | | 12/1991 | Manzalini | |
| 5,087,087 | A | | 2/1992 | Vetter et al. | |
| 5,087,088 | A | | 2/1992 | Milam | |
| 5,090,750 | A | | 2/1992 | Lindqvist | |
| 5,110,165 | A | | 5/1992 | Piltingsrud | |
| 5,127,685 | A | | 7/1992 | Dallaire et al. | |
| 5,139,291 | A | | 8/1992 | Schultz | |
| 5,161,839 | A | | 11/1992 | Piltingsrud et al. | |
| 5,165,737 | A | * | 11/1992 | Riegelman | 292/42 |
| 5,219,193 | A | | 6/1993 | Piltingsrud | |
| 5,398,447 | A | | 3/1995 | Morse | |
| 5,448,857 | A | | 9/1995 | Stormo | |
| D366,409 | S | | 1/1996 | Delaske | |
| 5,582,445 | A | | 12/1996 | Olsen et al. | |
| RE35,463 | E | | 2/1997 | Vetter et al. | |
| 5,715,631 | A | | 2/1998 | Kailian et al. | |
| 5,741,032 | A | | 4/1998 | Chaput | |
| 5,778,602 | A | | 7/1998 | Johnson et al. | |
| 5,839,767 | A | | 11/1998 | Piltingsrud | |
| 5,901,499 | A | | 5/1999 | Delaske et al. | |
| 5,992,907 | A | | 11/1999 | Sheldon et al. | |
| 6,116,665 | A | | 9/2000 | Subliskey | |
| 6,123,373 | A | | 9/2000 | Yoshida | |
| 6,142,541 | A | | 11/2000 | Rotondi | |
| 6,349,576 | B2 | | 2/2002 | Subliskey | |
| 6,406,076 | B1 | | 6/2002 | Zarzycki, Jr. | |
| 6,634,683 | B1 | | 10/2003 | Brannan | |
| 6,817,142 | B2 | | 11/2004 | Marshik | |
| 6,925,758 | B2 | | 8/2005 | Pettit | |
| 6,983,963 | B2 | | 1/2006 | Eslick et al. | |
| 7,063,361 | B1 | | 6/2006 | Lawrence | |
| 7,100,951 | B2 | * | 9/2006 | Jien | 292/207 |

FOREIGN PATENT DOCUMENTS

| | | | |
|---|---|---|---|
| CA | 2210026 | C | 9/1998 |
| CA | 2256643 | A1 | 5/2000 |
| CA | 2312095 | A1 | 12/2000 |
| GB | 341207 | | 1/1931 |
| GB | 2026594 | A | 2/1980 |

* cited by examiner

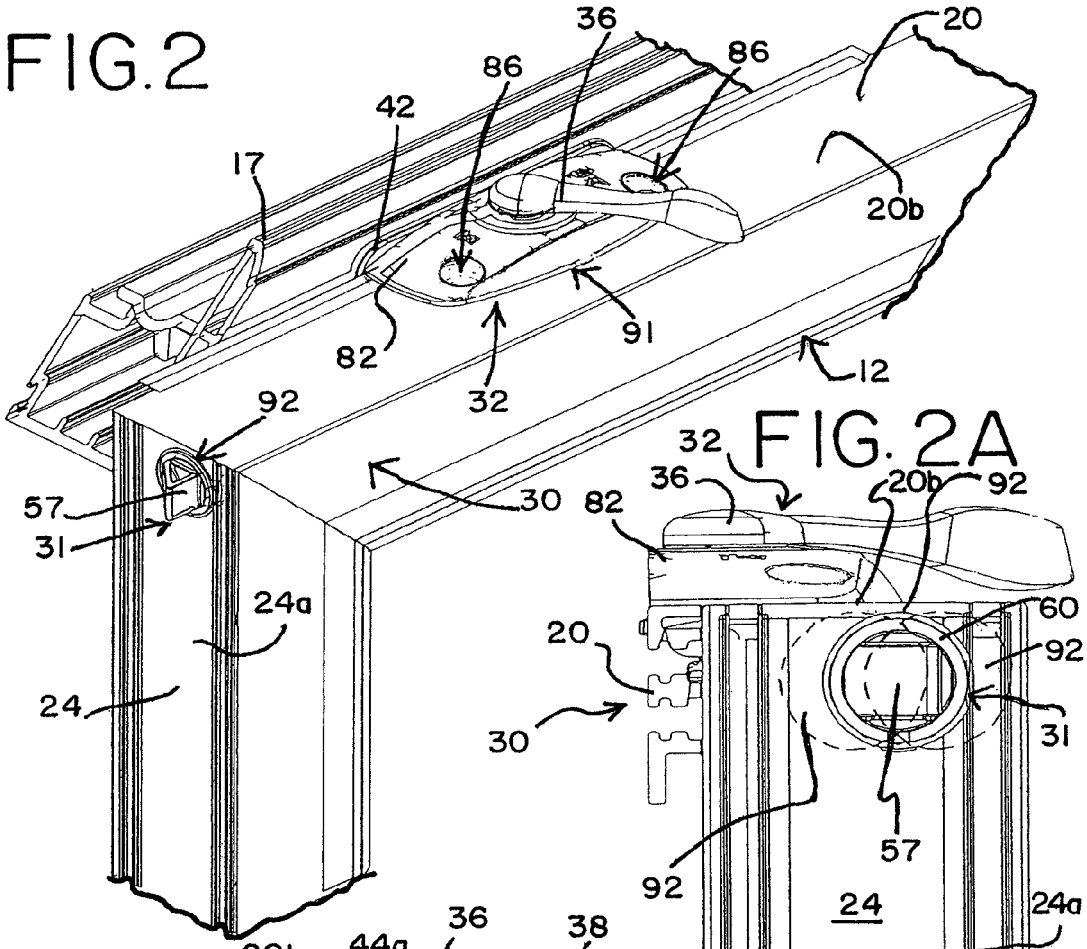
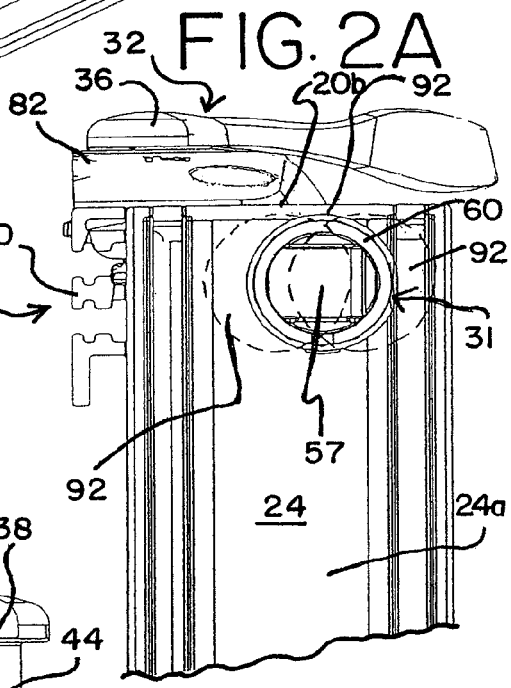
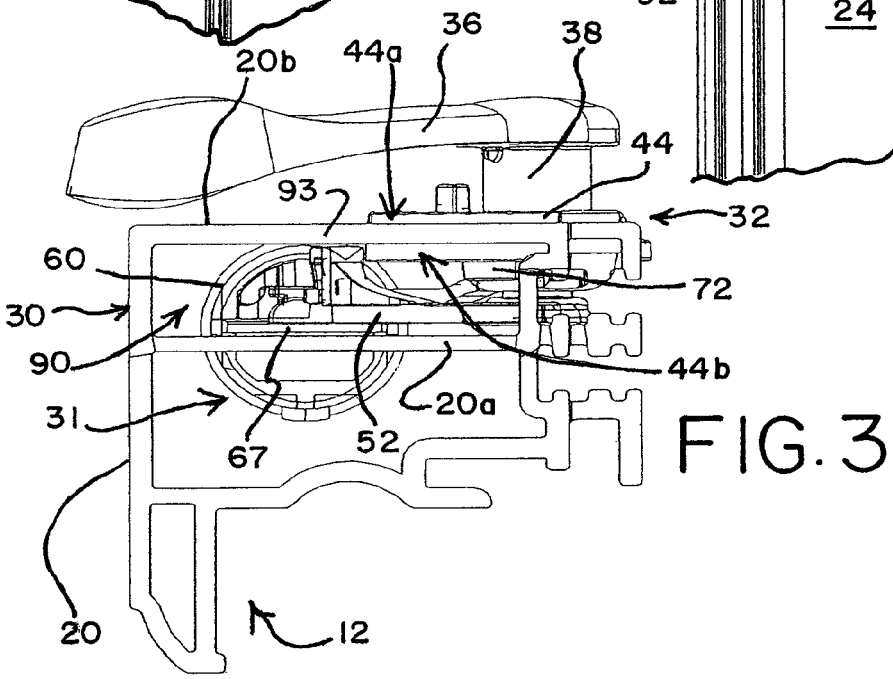
FIG. 3

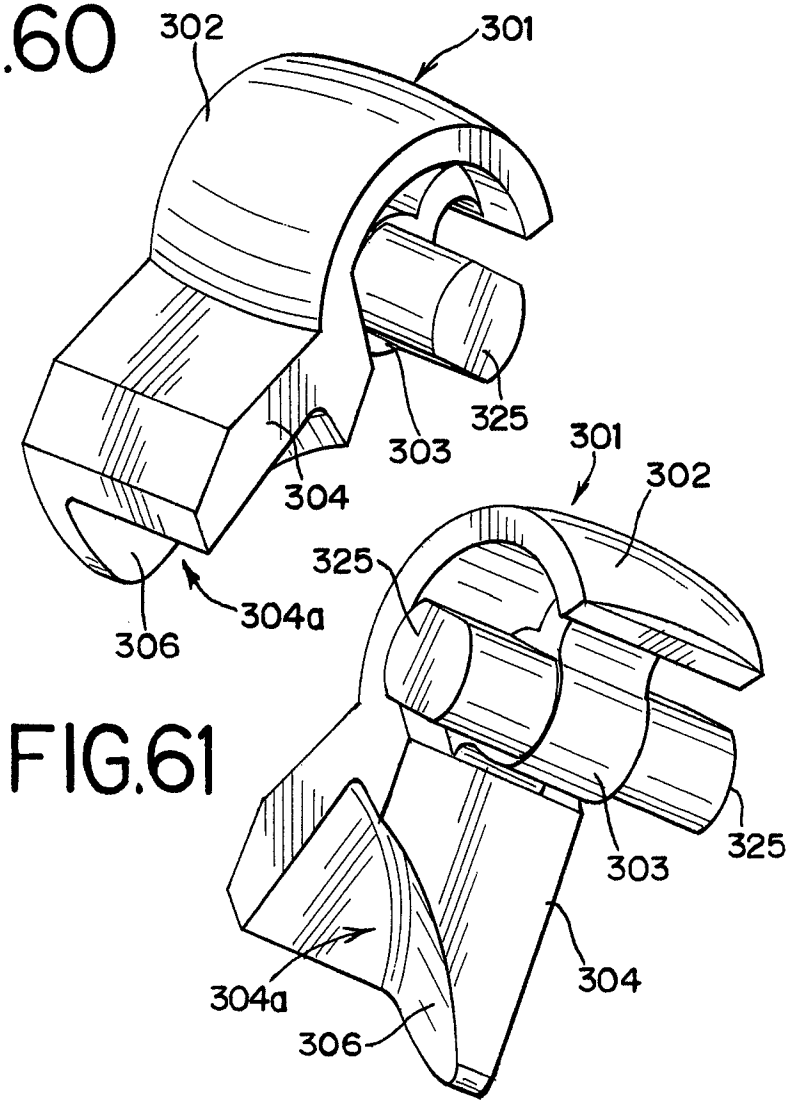
FIG.60
FIG.61
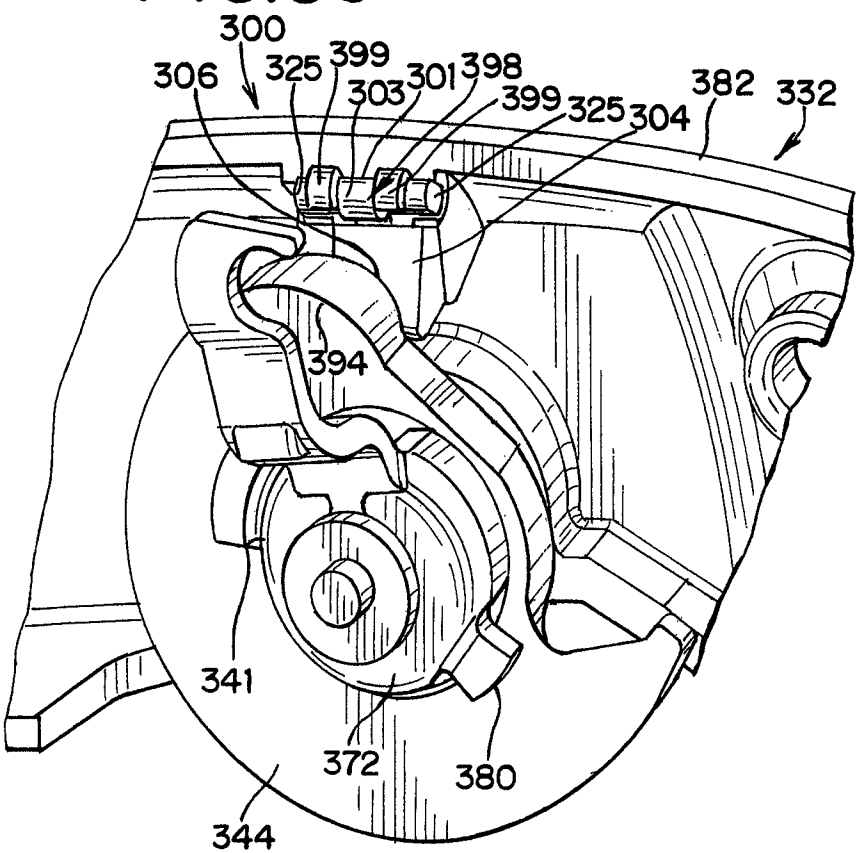
FIG.59

SASH LOCK WITH FORCED ENTRY RESISTANCE

TECHNICAL FIELD

The present invention relates to sash window hardware and, more particularly, to an integrated sash lock and tilt-latch for use in sash windows wherein the sash lock has forced entry resistance capabilities.

BACKGROUND OF THE INVENTION

A pivotal sash window adapted for installation in a master frame of a sash window assembly is well-known. The pivotal sash window assembly typically has opposed, vertically extending jambs or guide rails to enable vertical reciprocal sliding movement of the sash window in the master frame while cooperatively engaged with the guide rails. The sash window also has a top sash rail, a base or lower rail and a pair of stiles or side rails cooperatively connected together at adjacent extremities thereof to form a sash frame, usually a rectangular frame.

Hardware is associated with the sash window assembly, such as a sash lock that provides a locking mechanism between an upper sash window and a lower sash window, as well as tilt-latches that releasably engage the guide rails to allow the sash window to pivot from the master frame. Mechanisms have been developed that combine the sash lock mechanism and the tilt-latch mechanism. Other features have also been incorporated into the separate mechanisms. For example, certain sash lock mechanisms may have certain structures that provide forced entry resistance. While such combined mechanisms and other features provide a number of advantageous features, they nevertheless have certain limitations. The present invention seeks to overcome certain of these limitations and other drawbacks of the prior art, and to provide new features not heretofore available.

SUMMARY OF THE INVENTION

Aspects of the present invention relate to a sash lock mechanism that includes a handle, a housing adapted to be supported by a sash window assembly, the housing having an opening receiving the handle therethrough, and a rotor coupled to the handle. The rotor is moveable between at least a locked position and an unlocked position by movement of the handle. The sash lock mechanism also includes a locking mechanism that contains a pivotable member pivotably connected to the housing. The pivotable member has an engagement surface thereon and is pivotable between a first position and a second position. When the rotor is in the locked position and the pivotable member is in the first position, the engagement surface confronts the rotor to prevent movement of the rotor to the unlocked position. When the pivotable member is in the second position, the pivotable member does not prevent movement of the rotor.

According to one aspect, the rotor rotates about a first axis of rotation and the pivotable member pivots about a second axis of rotation, and the first axis of rotation is generally transverse to the second axis of rotation. In one embodiment, the pivotable member includes a mounting arm pivotably received in a receiver on the housing to mount the pivotable member to the housing, and the second axis of rotation is defined by the mounting arm.

According to another aspect, the pivotable member includes an actuator having a leg extending therefrom. The leg has a notch and an engagement surface defined within the notch. When the pivotable member is in the first position and the rotor is in the locked position, a portion of the cam is received within the notch and confronts the engagement surface, thereby preventing the rotor from moving to the unlocked position. In one embodiment, the engagement surface and the rotor portion are curvilinear in shape and the notch and the engagement surface are cooperatively dimensioned with the rotor portion.

According to another aspect, the pivotable member includes an actuator having a leg extending therefrom. When the pivotable member is in the second position and the leg is elevated above the rotor, the leg does not prevent the rotor from moving to the unlocked position.

According to another aspect, the sash lock mechanism further includes means for rotationally biasing the pivotable member to the first position. In one embodiment, the means for rotationally biasing the pivotable member includes a leaf spring connected to the housing. The leaf spring is configured to engage a portion of the pivotable member and exert a rotational force on the pivotable member when the pivotable member is in the first position. In another embodiment, the leaf spring is received in a recess in the housing, and when the pivotable member is in the second position, the portion of the pivotable member engages a face of the leaf spring and causes the leaf spring to flex into the recess.

According to another aspect, the pivotable member has a tactile outer surface accessible through an opening in the housing. In one embodiment, the tactile surface is created by a plurality of ridges on the outer surface.

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

BRIEF DESCRIPTION OF THE DRAWINGS

To understand the present invention, it will now be described by way of example, with reference to the accompanying drawings in which:

FIG. 2 is a perspective view of a portion of a sash window assembly incorporating the integrated tilt latch and sash lock assembly of the present invention;

FIG. 2A is a side view of the sash window assembly and integrated tilt latch and sash lock assembly and top sash member of FIG. 2;

FIG. 3 is a side view of the integrated tilt latch and sash lock assembly of FIG. 2, mounted in a top sash member;

FIG. 59 is a focused bottom perspective view of the sash lock mechanism of FIG. 58;

FIG. 60 is a perspective view of a pivotable member of the locking mechanism of the sash lock mechanism of FIG. 58;

FIG. 61 is a bottom perspective view of the pivotable member of FIG. 60;

DETAILED DESCRIPTION

Figure 1:
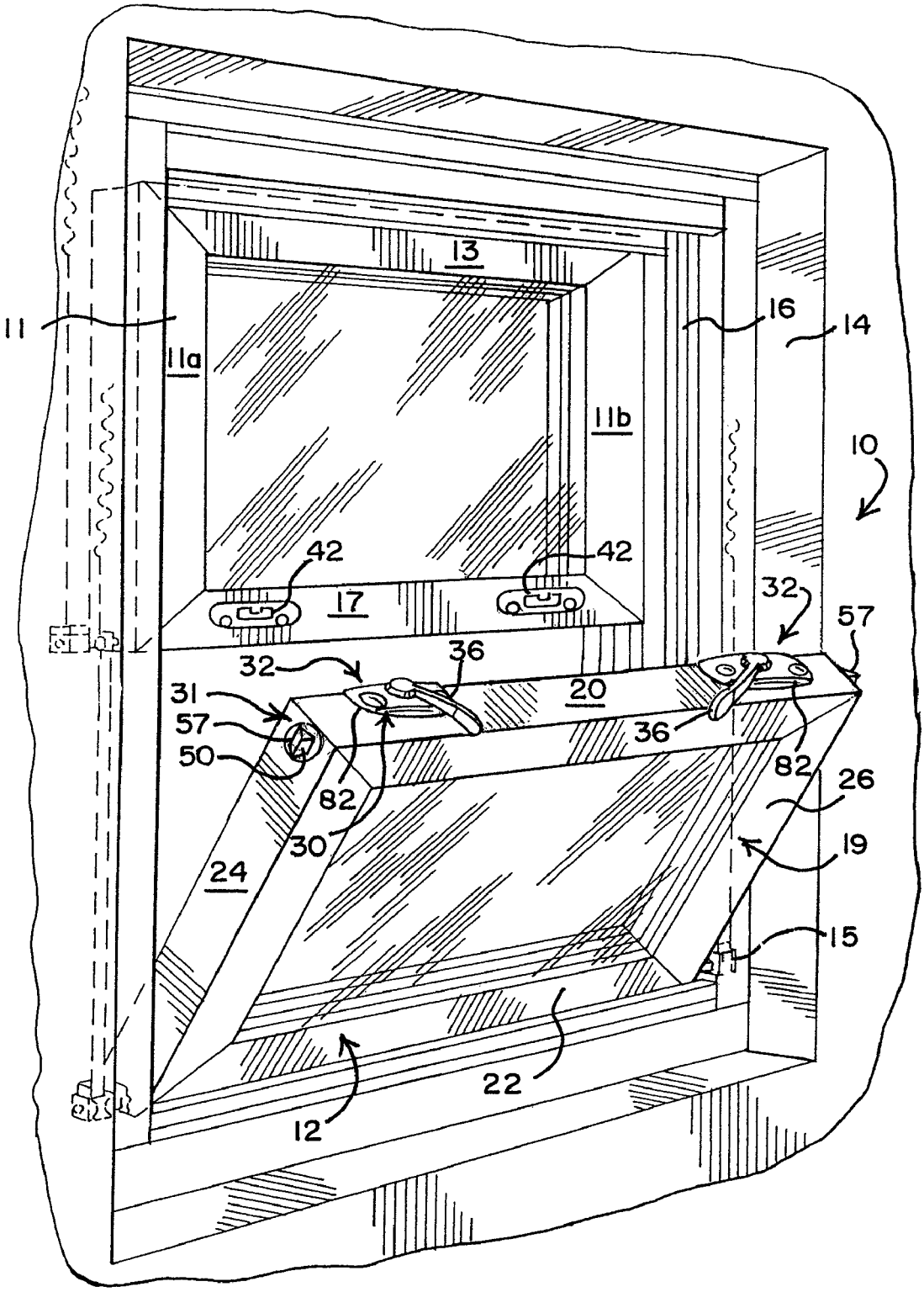
FIG. 1 is a perspective view of a sash window assembly incorporating an integrated tilt latch and sash lock assembly of the present invention.

While this invention is susceptible of embodiment in many different forms, there is shown in the drawings, and will herein be described in detail, preferred embodiments of the invention with the understanding that the present disclosure is to be considered as an exemplification of the principles of the invention and is not intended to limit the broad aspect of the invention to the embodiments illustrated.

A sash window assembly 10 is shown in FIG. 1. The sash window assembly 10 is a double-hung window assembly having a pivotal bottom sash window 12 installed in a master frame 14. The bottom sash window 12 is pivotally mounted to the master frame 14 by a pivot-corner/balance shoe assembly 15. The master frame 14 has opposed, vertically extending guide rails 16 or jambs 16. The bottom sash window 12 has a top sash rail 20, a base 22 or bottom sash rail 22 and a pair of stiles 24,26 or side rails 24,26, cooperatively connected together at adjacent extremities thereof to form a sash frame 19, which is typically rectangular, although other shapes are possible. The sash frame 19 with which the integrated assembly 30 described herein is employed is typically made from vinyl extrusions known in the art. While the present invention can be used with any type of frame 19, in one exemplary embodiment, the invention is used with a window assembly 10 having a frame 19 made of vinyl. In other embodiments, it is contemplated that the frame 19 could be made from wood, masonite or press board, or from extrusions or pulltrusions that are filled with fiberglass, epoxy, plastic, or wood chips, or from other materials, including aluminum. In the embodiment shown in FIG. 1, the window assembly 10 also has a top sash window 11, which is similar in structure to the bottom sash window 12, having a top rail 13, a bottom rail 17, and two stiles 11*a*,11*b*.

In accordance with one embodiment of the invention, the sash window 12 includes an integrated tilt latch and sash lock assembly 30, which is illustrated in FIGS. 1-38. The integrated assembly 30 provides a sash locking operation. Additionally, the integrated assembly 30 provides a tilt-latch operation. While the integrated assembly 30 will be described herein with respect to a single integrated assembly 30, the integrated assembly 30 can also be used in connection with a dual integrated assembly. In such an instance, the second half of the integrated assembly will be substantially the same as that half of the integrated assembly 30 described herein. Also, as can be understood from FIG. 1, one embodiment of the invention has a left-side integrated assembly 30 and a right-side integrated assembly 30. It is understood that the description herein is applicable to both a left-side integrated assembly 30 and a right-side integrated assembly 30. It is further understood that the features of the integrated assembly 30 may be incorporated into a single integrated assembly having a single sash lock mechanism and two tilt latch mechanisms.

Referring to FIGS. 1-3, the integrated tilt latch and sash lock assembly 30 generally includes a sash lock mechanism 32 and a tilt latch mechanism 31 that are interconnected by a connector 52, and a keeper or locking bracket 42. The left-side integrated assembly 30 shown in FIGS. 2-3 is supported by, and mounted partially within, the top sash rail 20 and the left stile 24. Generally, the sash lock mechanism 32 and the keeper 42 provide the sash locking operation, the tilt latch mechanism 31 provides the tilt-latch operation, and the connector 52 connects the sash lock mechanism 32 and the tilt latch mechanism 31. The integrated assembly 30 is moveable between a locked position, an unlocked position, and a tiltable position. In the locked position, the tilt latch mechanism 31 prevents the sash window 12 from tilting and the sash lock mechanism 32 prevents the sash window 12 from sliding within the master frame 14. In the unlocked position, the tilt latch mechanism 31 still prevents the sash window 12 from tilting, but the sash lock mechanism 32 is released, leaving the sash window 12 free to slide within the master frame 14. In the tiltable position, the tilt latch mechanism 31 is released, and the sash window 12 may be tilted as shown in FIG. 1. The operation of the integrated assembly 30 is described in greater detail below.

Figure 3A:
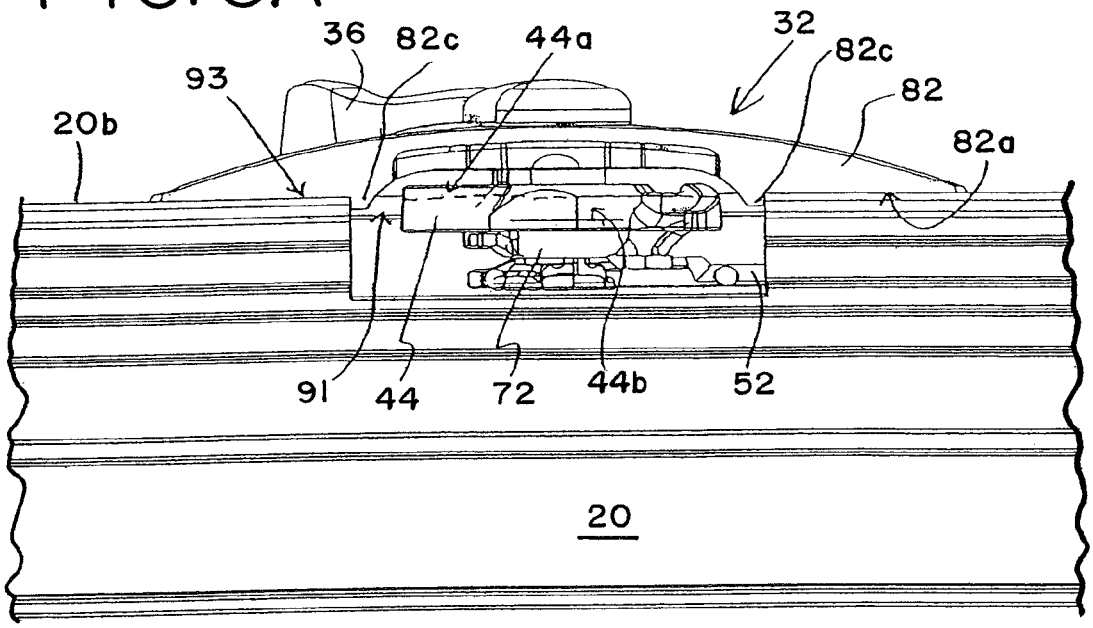
FIG. 3A is a rear view of the integrated tilt latch and sash lock assembly and top sash member of FIG. 3.
Figure 15:
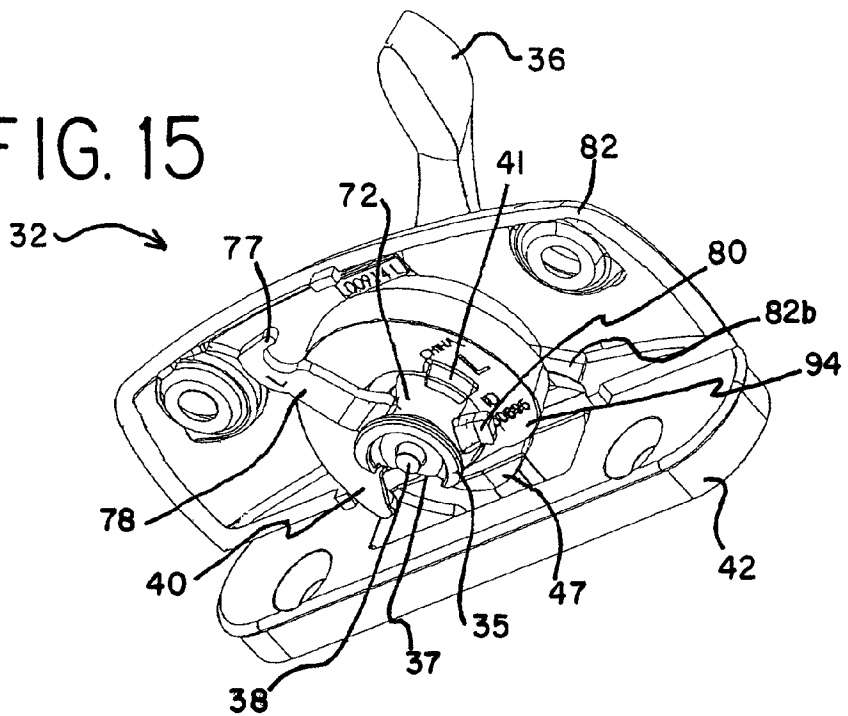
FIG. 15 is a bottom perspective view of a sash lock mechanism and a keeper of the integrated tilt latch and sash lock assembly of FIG. 4, shown in the unlocked position.
Figure 29:
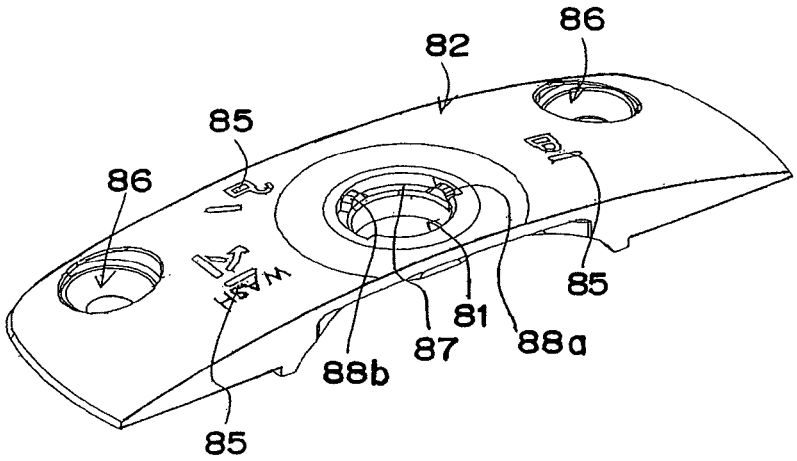
FIG. 29 is a perspective view of a housing of the sash lock mechanism of FIG. 15.
Figure 29A:
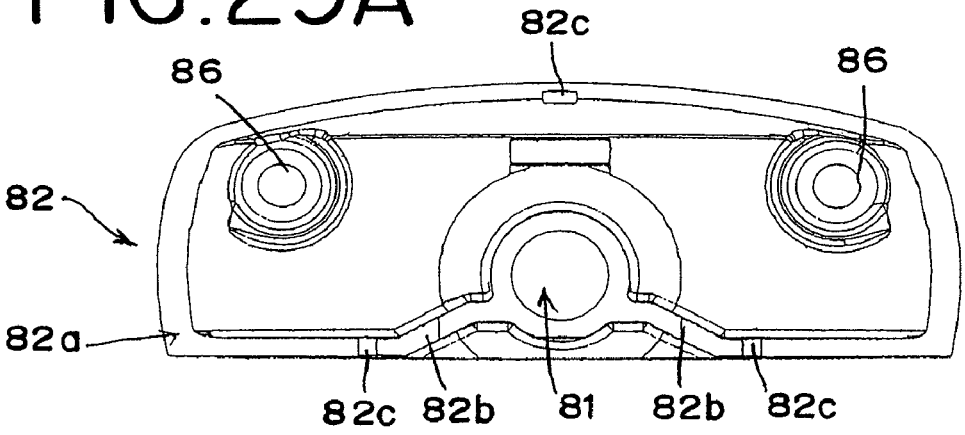
FIG. 29A is a bottom view of the housing of FIG. 29.
Figure 30:
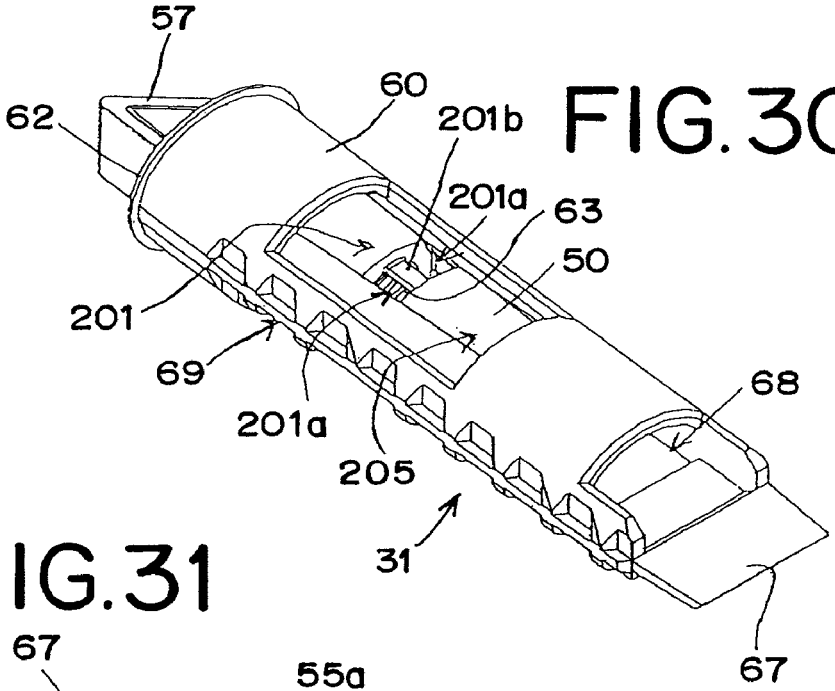
FIG. 30 is a perspective view of a tilt latch mechanism of the integrated tilt latch and sash lock assembly of FIG. 4.
Figure 31:
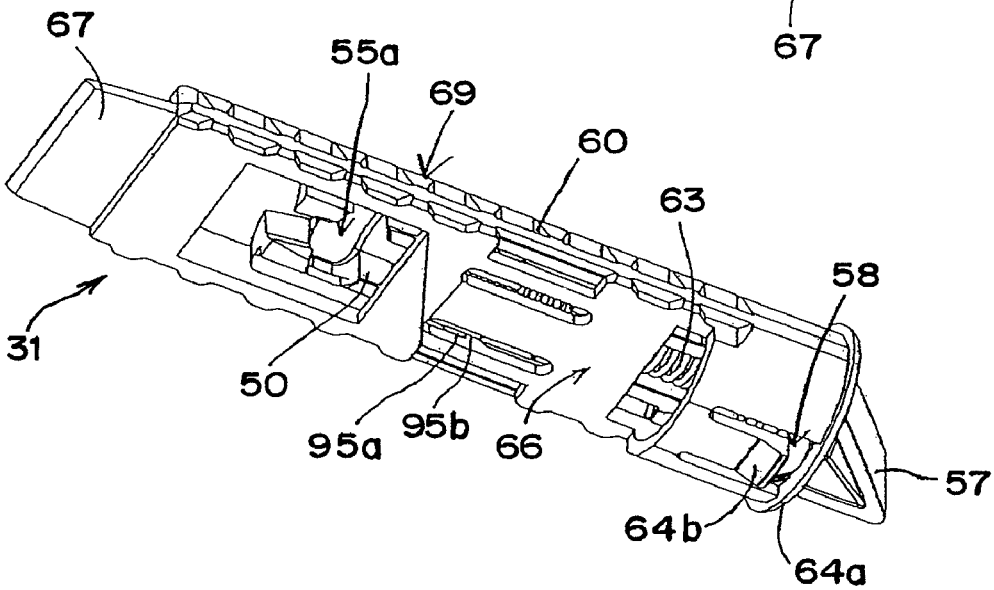
FIG. 31 is a bottom perspective view of the tilt latch mechanism of FIG. 30.
Figure 32:
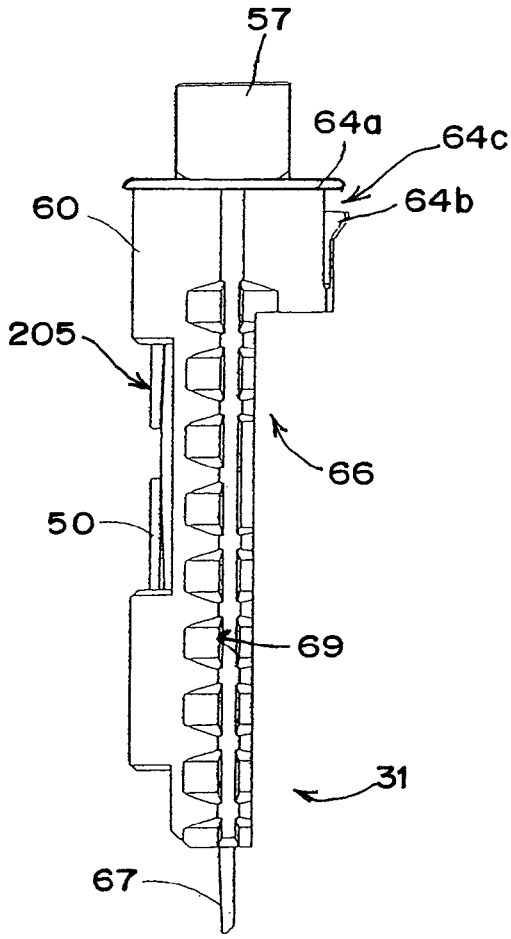
FIG. 32 is a rear view of the tilt latch mechanism of FIG. 30.
Figure 33:
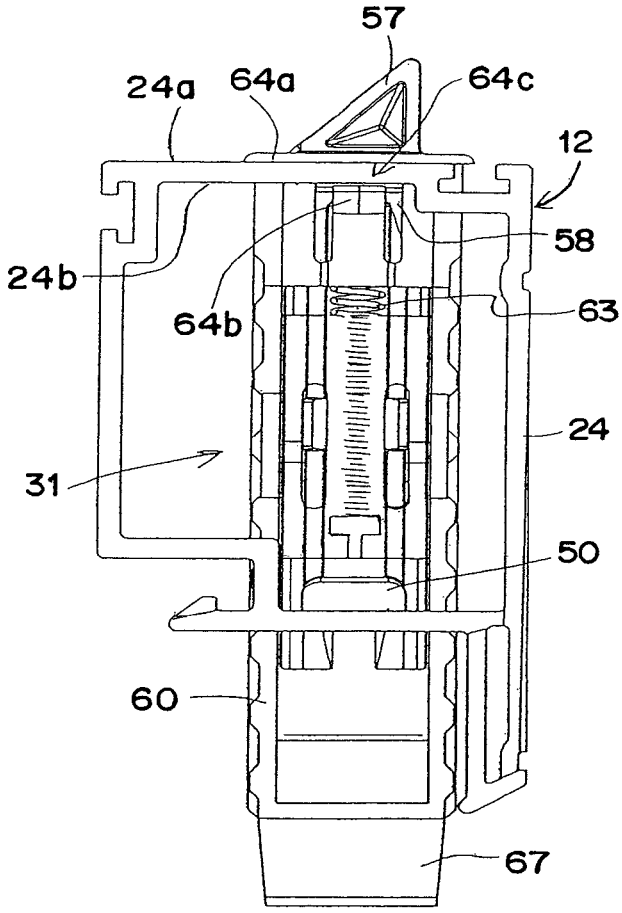
FIG. 33 is a bottom view of the tilt latch mechanism of FIG. 30 mounted in a stile of a sash window assembly.
Figure 34:
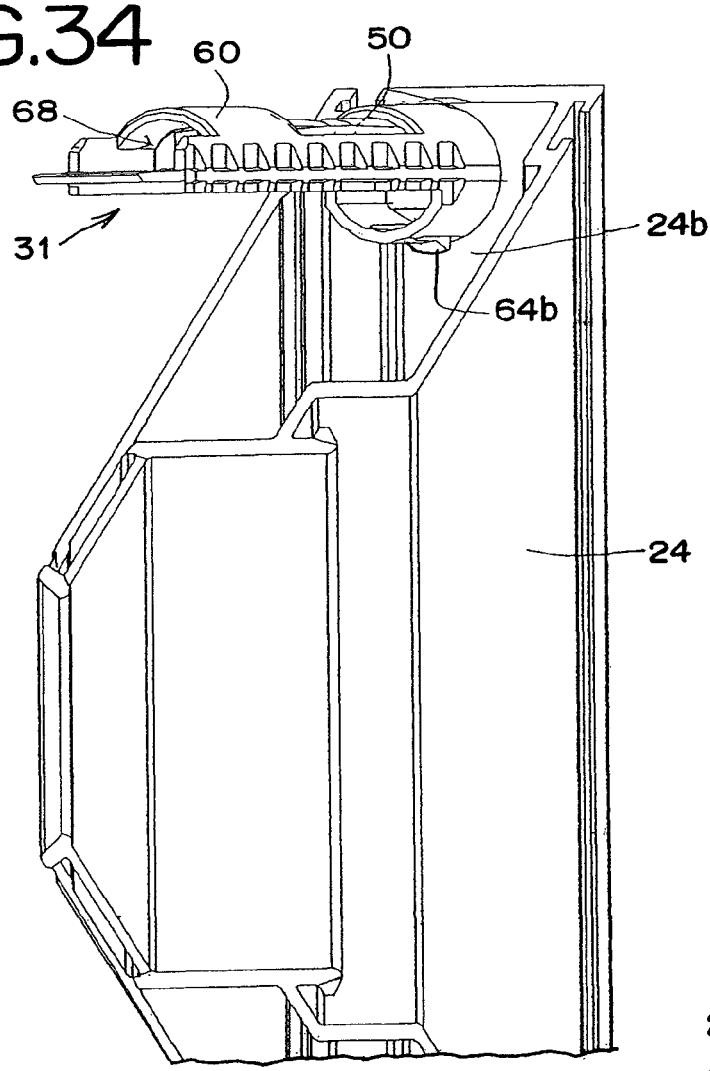
FIG. 34 is a perspective view of the tilt latch mechanism and stile of FIG. 33.

As shown in FIGS. 4-20, the illustrated embodiment of the sash lock mechanism 32 includes an actuator arm or handle 36 connected to a cam or rotor 44 which is operably connected to a pawl 72, and a housing 82 supporting the other components of the sash lock mechanism 32. The housing 82 is adapted to be mounted on the top sash rail 20 to mount the sash lock mechanism 32 to the sash window assembly 10, and is shown in greater detail in FIG. 29. In one exemplary embodiment, the housing 82 is made of cast metal and has a curvilinear surface. The housing 82 has an opening 81 therein and indicia 85 on the top surface thereof, as well as a pair of screw apertures 86 for insertion of fasteners to connect the housing 82 to the top sash rail 20. Additionally, as shown in FIG. 29, the housing 82 has an annular ledge 87 having two protrusions 88 positioned at points around the ledge 87. The inside of the housing 82 also has an added beam rail 82*b*, to provide more structural support to the housing 82, as shown in FIGS. 15 and 29A. Further, as illustrated in FIGS. 3A and 29A, the housing 82 has several tabs 82*c* that abut the inner surfaces of the sash lock opening 91 in the top sash rail 20 to hold the housing 82 in place when mounted on the top sash rail 20.

Figure 28:
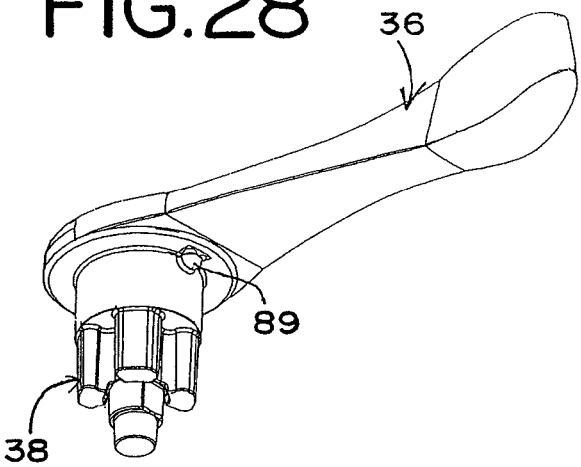
FIG. 28 is a bottom perspective view of an actuator handle of the sash lock mechanism of FIG. 15.

The actuator handle 36 has a shaft 38 extending through the opening 81 in the housing 82 and connected to the cam 44. As shown, for example, in FIG. 15A, the shaft 38 is received within a complementarily-shaped shaft opening 39 in the cam 44, so that movement of the actuator handle 36 effects rotation of the cam 44. Additionally, a projection 89 is located at the base of the shaft 38, as shown in FIG. 28. When the shaft 38 is inserted into the opening 81 in the housing 82, the projection 89 engages the protrusions 88 on the ledge 87 of the housing 82 during rotation of the actuator handle 36, creating a tactile "feel" and indicating positions of the actuator handle 36, as described in greater detail below. The actuator handle 36 is adapted to be manipulated by a user to move the integrated assembly 30 between the locked position, the unlocked position, and the tiltable position, and thus, the actuator handle 36 has a locked position, an unlocked position, and a tiltable position. The indicia 85 on the housing indicate when the actuator handle 36 is in each of the three positions.

Figure 18:
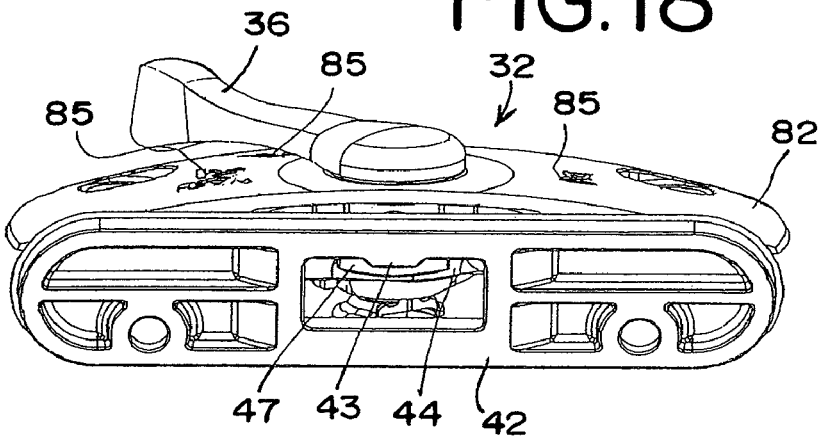
FIG. 18 is a rear view of the sash lock mechanism and keeper of FIG. 15, shown in the unlocked position.
Figure 26:
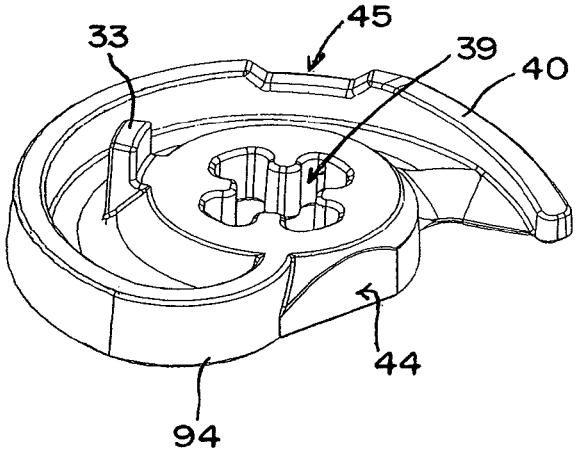
FIG. 26 is a perspective view of a cam of the sash lock mechanism of FIG. 15.
Figure 27:
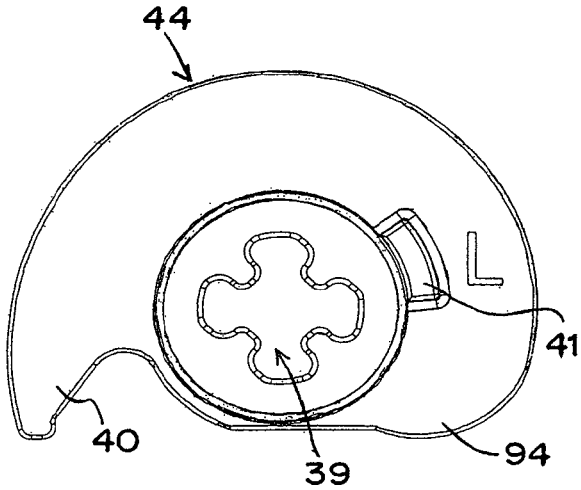
FIG. 27 is a bottom view of the cam of FIG. 26.

An exemplary embodiment of the cam 44 is illustrated in greater detail in FIGS. 26-27. The cam 44 is rotatably supported within and below the housing 82 and includes a locking member 40 configured to engage the keeper 42 to lock the sash window 12. The cam 44 is rotated by movement of the actuator handle 36 between a locked position, wherein the locking member 40 of the cam 44 engages the keeper 42 to lock the window 12 in place, and an unlocked position, wherein the locking member 40 of the cam 44 is disengaged from the keeper 42, allowing the window 12 to slide. The cam 44 also includes an abutment member 41 depending from the bottom surface thereof and a stub 33 extending from the top surface thereof. The stub 33 abuts the housing 82 at the ends of the range of rotation of the cam 44, thereby defining and limiting the range of rotation. The abutment member 41 engages the pawl 72, as described in greater detail below. Further, the cam 44 has a means 94 for selectively preventing movement of the integrated assembly 30 to the tiltable position, which generally takes the form of an extending member 94 extending from the cam 44. The extending member 94 may also be referred to as a leg 94 or an abutment member 94 for abutting the keeper 42. In one embodiment, illustrated in FIGS. 26-27, the extending member 94 is an enlarged or eccentric portion 94 of the cam 44 that is rotationally opposite of the locking member 40. When the integrated assembly 30 is in the unlocked position, and a user wishes to move the actuator handle 36 to the tiltable position, the eccentric portion 94 abuts a portion of the keeper 42, preventing rotation of the cam 44. In order to rotate the actuator handle 36 and cam 44 further, the user must lift the sash window 12 slightly, to allow the eccentric portion 94 to clear the keeper 42, and the actuator handle 36 can thus be moved to the tiltable position. Still further, in one embodiment, the cam 44 and the keeper 42 have complementary engaging structures that engage each other when the cam 44 is in the locked position to provide a more secure locking connection and create a tactile feel to alert the user that the cam 44 is in the locked position. As shown in FIGS. 15, 15B, and 18, the cam 44 has a notch 45 on or near the locking member 40 that receives a projection 43 on the keeper 42 when the cam 44 is in the locked position to accomplish this function.

Figure 15A:
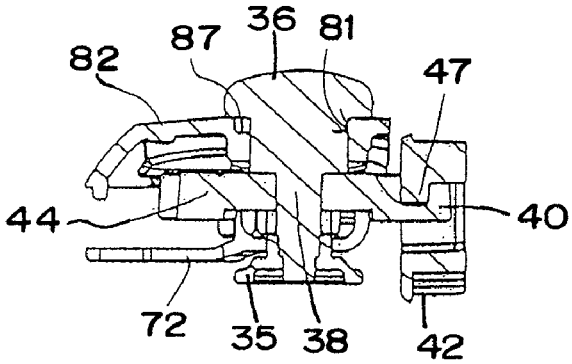
FIG. 15A is a cross-sectional view of the sash lock mechanism and keeper of FIG. 15, shown in the locked position.
Figure 15B:
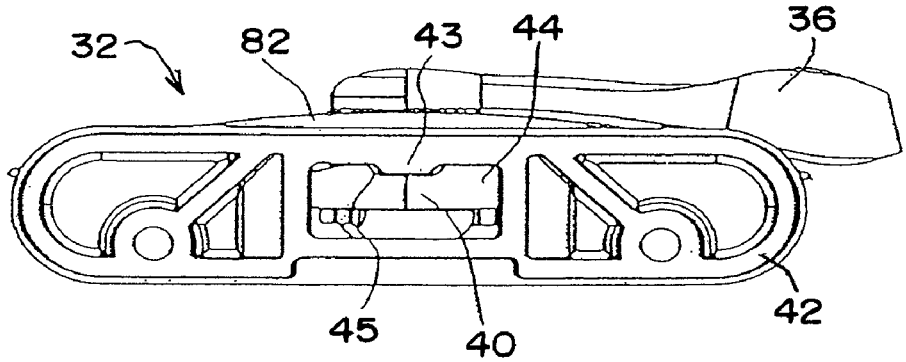
FIG. 15B is a rear view of the sash lock mechanism and keeper of FIG. 15, shown in the locked position.
Figure 16:
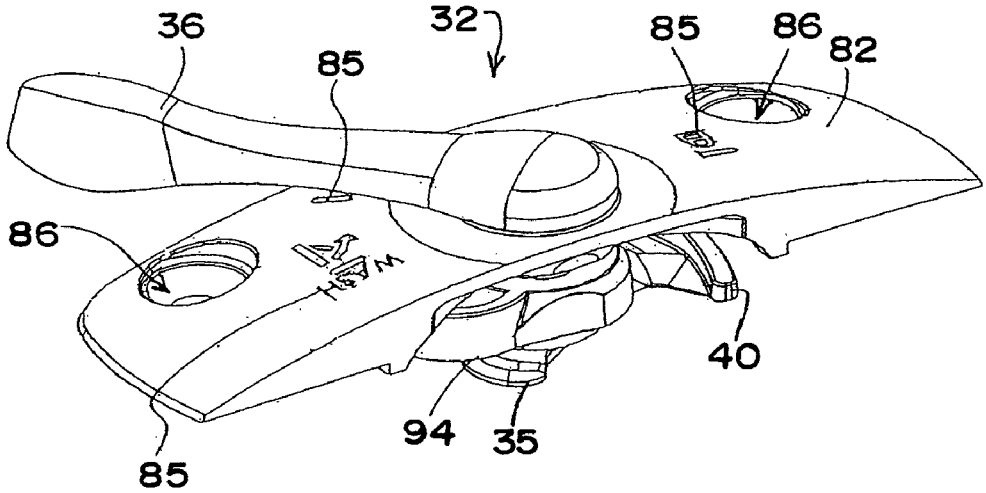
FIG. 16 is a rear perspective view of the sash lock mechanism of FIG. 15, shown in the unlocked position.
Figure 17:
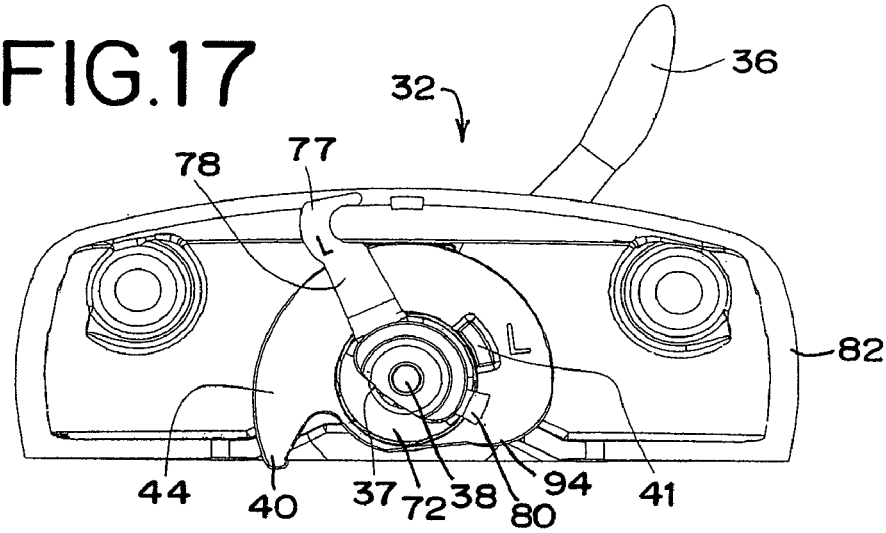
FIG. 17 is a bottom view of the sash lock mechanism of FIG. 15, shown in the unlocked position.

The interlocking between the locking member 40 of the cam or rotor 44 and the keeper 42 is illustrated in more detail in FIGS. 15A and 15B. As shown in FIGS. 15, 15B, and 18, the keeper 42 has a projection 43 that is cooperatively dimensioned with a notch 45 in the rotor 44. When the notch 45 and the projection 43 are aligned, the projection 43 will slip into the notch 45, giving the user a "feel" indication that the assembly 30 is securely in the locked position. Additionally, the keeper 42 has a tongue 47 that interlocks with the locking member 40 of the rotor 44 to hold the sash window 12 more securely closed and give additional protection against forced entry, as illustrated in FIGS. 15, 15A, and 15B.

Figure 19:
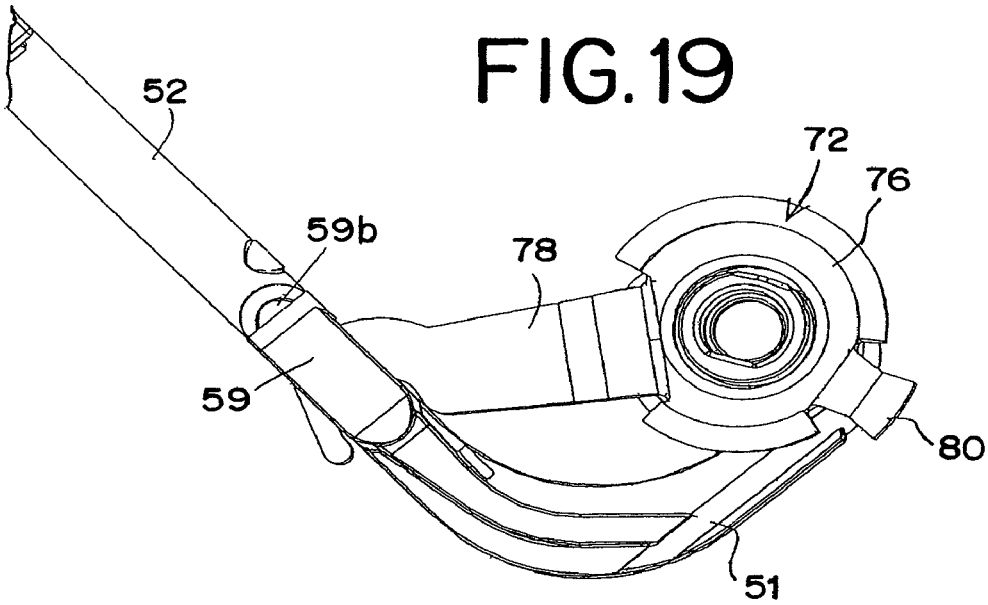
FIG. 19 is a top view of a pawl and a cap of the sash lock mechanism of FIG. 15 and an end of a connector of the integrated tilt latch and sash lock assembly of FIG. 4.
Figure 20:
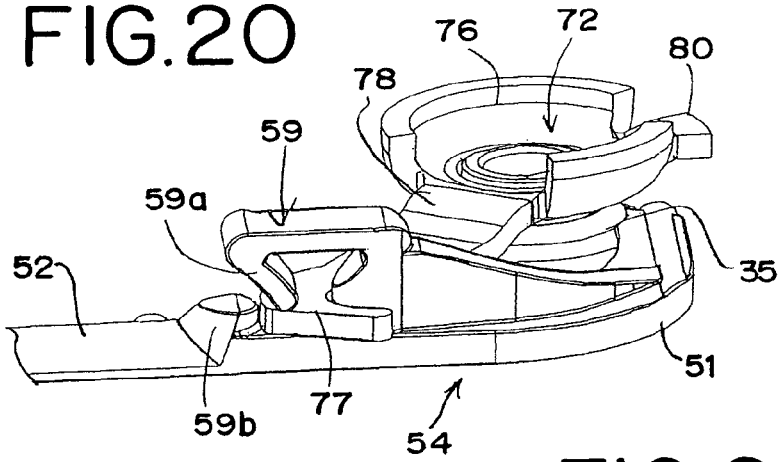
FIG. 20 is a perspective view of the pawl, cap, and connector end of FIG. 19.
Figure 21:
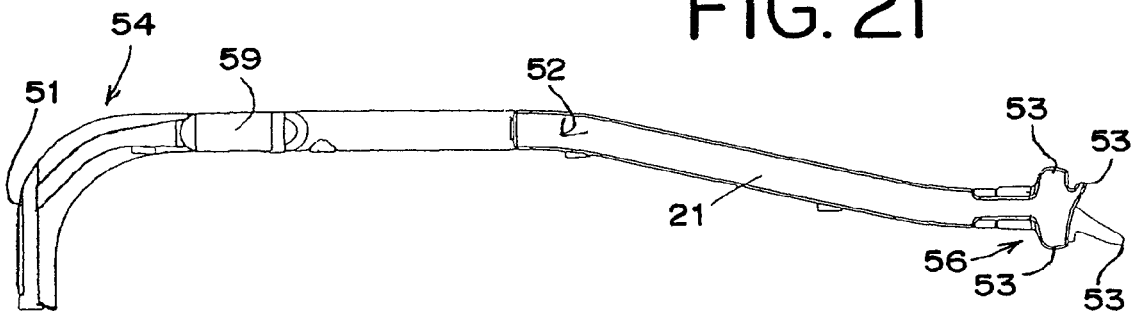
FIG. 21 is a top view of the connector of the integrated tilt latch and sash lock assembly of FIG. 4.
Figure 22:
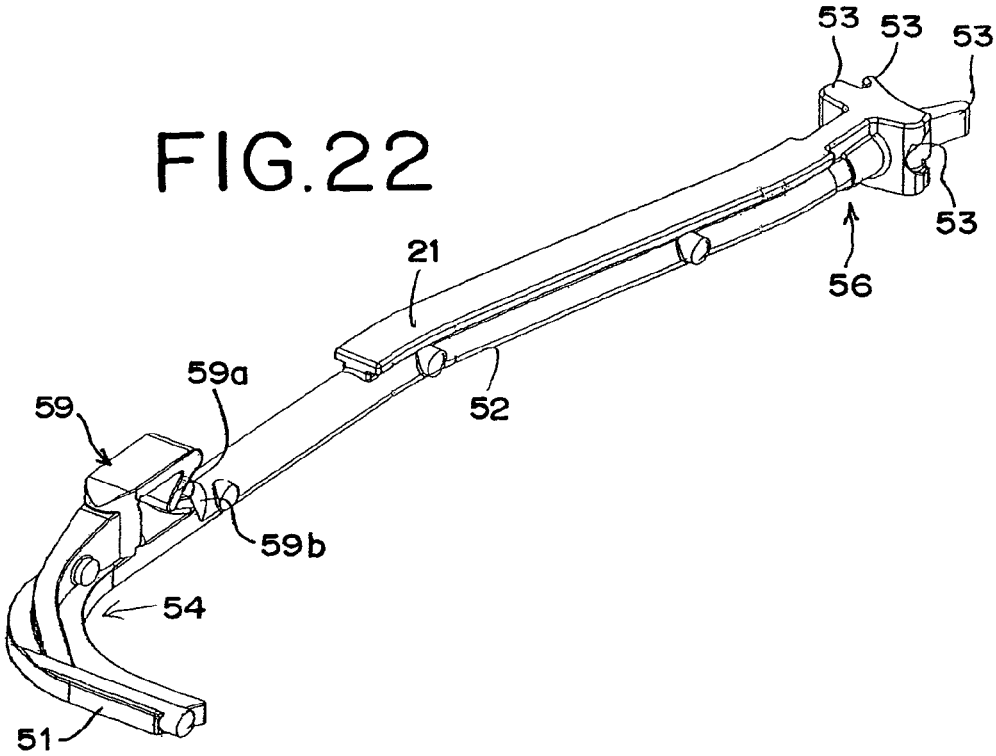
FIG. 22 is a rear perspective view of the connector of FIG. 21.
Figure 23:
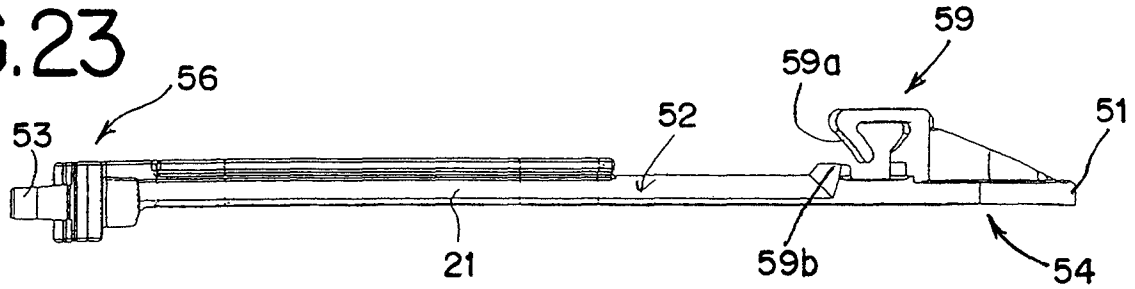
FIG. 23 is a front view of the connector of FIG. 21.
Figure 25:
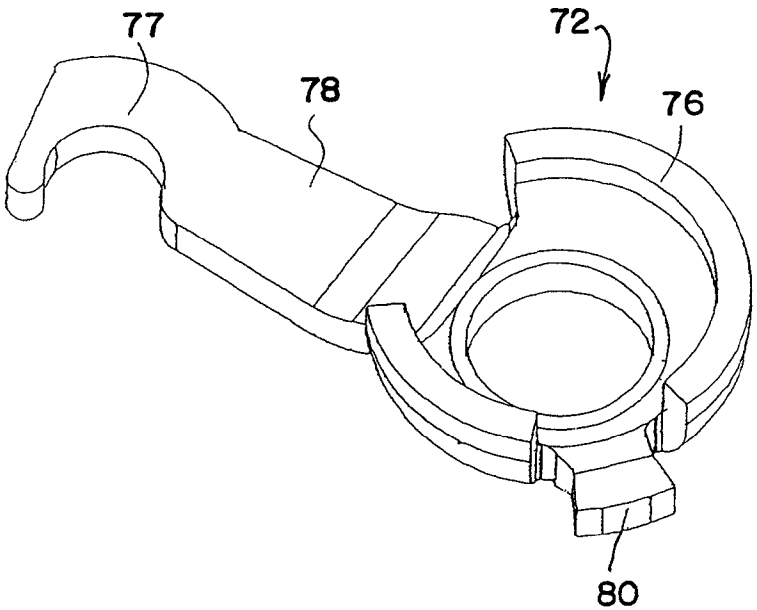
FIG. 25 is a perspective view of the pawl of FIG. 19.
Figure 24:
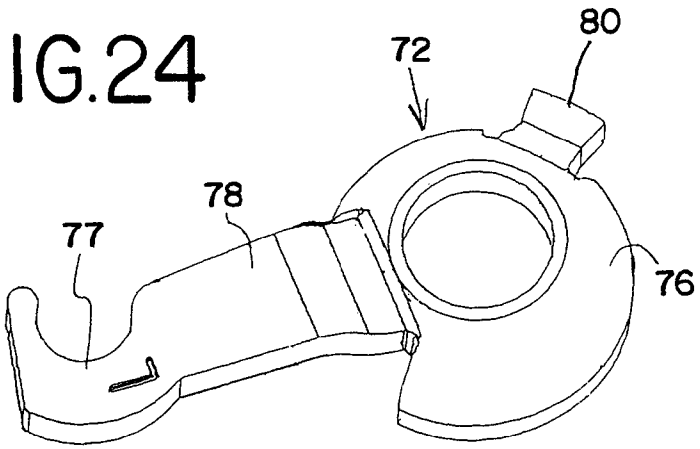
FIG. 24 is a bottom perspective view of the pawl of FIG. 19.

One exemplary embodiment of the pawl 72 is illustrated in greater detail in FIGS. 19-20 and 24-25. The pawl 72 includes a base 76 and a pawl member or appending member 78. The pawl 72 is operably associated with the connector 52 that extends away from the sash lock mechanism 32 to the tilt-latch mechanism 31. In one embodiment, the appending member 78 contains a hook 77 that engages a hitch 59 on the connector 52, directly connecting the pawl 72 to the connector 52, as illustrated in FIGS. 19-20. In this embodiment, the connector 52 contains a retaining structure to hold the hook 77 in place, which includes a flexible lip 59*a* and a protrusion 59*b*. The combination of the lip 59*a* and the protrusion 59*b* force the hook 77 into the retaining structure and then hold the hook 77 in place once the hook 77 is engaged with the hitch 59, forming a snap-fit connection. The pawl 72 is also operably connected to the cam 44 such that rotation of the cam 44 causes rotation of the pawl 72 through a portion of the range of rotation of the cam 44. The cam 44 and the pawl 72 are disposed proximate one another in operable association with each other and a tab 80 extends outwardly from an outer surface of the pawl base 76 to engage the abutment member 41 of the cam 44. Movement of the actuator handle 36 causes the cam 44 to rotate. In the embodiment illustrated, the cam 44 rotates freely and independently of the pawl 72 for a portion of the range of rotation. However, at a point in the rotation, the abutment member 41 of the cam 44 abuttingly engages the tab 80 of the pawl 72, such that when engaged, the cam 44 and the pawl 72 generally rotate in unison. Thus, the actuator handle 36, the cam 44, and the pawl 72 are all operably associated with each other.

The sash lock mechanism 32 illustrated in FIGS. 4-20 additionally includes an asymmetrical or eccentric cap 35 that is operably coupled to the actuator 36 to rotate with movement of the actuator 36. In one embodiment, the cap 35 is positioned on the bottom side of the pawl 72, opposite the rotor 44, protecting the pawl 72 and securing it to the sash lock mechanism 32. Additionally, in one embodiment, the cap 35 is asymmetrical and eccentric in shape, having a beveled or flattened portion 37. The cap 35 operates in a camming action with a curved arm 51 of the connector 52. As the actuator 36 is turned from the locked position, the cap 35 rotates with the cam 44. At a certain point along the rotation, the eccentric nature of the cap 35 causes the cap 35 to engage the arm 51 on the connector 52. Further rotation of the cap 35 exerts a force on the connector arm 51, pulling the connector 52 slightly, which in turn retracts the latch bolt 50 slightly. This permits the integrated assembly 30 to begin retraction of the latch bolt 50 prior to the point where the rotor 44 abuttingly engages the pawl 72.

The integrated assembly shown in FIGS. 4-14 contains one embodiment of the tilt latch mechanism 31, which is shown in greater detail in FIGS. 30-38. The tilt latch mechanism 31 is disposed within the sash window 12, such as within a cavity 90 in the sash window 12 that extends through both the stile 24,26 and the top sash rail 20. This embodiment of the tilt latch mechanism 31 includes a latch bolt 50 disposed within a housing 60 and coupled to the connector 52, and a means 63 for biasing the latch bolt outwardly, which, in the embodiment illustrated in FIGS. 30-33, is a spring 63. It is understood the spring 63 is generally positioned between the latch bolt 50 and the housing 60 to bias the latch bolt 50 outwardly from the housing 60 through a latch bolt opening 62 in the end of the housing 60. In one embodiment, the spring 63 is not evenly coiled, but rather has densely-coiled portions and more loosely-coiled portions. These densely-coiled portions prevent springs 63 stored in bulk from becoming intertwined and/or stuck together.

Figure 36:
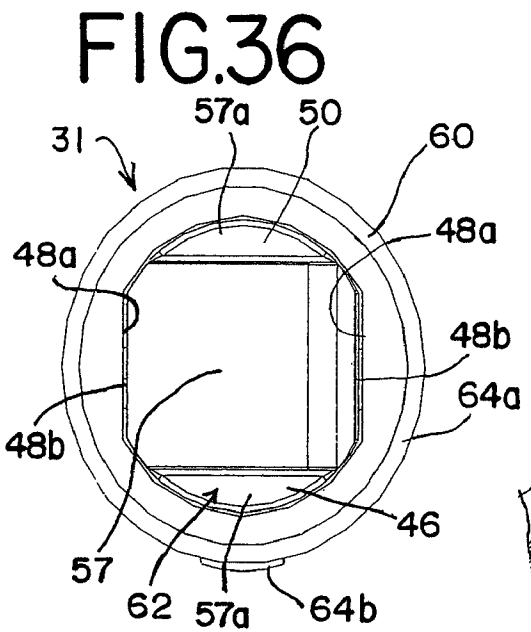
FIG. 36 is a side view of the tilt latch mechanism of FIG. 30.

The housing 60 is used to support the latch bolt 50 within the sash window 12. In one embodiment, the housing 60 is substantially cylindrical, having a curvilinear outer surface and appearing round when viewed in a side view (FIG. 36). The cylindrical housing 60 is adapted to be inserted into a round hole 92 in one of the stiles 24,26, as shown in FIGS. 2, 2A, 33, and 34, so that no hole in the top sash rail 20 is necessary for installation, and the tilt latch mechanism 31 is completely hidden beneath the top sash rail 20. The housing 60 has opposed stile-engaging members 64 that are adapted to engage both an outer surface 24*a* and an inner surface 24*b* of the stile 24. In the embodiment shown in FIGS. 33-34, the tilt latch mechanism 31 has stile-engaging members 64 in the forms of a circular flange 64*a* around the latch bolt opening 62 that engages the outer surface 24*a* of the stile 24 and a flexible, resilient tab 64*b* that engages the inner surface 24*b* of the stile 24. More generally, the tilt latch housing 60 contains a flange 64*a* and a tab 64*b* defining a gap 64*c* therebetween, and a portion of the lower sash window 12 is received within the gap 64*c*. The flange 64*a* and the tab 64*b* cooperate to hold the tilt latch mechanism 31 in place within the sash window 12. The housing 60 also includes a window 58 around the tab 64*b*, which provides ample room for the tab 64*b* to flex upward upon contact with the stile 24 during insertion of the tilt latch mechanism 31 into the sash window 12. In the embodiment shown in FIGS. 33-34, the window 58 is dimensioned cooperatively with the tab 64*b*, so that the tab 64*b* can easily deflect into the housing 60 through the window 58. Once the tab 64*b* clears the inner surface 24*b* of the stile 24, the resilient tab 64*b* snaps back into its original position to engage the inner surface 24*b* of the stile 24. The flexible, resilient tab 64*b* is able to deflect as described above without being permanently deformed.

The cylindrical housing 60 has a curvilinear outer sidewall 61 having a series of ribs 69 thereon, a rear opening 68, and a stabilizing member 67 proximate the rear opening 68. The rear opening 68 allows the connector 52 to pass through and connect to the latch bolt 50, and is defined at the rear of the housing 68, opposite the latch bolt opening 62, as illustrated in FIGS. 4-14 and 30. The ribs 69 create a waffle-structure that strengthens the housing and improves its strength:weight ratio. In one embodiment, the stabilizing member 67 is a flat tongue 67 extending from the housing 60 proximate the rear opening 68, and is adapted to engage an inner wall 20*a* of the top sash rail 20 to stabilize the housing 60 and prevent the housing 60 from rotating within the sash window 12. As shown in FIG. 3, the stabilizing member 67 rests upon the inner wall 20*a* of the top sash rail 20. It is understood that the stabilizing member 67 may have another configuration suitably adapted to engage the inner wall of the top rail 20. The housing 60 of the tilt latch mechanism shown in FIGS. 4-14 and 30-38 also has a cut-out portion 66 at the bottom of the housing 60 and a slot or elongated opening 23 at the top of the housing 60. The cut-out portion 66 decreases the size of the housing 60, both allowing the housing 60 to fit into smaller spaces and decreasing the amount of material used to manufacture the housing 60. Thus, a portion of the housing proximate the latch bolt opening 62 is a complete cylinder, and the rear portion of the housing 60 is partially-cylindrical. The slot 23 allows for insertion of an actuator (not shown) to operate the tilt latch mechanism 31 independently, and the latch bolt has connecting structure 23*a*, 23*b* to permit connection of such an actuator (FIG. 35).

Figure 35:
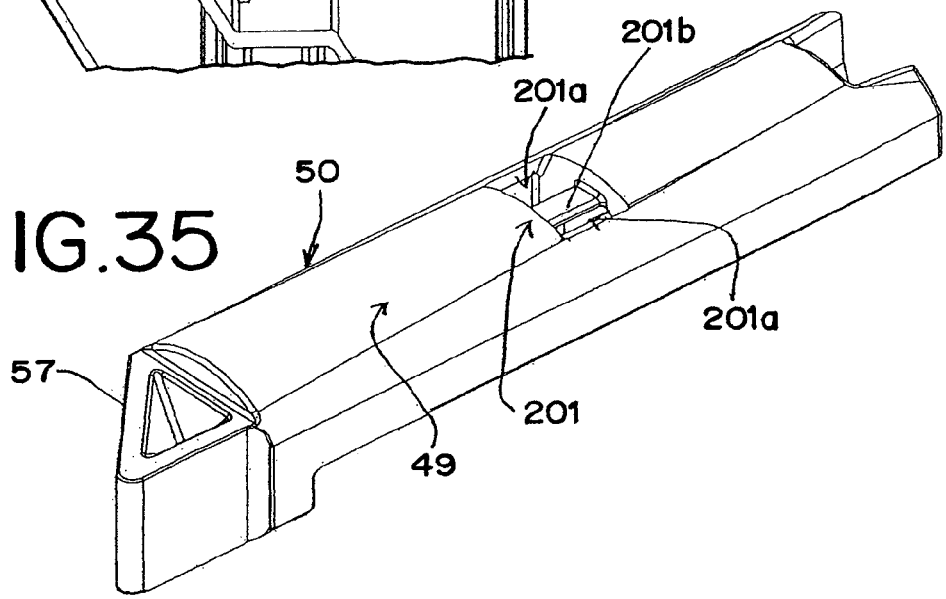
FIG. 35 is a perspective view of a latch bolt of the tilt latch mechanism of FIG. 30.
Figure 38:
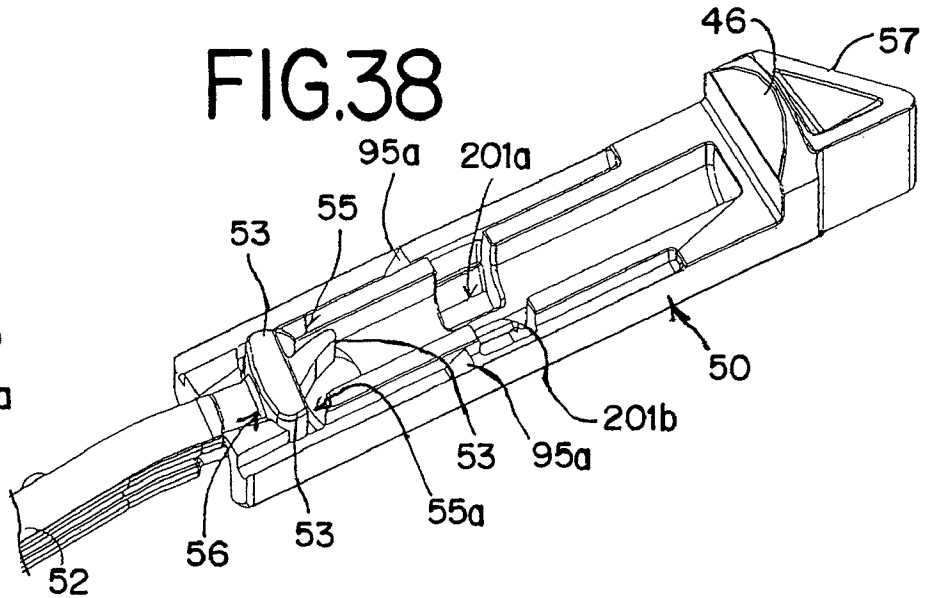
FIG. 38 is a bottom perspective view of the latch bolt of FIG. 35 and an end of the connector of the integrated tilt latch and sash lock assembly of FIG. 4.
Figure 37:
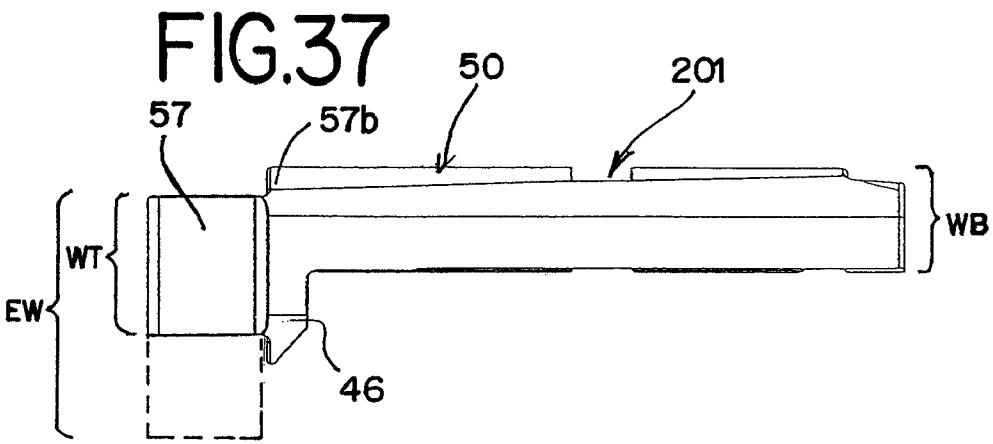
FIG. 37 is a front view of the latch bolt of FIG. 35.

The latch bolt 50 of the tilt latch mechanism 31 of FIGS. 4-14 and 30-38 is shown alone in FIGS. 35, 37, and 38. The latch bolt 50 is adapted to slide within the housing 60 between a retracted position, wherein the nose or tip 57 of the latch bolt 50 is retracted into the housing 60, and an outwardly-extended position, wherein the nose 57 of the latch bolt 50 extends beyond the end of the housing 60 and beyond the edge of the stile 24,26. This movement of the latch bolt 50 is shown in FIGS. 4-14 and is discussed in greater detail below. When the sash window 12 is closed, the latch bolt 50 engages one of the guide rails 16 in the outwardly-extended position to prevent the window 12 from tilting. The spring 63 is generally positioned between a portion of the latch bolt 50 and a portion of the housing 60, and biases the latch bolt 50 towards the outwardly-extended position. Additionally, the nose or tip 57 of the latch bolt 50 is generally angled or beveled on one side, so that the window 12 may be shut wherein the beveled surfaces engage edges of the guide rails 16 as the sash window 12 is pivoted to the vertical position wherein the latch bolts 50 are retracted into the housing 60 and then extend back outwardly to engage the guide rails 16 when the sash window is in the unpivoted position.

The latch bolt 50 is dimensioned to fit properly within the cylindrical housing 60, which has a rounded latch bolt opening 62, as shown in FIG. 36. Thus, in the embodiment the latch bolt 50 has at least one generally rounded portion. In the embodiment shown in FIGS. 35-38, the latch bolt opening 62 of the housing 60 is generally circular with beveled or flat edges 48*a*, and an end portion 46 of the latch bolt 50 is similarly dimensioned, being generally circular with beveled flat edges 48*b*. The cooperative engagement of the beveled edges 48*a*,48*b* prevent rotation of the latch bolt 50 within the housing 60. In one embodiment, the tip 57 of the latch bolt 50 has a different cross-sectional shape than the portion of the latch bolt 50 immediately adjacent the tip 57. As shown in FIG. 36, the tip 57 is rectangular and extends from the enlarged end portion 46 that is dimensioned to fill the latch bolt opening 62. The transition or "filler" segments 57*a* caused by difference in shape between the rectangular tip 57 and the rounded body of the latch bolt 50 can be seen in FIG. 36. As discussed, the tilt-latch housing 60 has generally circular cross-section while the tip 57, or nose 57, of the latch bolt 50 has more of a rectangular cross-section. The latch bolt 50 includes the filler segments 57*a* that "fill" the areas between the tip 57 and the rounded surfaces defining the end opening 62 of the housing 60. Thus, the segments 57*a* have a planar portion adjacent the tip 57 and a rounded portion adjacent the housing 60. It is understood that in one embodiment, fill segments 57*a* are integral with the latch bolt 50.

Further, as illustrated in FIG. 37, the width (WT) of the tip 57 of the latch bolt 50 and the width of the portion 57*b* of the latch bolt 50 adjacent the tip 57 are generally greater than the width (WB) of the bulk of the latch bolt 50. Thus, even though the main portion of the latch bolt 50 is sized to fit within the tilt-latch housing 60 having a smaller configuration to fit within smaller pockets of the top rail 20, the width (WT) of the tip 57 can have a conventional width that provides a suitable engagement surface for the guide rails 16. In another embodiment, the tip 57 of the latch bolt 50 may be substantially larger than the rest of the latch bolt 50 or even larger than the housing 60 to provide a larger engagement surface (EW) because the latch bolt tip 57 need not fit completely into the housing 60. This enlarged design is shown schematically by the dotted lines in FIG. 37. The housing 60 can be designed with a slot or gap (not shown) therein to permit retraction of a latch bolt tip 57 much wider than the housing 60. In such case, the flexible stile engaging member 64*b* may be suitably relocated on the housing 60. The hole provided in the stile would also be enlarged to accommodate the enlarged nose or tip 57. Thus, the latch bolt 50 and housing 60 can be designed to be very small, while the tip 57 of the latch bolt 50 can be of a different size. As shown in FIGS. 35 and 37, the latch bolt 50 has a rounded top surface 49 that is dimensioned similarly to the rounded housing 60. Additionally, in one embodiment, the latch bolt 50 has a stop 95*a* (FIG. 38) that abuts an abutment surface 95*b* of the housing 60 to prevent the latch bolt 50 from being pushed out of the housing 60 farther than is necessary for engaging the guide rail 16. It is understood that the latch bolt 50 and the cavity of the housing 60 may be differently shaped, and may include different features to prevent rotation of the latch bolt 50 within the housing 60.

The connector 52 connects to the latch bolt 50, such as by a snap-fit connection 55, as illustrated in FIGS. 4-14 and 38. The latch bolt 50, as shown, has a recess 55*a* on the underside of the latch bolt 50 to receive the end 56 of the connector 52 and create the snap-fit connection 55. As illustrated in FIGS. 21-23 and 38, the second end 56 of the connector 52 has several resilient bracing arms 53 extending therefrom. When the connector end 56 is snapped into the latch bolt 50, the bracing arms 53 exert directional forces on the latch bolt 50, thus bracing the connector 52 against excessive movement during operation of the assembly 30. Also, the top wall of the housing 60 covers the snap fit connection 55 when the latch bolt 50 is extended, resisting disconnection of the connector 52 from the latch bolt 50.

The integrated assembly 30 includes a connector 52 that connects the sash lock mechanism 32 to the tilt latch mechanism 31. The connector 52 has a substantially rigid or semi-flexible, elongated body 21 with a first end 54 connected to the sash lock mechanism 32 and a second end 56 connected to the tilt latch mechanism 31. The first end 54 of the connector 52 is operably associated with the pawl 72, such as by engaging the appending member 78 of the pawl 72. As described above, the connector 52 has the hitch 59 that engages the hook 77 on the appending member 78 of the pawl 72 and the retaining structure that includes the flexible lip 59*a* and the protrusion 59*b*. The second end 56 of the connector 52 is connected to the latch bolt 50, such as by passing through the rear opening 68 of the housing 60 and forming a snap-fit connection 55 with the latch bolt, as described above and illustrated in FIGS. 4-14 and 38. As also described above, when the connector end 56 is snapped into the latch bolt 50, the bracing arms 53 exert directional forces on the latch bolt 50, thus bracing the connector 52 against excessive movement during operation of the assembly 30. Additionally, the bracing arms 53 exert a downward force or torque on the connector 52, tending to push the first end 54 of the connector downward. Pushing the first end 54 of the connector 52 downward helps assure that the connector 52 remains in the proper position for connection to the sash-lock mechanism 32, facilitating a user in making a blind connection between the connector 52 and the sash lock mechanism 32. However, the positioning of the bracing arms 53 permits a certain amount of lateral pivoting of the connector 52, which enables mounting in different positions, as described below.

In one exemplary embodiment, the connector 52 is a substantially rigid or semi-flexible connecting rod having an elongated body 21. The rigid or semi-flexible connector 52 has a bend in the middle to prevent interference between the connector 52 and mounting structure for the sash lock mechanism 32. Further, the connector 52 has a curved arm 51 at the first end 54 that engages the eccentric cap 35 of the sash lock mechanism 32 to retract the latch bolt 50 slightly, as described below. The non-flexible nature of the connector 52 provides advantages over prior connecting means that utilize flexible cords or bands. For example, the non-flexible connector 52 has increased dimensional stability, so the connector 52 doesn't stretch over time and affect the functioning of the integrated assembly 30. However, in another embodiment, a flexible cord or band may be used as the connector 52 of the present invention.

The length of the connector 52 used with the integrated assembly 30 can vary as desired, for example, in order to mount the integrated assembly 30 in windows of different dimensions. In one embodiment, the connector 52 has a fixed length, and thus, different connectors 52 having different lengths can be produced and selected for use as desired. In other words, the connector 52 selected from a group consisting of a plurality of connectors 52 having different lengths.

In one exemplary embodiment, the mounting length between the center of rotation of the cam 44 (i.e., the center of the shaft 38) and the stile outer surface 24*a* is 15-25% of the total length of the top rail 20 when the integrated assembly 30 is mounted in the sash window 12. This positioning maximizes the strength of the top rail 20. In one configuration, the mounting length is 4.5 in. (±1 in.), and the corresponding length of the connector 52 is 3.520 in. (±1 in.). In another configuration, the mounting length is 7.75 in. (±1 in.), and the corresponding length of the connector 52 is 6.770 in. (±1 in.). In a third configuration, the mounting length is 11 in. (±1 in.), and the corresponding length of the connector 52 is 10.020 in. (±1 in.). As described above, a nearly infinite number of other configurations are possible. The connector 52 lengths are selected based on window size and to enhance overall manufacturability, strength, and user operation.

The components of the integrated assembly 30 of FIGS. 1-38 are connected as shown in FIGS. 4-14. First, the sash lock assembly 32 and the tilt latch assembly 31 are assembled. Assembly of the tilt latch mechanism 31 includes inserting the latch bolt 50 and the spring 63 into the housing 60 in the required positions. To assemble the sash lock mechanism, the shaft 38 of the actuator handle 36 is inserted down through the opening 81 in the housing 82 and is connected to the cam 44, extending down through the cam. The pawl 72 is then inserted onto the end of the shaft 38, and the cap 35 is connected over the pawl 72 at the tip of the shaft 38. A washer, grommet, bearing, or similar component (not shown) may also be inserted between the components of the sash lock mechanism 32. Finally, the connector 52 is connected at the second end 56 to the latch bolt 50 and at the first end 54 to the appending member 78 of the pawl 72 to operably connect the tilt latch mechanism 31 to the sash lock mechanism 32. As discussed in greater detail below, the tilt-latch mechanism 31 and connector 52 may be inserted into the top rail 20 and then the sash lock mechanism 32 is connected to the connector 52 and mounted on the top rail 20.

Figure 39:
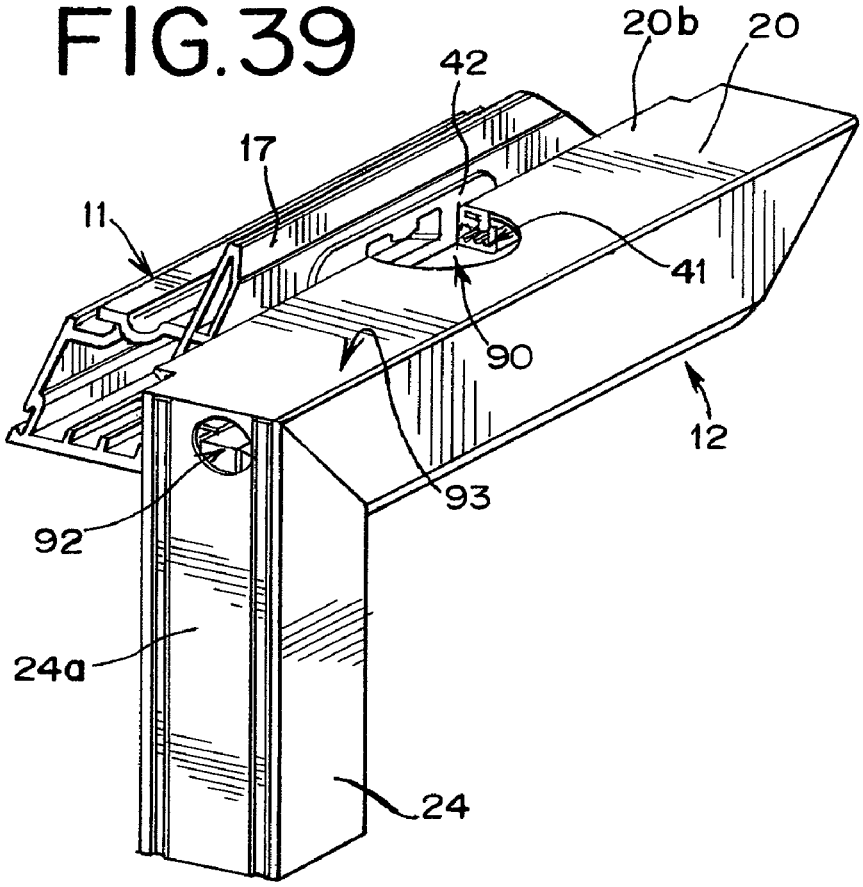
FIG. 39 is a perspective view of the portion of the sash window assembly of FIG. 2.
Figure 40:
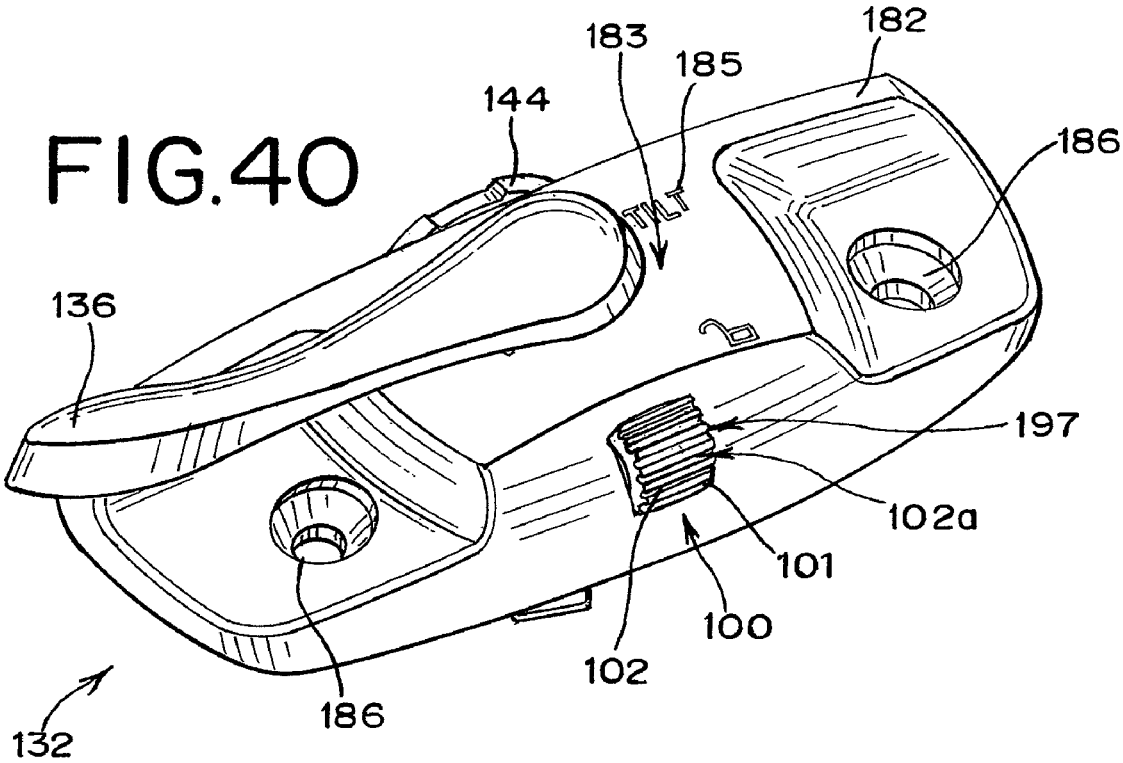
FIG. 40 is a perspective view of one embodiment of a sash lock mechanism having a forced entry resistance mechanism, shown in a locked position.

A variety of different methods can be used to mount the integrated assembly 30 in the sash window 12, as determined by the user. In one embodiment, the integrated assembly 30 is mounted within a cavity 90 in the sash window 12. The cavity 90 is in communication with a first opening 91 in the top sash rail 20 for the sash lock mechanism 32 and a second opening 92 in the stile 24,26 for the tilt latch mechanism 31, as illustrated in FIG. 39. The second opening 92 extends through the vertical outer surface 24*a* of the stile 24 and is located entirely below the horizontal outer surface 20*b* of the top rail 20. It is understood that in some embodiments, the second opening 92 may extend into a top surface 20*b* of the top rail 20 as well, depending on the configuration of the tilt latch mechanism 31. Generally, the user forms the openings 91,92 in the sash window 12 by cutting, drilling, routing etc., but it is contemplated that sash windows 12 could be manufactured with pre-formed openings 91,92. Advantageously, the rounded shape of the tilt latch housing 60 permits the tilt latch mechanism 31 to be mounted in a circular opening 92 in the stile 24,26. The circular opening 92 can be routed or drilled using a corresponding bit of suitable diameter, which is quicker, more precise, and greatly simplified with respect to prior tilt latch mounting procedures that often require stile openings of complex geometry. Further, the tilt latch mechanism 31 does not require an opening that extends through both the stile 24,26 and the top surface 20*b* of the top rail 20, which can lessen the overall strength of the top sash rail 20 and produce an undesirable appearance for some applications, as do many prior tilt latches. Thus, the tilt-latch mechanism 31 is mounted within the top rail 20 by an opening in the stile 24,26 wherein the top surface 20*b* of the top rail 20 is smooth and is not compromised by a top opening.

First, the second end 56 of the connector 52 is snapped to the latch bolt 50 of the assembled tilt latch mechanism 31 to form a snap fit connection 55, after the latch bolt 50 is pulled backward in the housing 60 to make the recess 55*a* accessible. Then, as can be appreciated from FIGS. 2 and 2A, the tilt latch mechanism 31 and connector 52 are inserted through the second opening 92 and into the cavity 90 in the sash window 12. When the tilt latch mechanism 31 is inserted into the opening 92, the tab 64*b* flexes upward upon contact with the stile 24,26 and snaps back into position upon clearing the wall of the stile 24,26. The flange 64*a* and the tab 64*b* then cooperate to hold the tilt latch mechanism 31 in place within the sash window 12. Thus, the tilt latch mechanism 31 can be mounted within the sash window 12 without the use of fasteners. At this point, the first end 54 of the connector 52 is exposed within the first opening 91. The assembled sash lock mechanism 32 is likewise installed in the first opening 91 so that the housing 82 rests upon the top surface 20*b* of the top sash rail 20 and a portion of the sash lock mechanism 32 extends into the cavity 90 in the sash window 12. The sash lock mechanism 32 should be positioned so that the appending member 78 of the pawl 72 is in position to engage the hitch 59 of the connector 52. In one embodiment, the sash lock housing 82 is fastened to the top sash rail 20 by screws or other fasteners (not shown). Once the tilt latch mechanism 31 and the sash lock mechanism 32 are in place, the connector 52 is connected to the appending member 78 of the pawl 72 by simply rotating the actuator handle 36, which causes the pawl 72 to rotate, forcing the hook 77 of the pawl 72 to snap into the hitch 59 on the first end 54 of the connector 52. Another integrated assembly may be mounted at the other side of the sash window 12 in a similar manner. The order of the steps in the mounting method described above may be varied, and further, the integrated assembly 30 may be mounted using a different method.

The first opening 91 is positioned at a first location and the second opening 92 is positioned at a second location remote from the first location, so that, when mounted, the sash lock mechanism 32 is positioned at the first location and the tilt latch mechanism 31 is positioned at the second, remote location. The positioning of the openings 91,92 on the sash window 12 can vary, based on several factors, including user choice and the size of the components of the integrated assembly 30. Generally, the tilt latch opening 92 can be moved an appreciable lateral distance without necessitating a change in components of the integrated assembly 30. The broken lines in FIG. 2A illustrate two potential positions to which the tilt latch opening 92 and the tilt latch mechanism 31 may be moved. The structure of the snap fit connection 55, particularly the bracing arms 53 of the connector 52, permit the connector 52 to pivot a certain distance laterally, creating a variety of different positions for connection. Thus, the lateral displacement between the tilt latch mechanism 31 and the sash lock mechanism 32 can vary. Further, the bracing arms 53 embody means and structure for resisting vertical movement and pivoting of the connector 52 while permitting lateral movement and pivoting of the connector 52.

When the integrated assembly 30 is mounted within the sash window 12, the sash lock mechanism 32 is located partially above the top wall 93 of the top sash rail 20 and partially below the top wall 93, as shown in FIGS. 3 and 3A. Mounting the sash lock mechanism 32 with a shallow mounting depth is advantageous because it allows the integrated assembly 30 to be mounted using a relatively shallow cavity 90. On the other hand, mounting the sash lock mechanism 32 with a large mounting depth is often considered more visually appealing because such a mounting generally results in a lower profile. Thus, the mounting configuration of the integrated assembly 30 offers a compromise, having a relatively shallow cavity 90 while still presenting a relatively low profile. As shown in FIGS. 3 and 3A, the integrated assembly 30 is mounted so the cam 44 is approximately level with the top wall 93 of the top sash rail 20. Thus, a portion 44*a* of the cam 44 is above the top sash rail 20 and a portion 44*b* of the cam 44 is below the top sash rail 20. It is understood that the mounting depth can be varied by altering the size, shape, and spacing of the components of the sash lock mechanism 32, including by altering the shape and/or curvature of the sash lock housing 82. Also, as shown in FIGS. 6, 7, 10, and 14, because the bottom surface 82*a* of the sash lock housing 82 rests on the top wall 93 of the top sash rail 20, the sash lock mechanism 32 is configured so that a portion 44*a* of the cam 44 is above the bottom surface 82*a* of the sash lock housing 82 and a portion 44*b* of the cam 44 is below the bottom surface 82*a* of the sash lock housing 82.

The keeper 42 is mounted on the bottom sash rail 17 of the upper sash window 11, within an opening cut into the side surface of the bottom sash rail 17, as shown in FIGS. 1 and 2. To mount the keeper 42, the opening is cut into the bottom sash rail 17 in the proper shape and the keeper 42 is inserted into the opening. The keeper 42 may be held in place by screws or other fasteners (not shown). The positioning of the cam 44 level with the top wall 93 of the top sash rail 20 of the bottom sash window 12 makes this positioning of the keeper 42 advantageous. In addition, this positioning of the keeper 42 presents a lower profile as compared to positioning the keeper 42 on top of the bottom sash rail 17.

As described above and illustrated in FIGS. 4-14, the assembly 30 is operable between a locked position, an unlocked position, and a tiltable position. The actuator handle 36 of the present invention is operable between locked, unlocked and tiltable positions, adjusting the assembly 30 between the three positions. The sash lock housing 82 has indicia 85 thereon to indicate the positions of the actuator handle 36. It is also contemplated that the actuator handle 36 can include some indicia thereon for assisting a user during operation. When the actuator handle 36 is in the locked position, illustrated in FIGS. 7-10, the locking member 40 of the cam 44 engages the keeper 42 (See FIGS. 15A and 15B) and the latch bolt 50 is in the outwardly-extended position, engaging the guide rail 16. Accordingly, the sash lock mechanism 32 is locked wherein the cam 44 is locked with the keeper 42. Also, the latch bolt 50 is in its extended position and engaged with the guide rail 16. Thus, the sash window 12 is prevented both from sliding vertically with respect to the upper sash window to an open position and from tilting from the master frame 14. In this position, the abutment member 41 of the cam 44 and the tab 80 of the pawl 72 are not engaged with each other, and the cam 44 moves freely and independently of the pawl 72.

Figure 4:
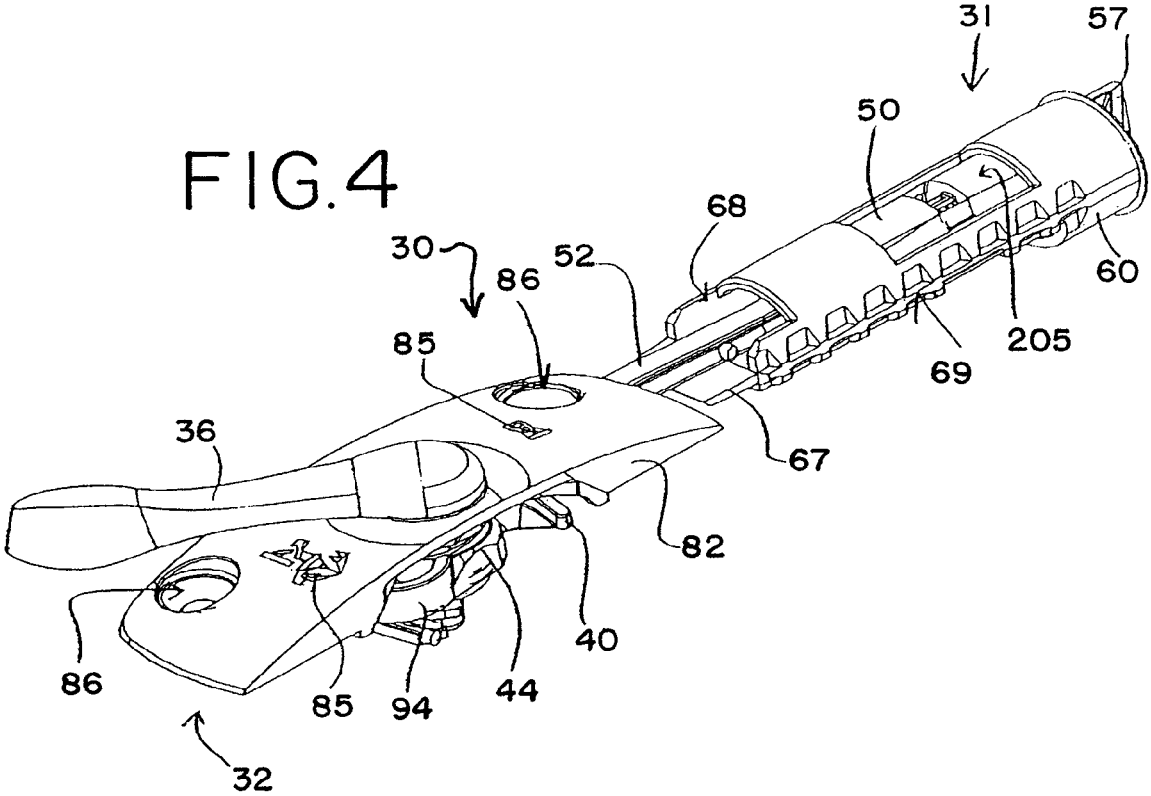
FIG. 4 is a rear perspective view of one embodiment of an integrated tilt latch and sash lock assembly of the present invention, shown in an unlocked position.
Figure 4A:
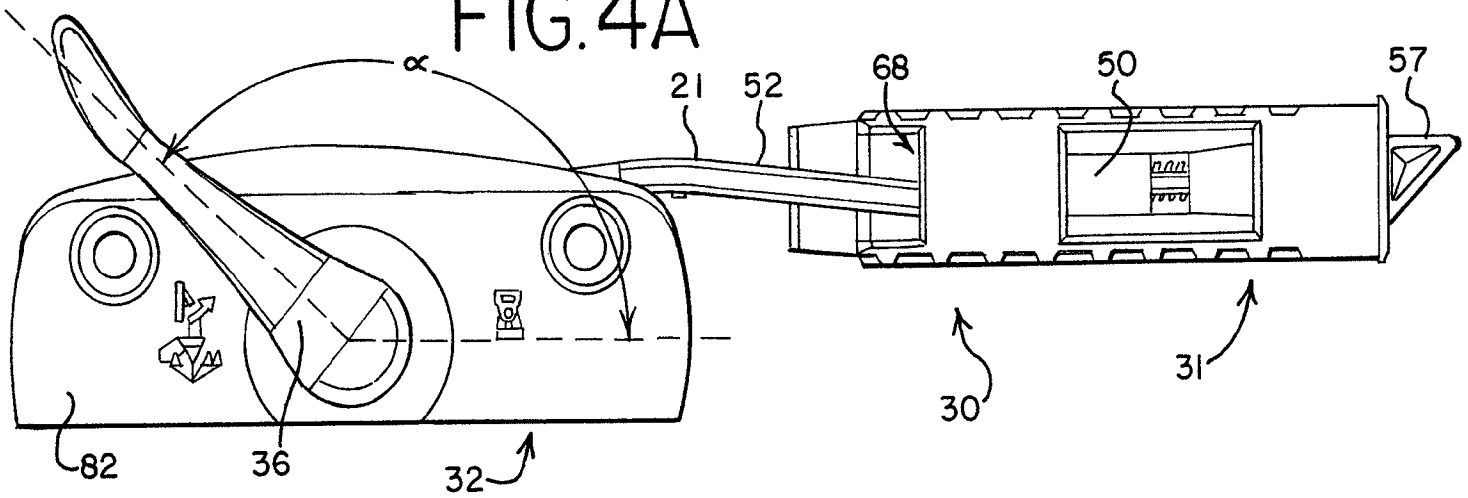
FIG. 4A is a top view of the integrated tilt latch and sash lock assembly of FIG. 4, shown in the unlocked position.
Figure 5:
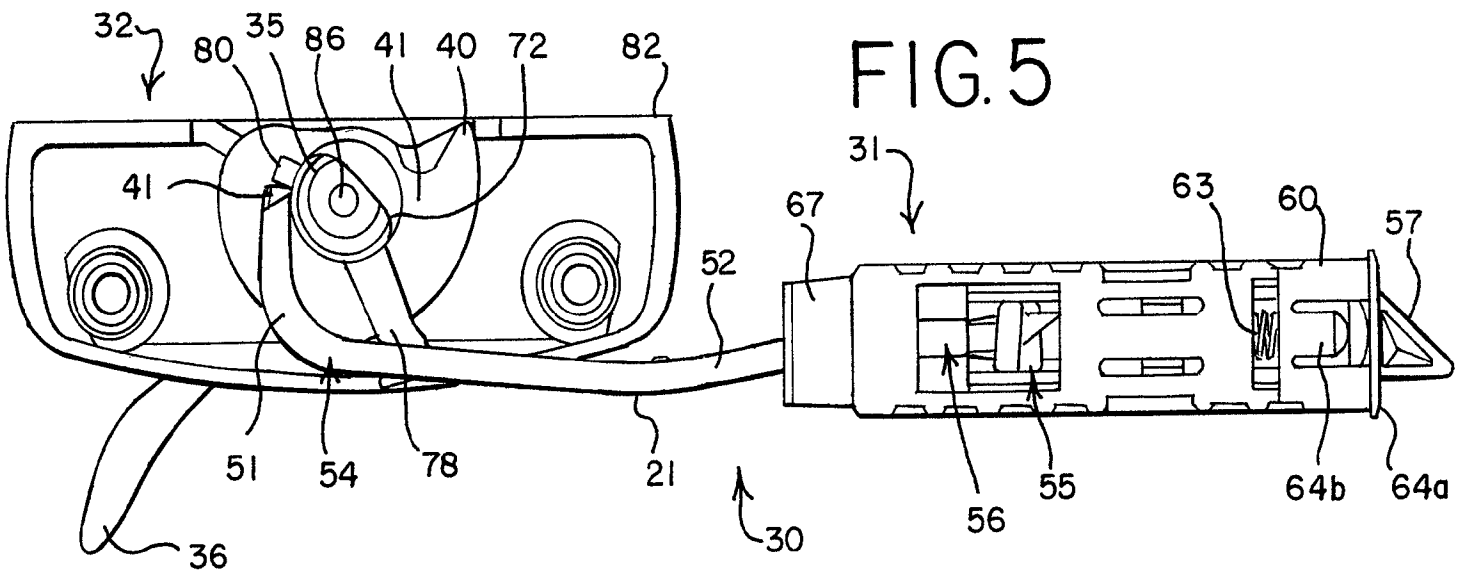
FIG. 5 is a bottom view of the integrated tilt latch and sash lock assembly of FIG. 4, shown in the unlocked position.
Figure 6:
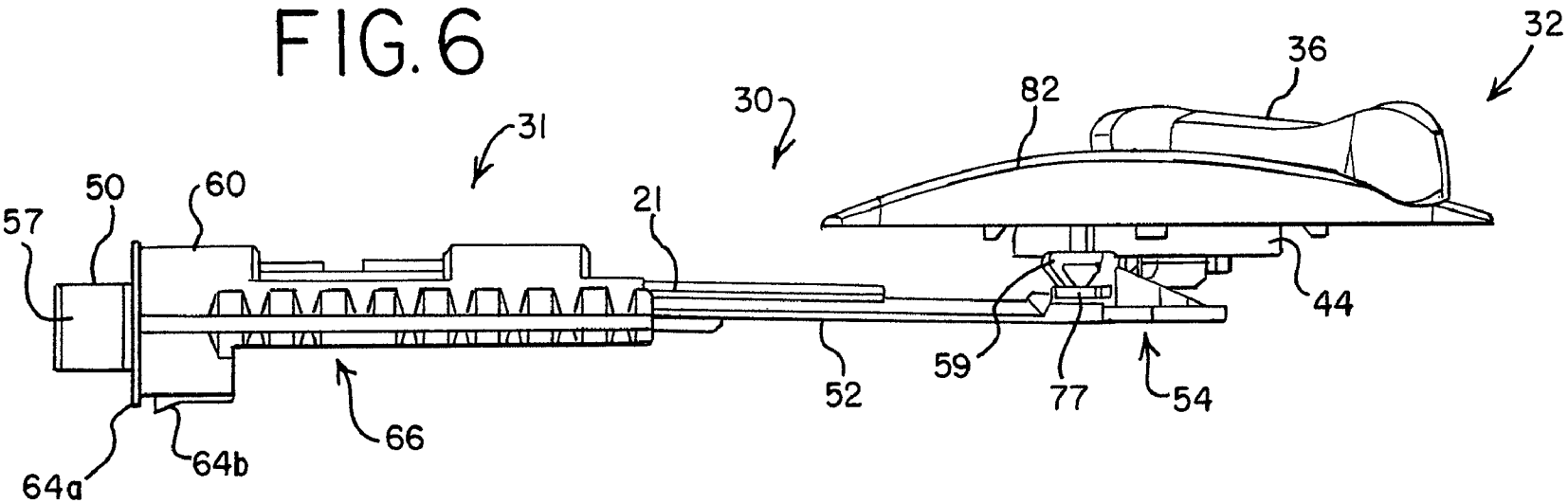
FIG. 6 is a front view of the integrated tilt latch and sash lock assembly of FIG. 4, shown in the unlocked position.
Figure 7:
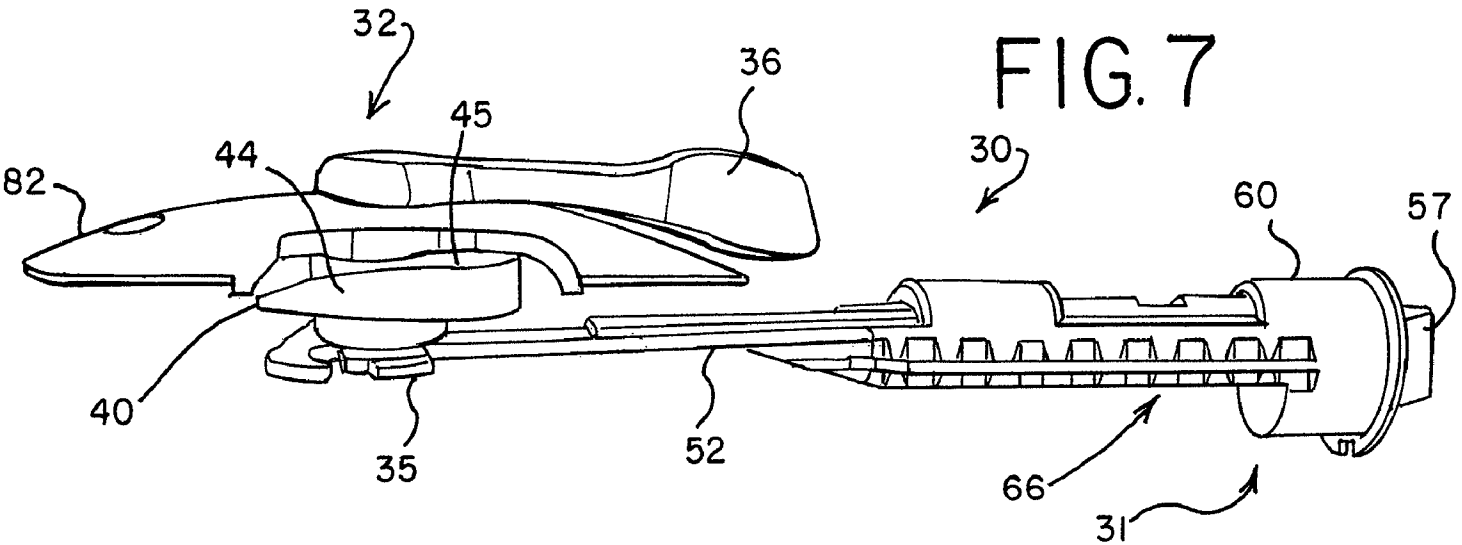
FIG. 7 is a rear perspective view of the integrated tilt latch and sash lock assembly of FIG. 4, shown in a locked position.
Figure 8:
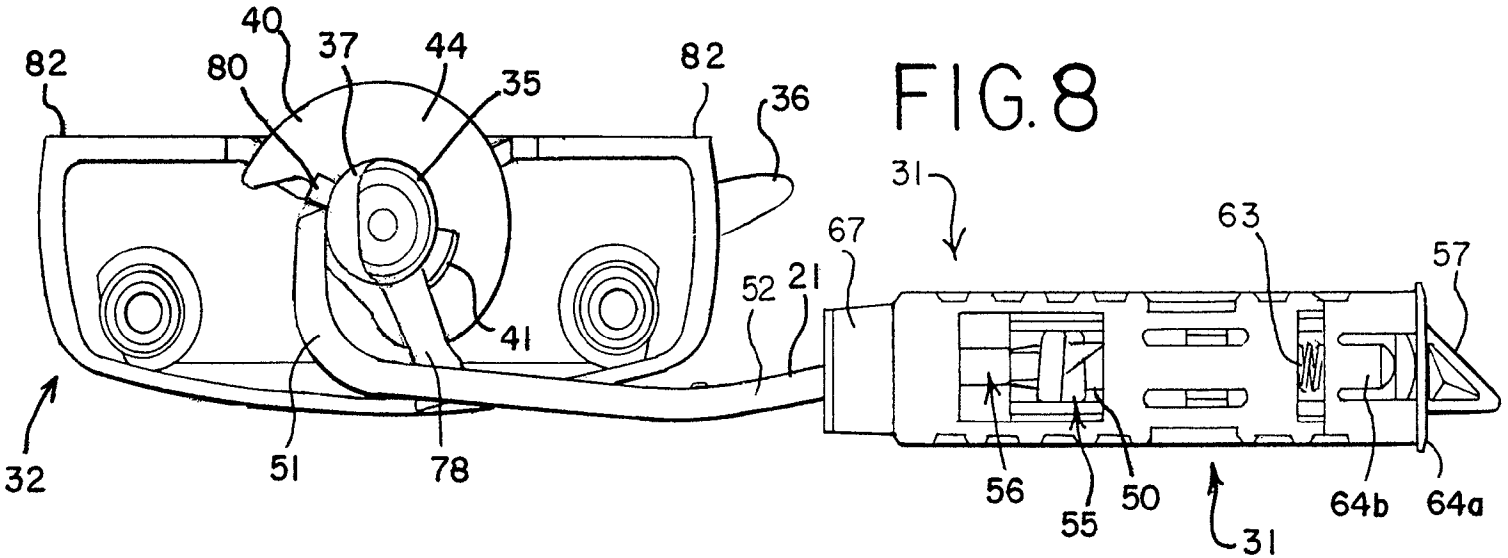
FIG. 8 is a bottom view of the integrated tilt latch and sash lock assembly of FIG. 4, shown in the locked position.
Figure 9:
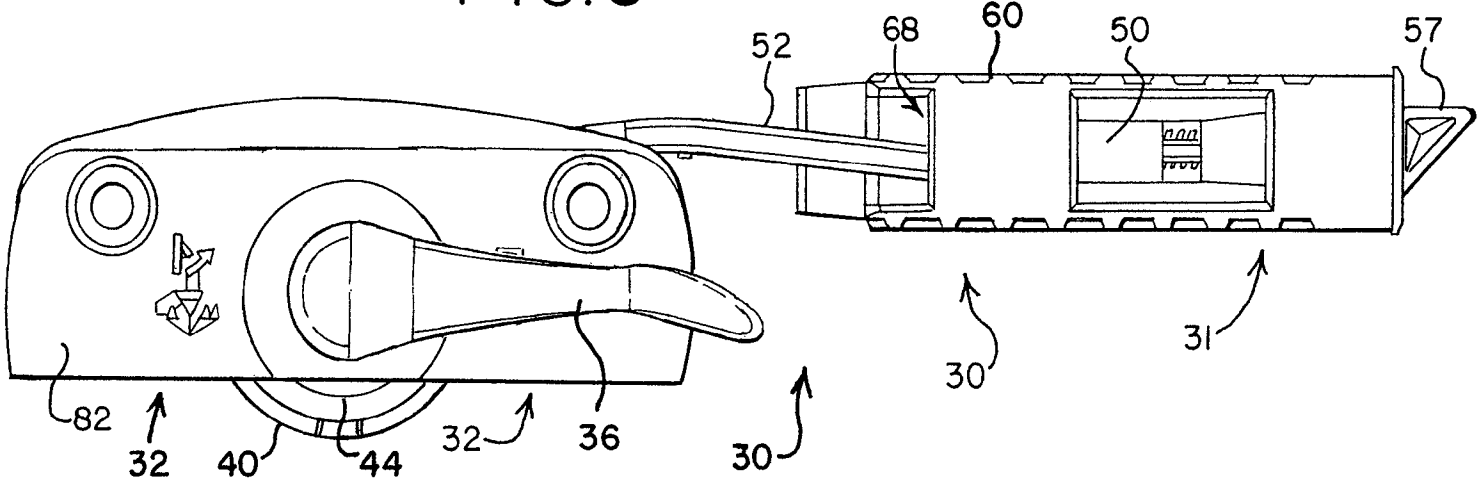
FIG. 9 is a top view of the integrated tilt latch and sash lock assembly of FIG. 4, shown in the locked position.
Figure 10:
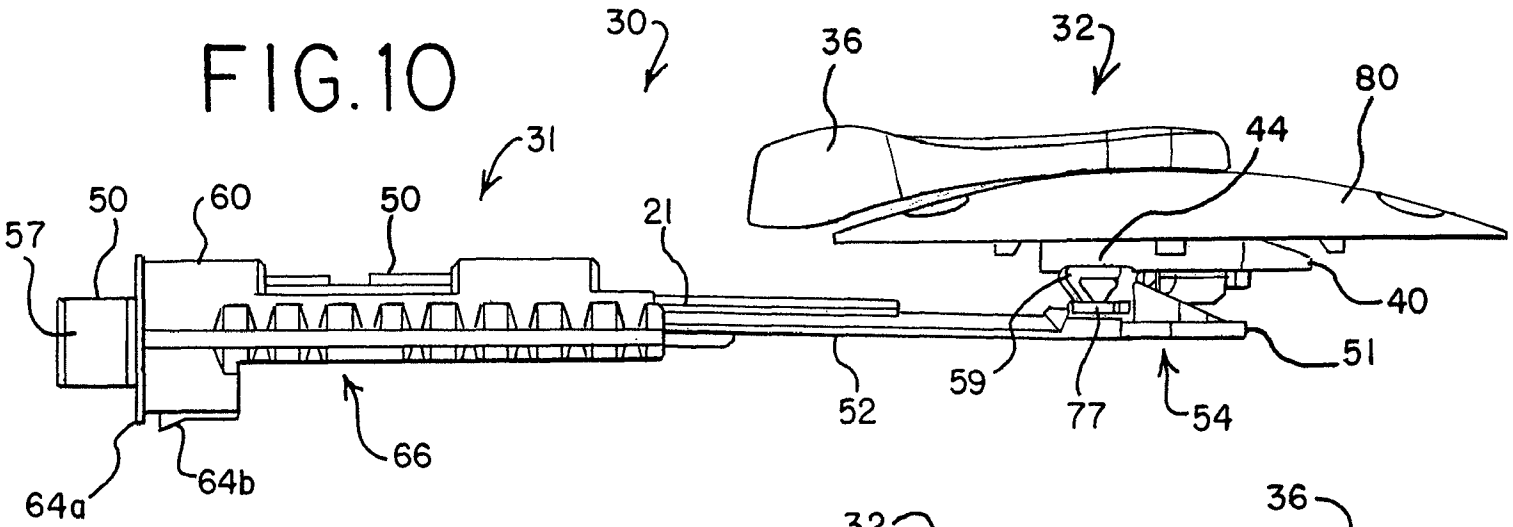
FIG. 10 is a front view of the integrated tilt latch and sash lock assembly of FIG. 4, shown in the locked position.
Figure 11:
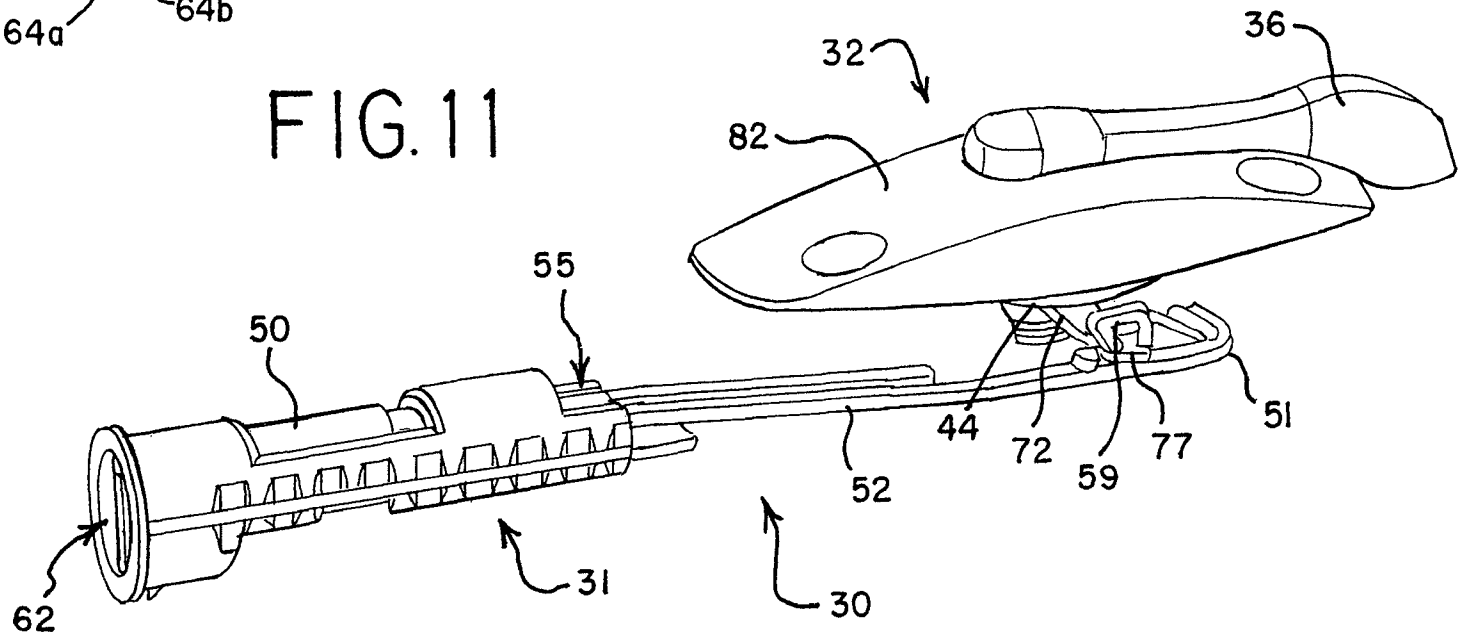
FIG. 11 is a perspective view of the integrated tilt latch and sash lock assembly of FIG. 4, shown in a tiltable position.
Figure 12:
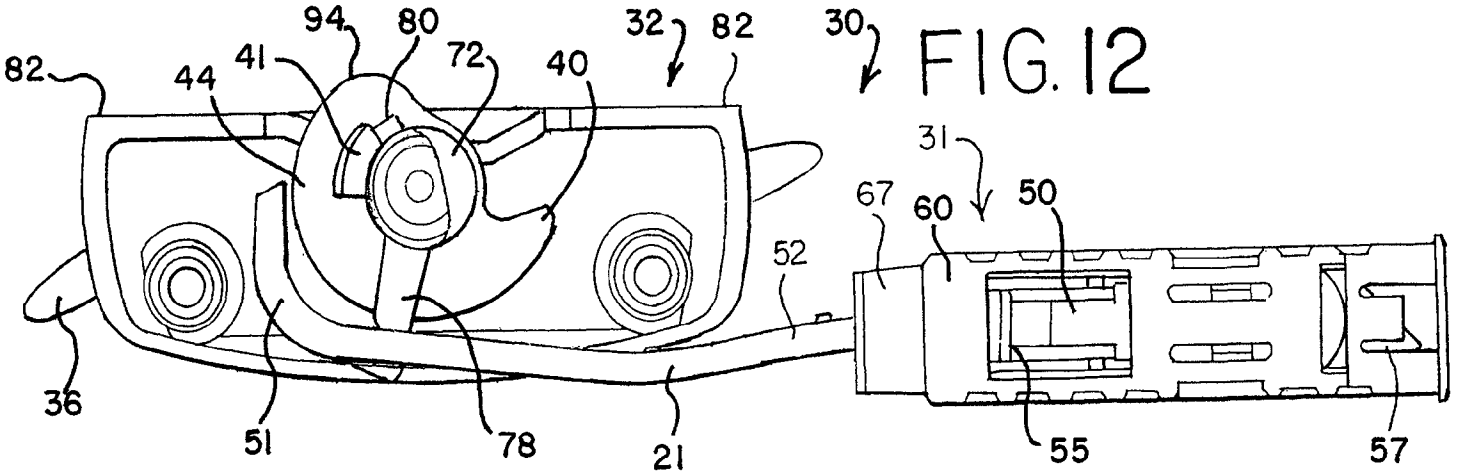
FIG. 12 is a bottom view of the integrated tilt latch and sash lock assembly of FIG. 4, shown in the tiltable position.
Figure 13:
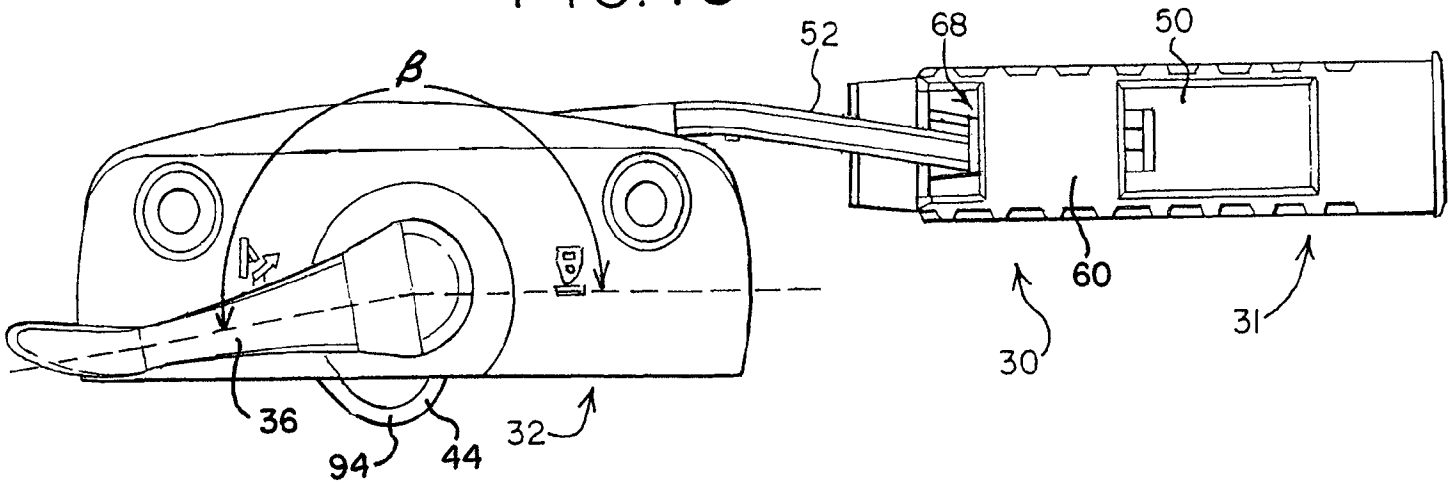
FIG. 13 is a top view of the integrated tilt latch and sash lock assembly of FIG. 4, shown in the tiltable position.
Figure 14:
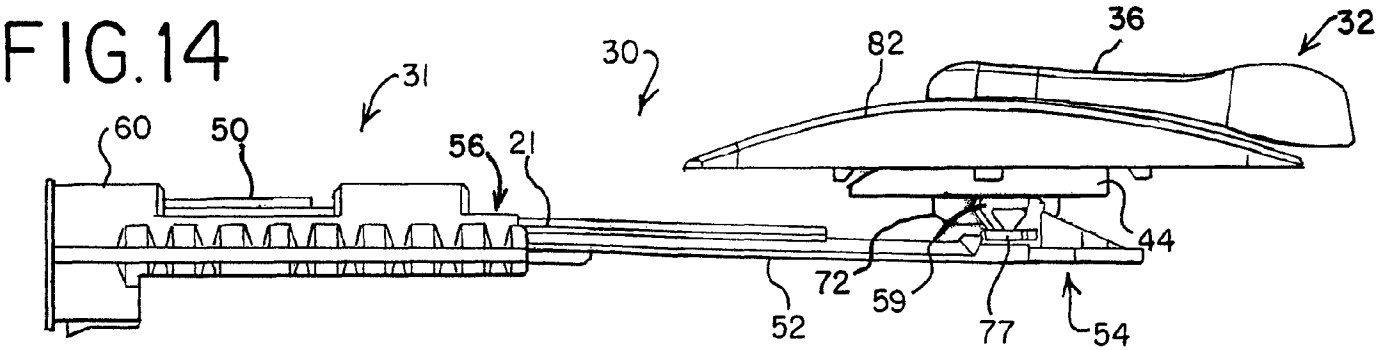
FIG. 14 is a front view of the integrated tilt latch and sash lock assembly of FIG. 4, shown in the tiltable position.

When the actuator handle 36 is moved from the locked position to the unlocked position, shown in FIGS. 4-6, the actuator handle 36 and the cam 44 are rotated to a first angle $\alpha$ from the locked position. This rotation disengages the locking member 40 from the keeper or locking bracket 42, permitting the sash window 12 to vertically open by sliding within the window frame 14. However, the latch bolt 50 remains outwardly extended into the guide rail 16, and thus, the sash window 12 continues to be prevented from tilting. In the embodiment illustrated in FIGS. 4-6, in the unlocked position, the tab 80 of the pawl 72 is still not yet abuttingly engaged by the cam 44, and the pawl 72 abuttingly engages the cam 44 upon slight further rotation. However, the integrated assembly 30 may be modified so the cam 44 and the pawl 72 abuttingly engage prior to the actuator 36 reaching the unlocked position, simultaneously with the unlocked position, or significantly after the actuator 36 passes the unlocked position. Additionally, a spring within the latch bolt housing 60 may bias the cam 44 toward the unlocked position.

When the actuator arm 36 is moved from the unlocked position to the tiltable position, shown in FIGS. 11-14, the actuator handle 36 and the cam 44 are rotated to a second angle β from the locked position, wherein the second angle β is greater than the first angle α. The second angle β is greater than 180° in one embodiment, shown in FIG. 13. In the tiltable position, the locking cam 44 remains disengaged from the keeper 42, still permitting the sash window 12 to vertically open. However, the cam 44 abuttingly engages the tab 80 extending from the pawl 72, causing the pawl 72 to rotate in unison with the cam 44. Rotation of the pawl 72 pulls the connector 52, which in turn pulls the latch bolt 50 toward the retracted position. In this retracted position, the latch bolt 50 is released from the guide rail 16, permitting the sash window 12 to tilt about the pivot corner 15. During this movement, the connector 52 is substantially linearly displaced. At some point between the first angle α and the second angle β and prior to the point where the abutment member 41 abuttingly engages the pawl 72, the eccentric cap 35 rotates to engage the curved arm 51 of the connector 52. Further rotation of the cap 35 exerts a camming force on the connector arm 51, pulling the connector 52 slightly, which in turn retracts the latch bolt 50 slightly. This permits the integrated assembly 30 to begin retraction of the latch bolt 50 prior to the point where the abutment member 41 of the cam 44 abuttingly engages the pawl 72.

As described above, the cam 44 contains means 94 for selectively preventing movement of the integrated assembly 30 to the tiltable position, such as the enlarged or eccentric portion 94 of the cam 44 that is rotationally opposite of the locking member 40. When the integrated assembly 30 is in the unlocked position, and a user wishes to move the actuator handle 36 to the tiltable position, the eccentric portion 94 abuts the keeper 42, preventing rotation of the cam 44. In order to rotate the actuator handle 36 and cam 44 further, the user must lift the sash window 12 slightly, to allow the eccentric portion 94 to clear the keeper 42 and the bottom rail 17, in one embodiment, and the actuator handle 36 can thus be moved to the tiltable position. It is understood that the bottom rail 17 could be modified or the keeper 42 positioned such that as soon as the cam 44 passes above the keeper 42, the actuator handle 36 can be moved to the tiltable position.

Additionally, in one embodiment, the actuator handle 36 and the sash lock housing 82 have cooperating structure to indicate the position of the integrated assembly 30 to the user. As shown in FIGS. 28-29, the housing 82 has an annular ledge 87 having two protrusions 88 positioned at points around the ledge 87, and the actuator handle 36 has a projection 89 on the lower side. The first protrusion 88*a* is located proximate the fully locked position of the actuator handle 36, and the second protrusion 88*b* is located proximate the unlocked position of the actuator handle 36. During rotation of the actuator handle 36, the projection 89 of the actuator handle 36 engages the protrusion 88 of the housing 82, creating momentarily greater resistance to rotation of the actuator handle 36. When the actuator handle 36 clears the protrusion 88, the user feels a "click" which, due to the relative positions of the protrusions 88, indicates a position of the actuator handle 36 to the user. Accordingly, the tactile feel created by the first protrusion 88*a* indicates when the actuator handle 36 has moved to or from the fully locked position. Similarly, the tactile feel created by the second protrusion 88*b* indicates when the actuator handle 36 has moved to or from the unlocked position. Thus, the actuator handle 36 and the housing 82 create a tactile feel for the user to indicate positions of the integrated assembly 30.

Viewed another way, the assembly 30 is moveable through a first range of angular movement, where movement of the actuator handle 36 rotates the rotor 44, and a second range of angular movement, where the rotor 44 abuttingly engages the pawl 72 such that movement of the actuator handle 36 rotates the rotor 44 and the pawl 72 together. As described above, the locking member 40 is disengaged from the keeper 42 within the first range of angular movement, and prior to the abutting engagement between the rotor 44 and the pawl 72. Additionally, the actuator handle 36 is moveable among a first position, where the cam or rotor 44 does not abuttingly engage the pawl 72 and the assembly is in the locked position, a second position where the cam 44 abuttingly engages the pawl 72 and the assembly is in the unlocked position, and a third position where the cam 44 abuttingly engages the pawl 72 and the connector 52 retracts the latch bolt 50 so the assembly is in the tiltable position. As described above, the locking member 40 is disengaged from the keeper 42 before the actuator handle 36 reaches the second position. It is understood that the assembly 30 and the actuator 36 may have several positions which are "locked," "unlocked," and "tiltable" positions, dictated by the function of the window at the respective position. It is also understood that the sequence of mechanical interactions within the assembly 30 may be varied. Thus, depending on the configuration of the assembly 30, there may be additional positions where, for example, the assembly is in the locked position and the cam 44 is already abuttingly engaging the pawl 72; or, in an alternate embodiment of the assembly, where the assembly 30 is in the unlocked position but the cam 44 has not yet abuttingly engaged the pawl 72.

When operating the actuator handle 36 in reverse to the above, the integrated assembly 30 is moved from the tiltable position to the unlocked position, and the actuator handle 36 and cam 44 are rotated from the second angle β back to the first angle α. The locking member 40 remains disengaged from the keeper 42, still permitting the sash window to vertically open. As the actuator handle 36 and the cam 44 move toward the unlocked position, the latch bolt 50 moves back to the outwardly-extended position due to the bias created by the spring 63. This movement is enabled because the pawl 72 is no longer being rotatably biased by the cam 44. In one embodiment, this action is done automatically when the handle 36 is released by the user, because the force of the spring 63 not only forces the latch bolt 50 to the outwardly-extended position, but pulls on the connector 52, causing the cam 44 and the handle 36 to rotate back to the unlocked position (angle α). At some point within this range of movement, prior to the full extension of the latch bolt 50, the abutting engagement between the abutment member 41 of the cam 44 and the tab 80 of the pawl 72 ceases. When the integrated assembly 30 reaches the unlocked position, the latch bolt 50 is once again fully extended, and the sash window 12 is prevented from tilting when in the closed position. It is understood that the integrated assembly 30 can be returned to the unlocked position while the window 12 is still tilted open. Due to the beveled surface of the latch bolt tip 57, the window 12 can be shut while the integrated assembly 30 is in the unlocked position, as contact with the window frame 14 will force the latch bolt 50 back into the housing 60 until the latch bolt tip 57 is aligned with the guide rails 16, when the spring 63 forces the latch bolt 50 back outward. The forcing of the latch bolt 50 inward during this action will cause the pawl 72 to rotate, but since the pawl 72 and the cam 44 are engaged only for rotation in one direction, this movement of the pawl 72 will not rotate the cam 44. As the actuator handle 36 and the cam 44 further move toward the locked position, the cam 44 rotates to engage the keeper 42. When the integrated assembly 30 is returned to the locked position, the locking member 40 engages the locking bracket on the keeper 42, preventing the sash window 12 from opening.

Another embodiment of a sash lock mechanism 132 is illustrated in FIGS. 40-48. Most of the components of the sash lock assembly 132 shown in FIGS. 40-48 are the same or similar to those of the sash lock assembly 32 shown in FIGS. 2-38, and are consistently numbered using the "100" series of reference numbers. As illustrated, the sash lock assembly 132 is adapted for use with the integrated tilt latch and sash lock assembly 30 as described above, and includes an actuator arm or handle 136 connected to a cam or rotor 144 which is operably connected to a pawl 172, and a housing 182 supporting the other components of the sash lock mechanism 132. The housing 182 is adapted to be mounted on the top sash rail 20 to mount the sash lock mechanism 132 to the sash window assembly 10. In one exemplary embodiment, the housing 182 is made of cast metal. The housing 182 has an opening 181 therein and indicia 185 on the top surface 183 thereof, as well as a pair of screw apertures 186 for insertion of fasteners to connect the housing 182 to the top sash rail 20. The housing 182 has additional features similar to those described above with respect to the integrated assembly 30 illustrated in FIGS. 2-38.

The sash lock mechanism 132 of FIGS. 40-48 further includes locking mechanism 100 that operates to selectively prevent rotation of the cam 144 from the locked position. In some embodiments, the locking mechanism 100 may operate as a forced entry resistance (FER) mechanism. The locking mechanism 100 generally includes a moveable member or rocker 101 pivotably mounted on the housing 182 and operable to engage the cam 144 to selectively prevent rotation of the cam 144 from the locked position. In one exemplary embodiment, the moveable member 101 is made of zinc or another suitable metal, but in other embodiments, the moveable member 101 may be made from a different material, such as a polymer or composite. In the embodiment illustrated in FIGS. 40-48, the housing 182 has an internal mounting structure 196 for pivotably mounting the moveable member 101 and an opening 197 extending across a portion of the top and front of the housing 182, to allow access to the moveable member 101 through the housing 182. The mounting structure 196 includes a receiver 198 adapted to receive a portion of the moveable member 101 therein in a pivotable arrangement. In one exemplary embodiment, the receiver 198 is partially defined by two fingers 199 (FIG. 42) adapted to wrap around a portion of the moveable member 101 to connect the moveable member 101 to the receiver 198.

Figure 45:
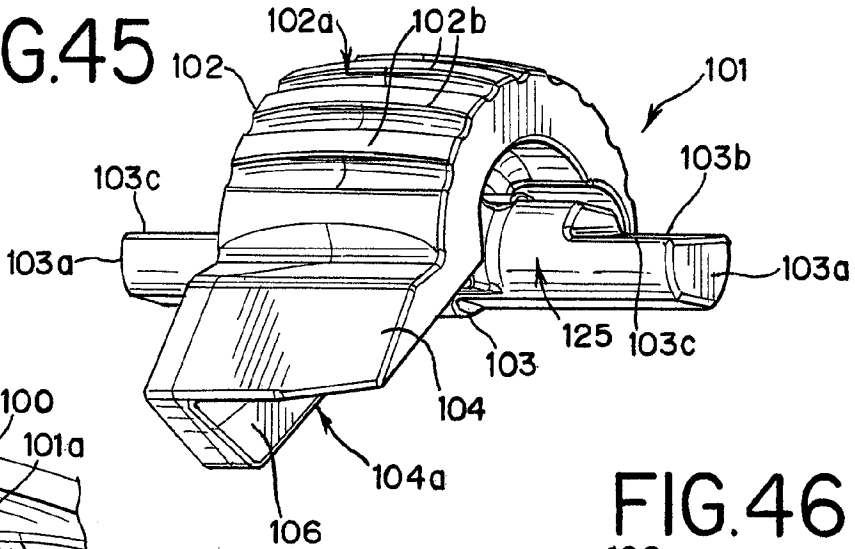
FIG. 45 is a perspective view of a pivotable member of the locking mechanism of the sash lock mechanism of FIG. 40.
Figure 46:
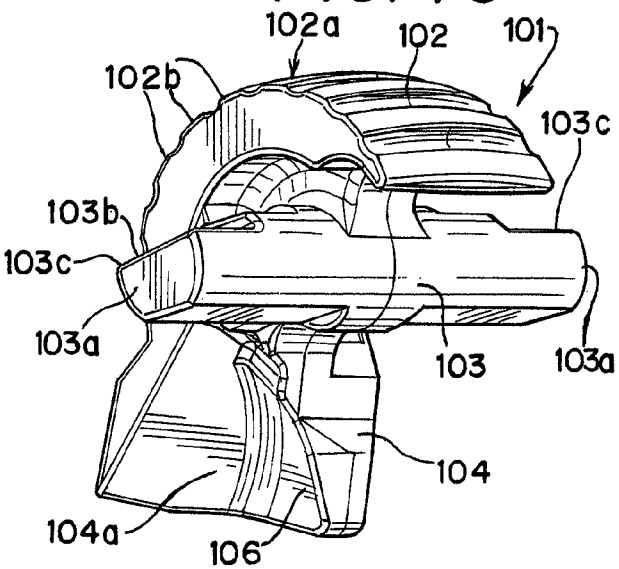
FIG. 46 is a bottom perspective view of the pivotable member of FIG. 45.
Figure 44:
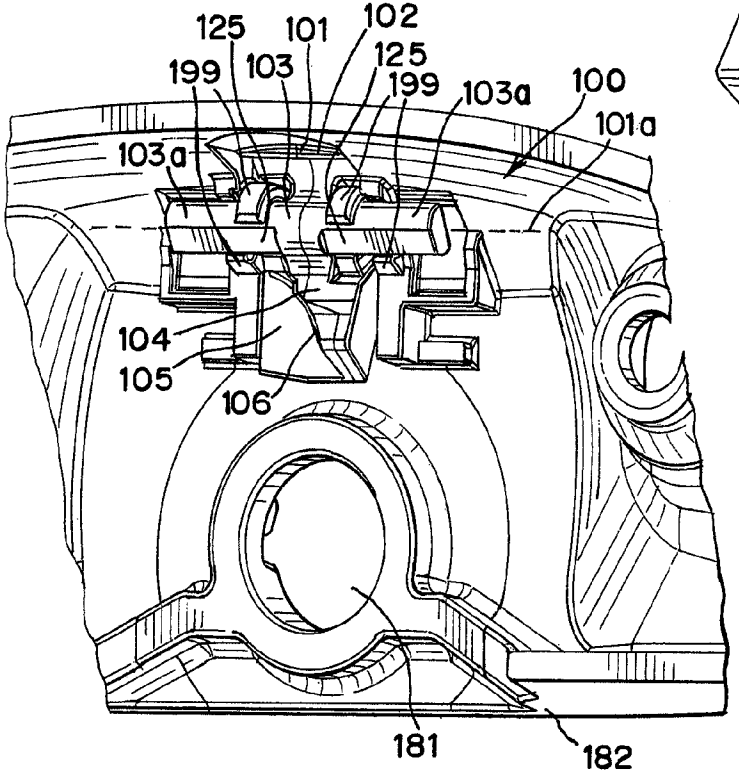
FIG. 44 is a focused bottom perspective view of a housing and a locking mechanism of the sash lock mechanism of FIG. 40, with the locking mechanism shown in a secure position.

As shown in FIGS. 45-46, the moveable member 101 includes an actuator portion 102, a mounting arm 103, and a leg 104 extending from the actuator portion 102, the leg 104 having an engagement surface 106 thereon for engaging the cam 144 to prevent rotation thereof In the illustrated embodiment, the actuator portion 102 is formed by a wheel or barrel-shaped structure that has a curvilinear outer surface that protrudes from the opening 197 and is adapted to be engaged by the finger of a user to pivot the moveable member 101. The actuator portion 102 includes a tactile surface 102*a* for enhancing increasing traction between the user's finger and the actuator portion 102 to facilitate manipulation thereof In this embodiment, the tactile surface 102*a* is formed by a plurality of ridges 102*b* on the surface of the actuator portion 102 to provide this increased traction. In other embodiments, a different type of tactile surface may be used, such as a surface having a series of protrusions or recesses or a tacky substance thereon, as well as other tactile surfaces known in the art, or further may include a lever or other extending structure to facilitate manipulation of the actuator portion 102. The mounting arm 103 is adapted to be received in the receiver 198 to pivotably mount the moveable member 101 on the housing 182. As shown in FIGS. 44-46, the mounting arm 103 includes pegs 125 extending outwardly from both sides of the actuator 102, and each peg 125 of the mounting arm 103 is engaged by one of the fingers 199 of the receiver 198 to retain the mounting arm 103 in the receiver 198. The mounting arm 103 can pivot within the receiver 198, allowing the moveable member 101 to pivot within the housing 182 in response to manipulation by the user, as described below. In this embodiment, the mounting arm 103 of the moveable member 101 has two eccentric cam portions 103*a*, one extending from each of the pegs 125, which will be described in greater detail below. In other embodiments, the moveable member 101 may have a different type or configuration of mounting arm, and may have two or more separate mounting arms.

Figures 41, 42, 43:
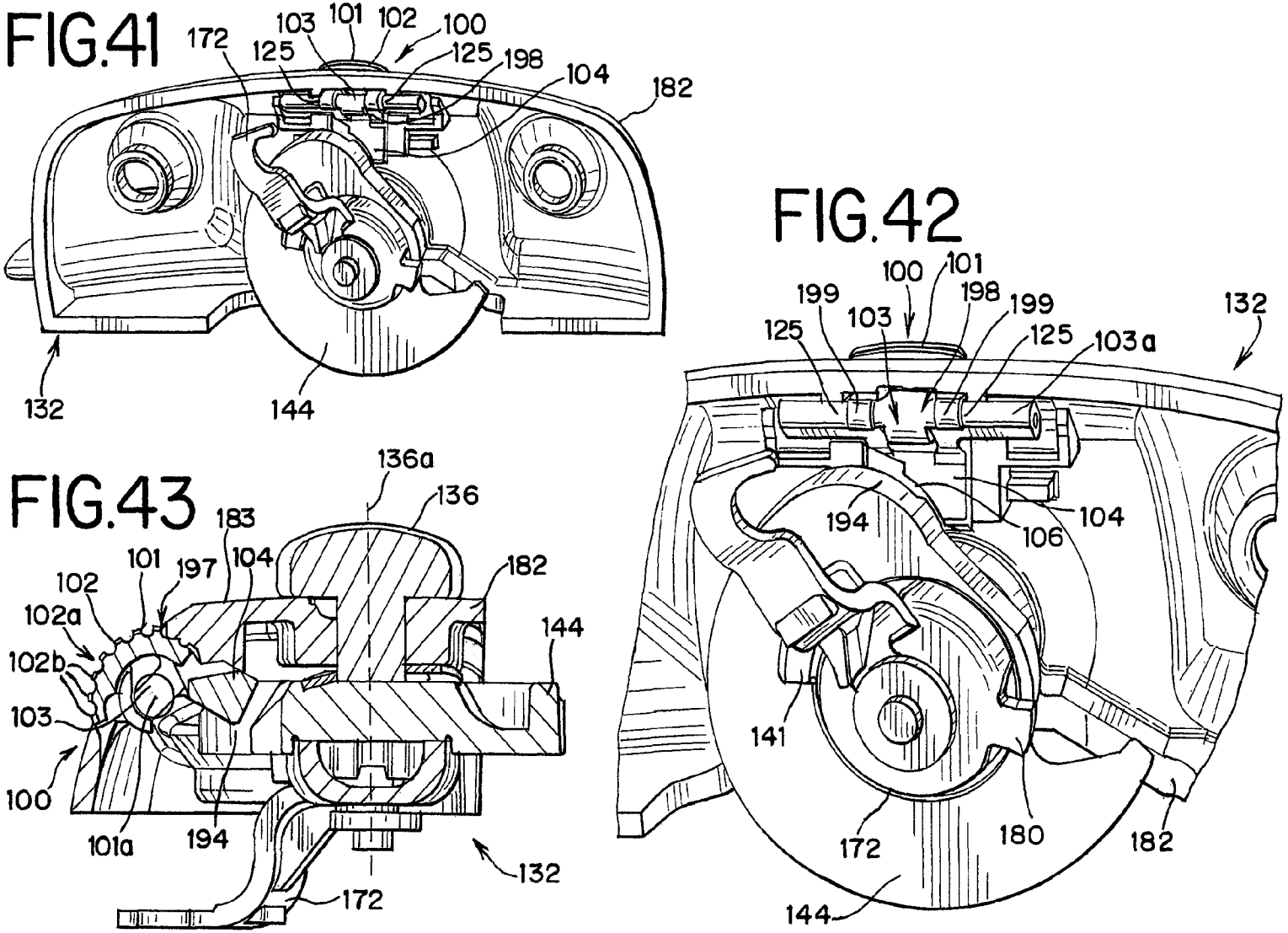
FIG. 41 is a bottom perspective view of the sash lock mechanism of FIG. 40.
FIG. 42 is a focused bottom perspective view of the sash lock mechanism of FIG. 40.
FIG. 43 is a cross-sectional view of the sash lock mechanism of FIG. 40.

In the embodiment shown in FIGS. 40-48, the engagement surface 106 is located on the underside of the leg 104, which extends from the actuator portion 102. The engagement surface 106 is defined on one surface of a notch or cut out portion 104*a* on the leg 104, which receives a portion 194 of the cam 144 therein when the cam is in the locked position. The engagement surface 106 has a curvilinear contour to cooperate with the curvilinear contour of the cam portion 194. In this configuration, the engagement surface 106 confronts the portion 194 of the cam 144 when the moveable member 101 is in the secure position, as illustrated in FIGS. 41-42. In this embodiment, when the cam 144 is fully in the locked position, the confronting surfaces 106, 194 are slightly spaced from each other, and when the cam 144 is rotated toward the unlocked position, the confronting surfaces 106, 194 engage each other. It is understood that the engaging portions 106, 194 may be differently contoured in other embodiments, and such other contours may be designed so that the engaging portions 106, 194 are cooperatively dimensioned with each other. Additionally, in other embodiments, the engagement surface 106 may not be located on a leg or other extending member, and may not have an adjacent cut out portion.

As described above, the sash lock mechanism 132 is adapted to be used with the integrated assembly 30 described above, in the same manner as the sash lock mechanism 32 as shown in FIGS. 4-14. In such a configuration, the components of the sash lock mechanism 132 and the remainder of the integrated assembly 30 are connected and operated in the same manner as described above. For example, the connector 52 may be connected the appending member 178 of the pawl 172 to assemble the integrated assembly. Thus, in such a configuration of the sash lock mechanism 132, the actuator 136 and cam 144 are rotatable between a locked position, an unlocked position, and a tiltable position, as described above. The locking of the cam 144 with the keeper 142 is shown in FIGS. 41-43. The actuator 136 and cam 144 rotate about an axis of rotation 136*a* (FIG. 43). The sash lock assembly 132 could be used independently of the integrated assembly 30, and in such a configuration, the pawl 172 may be absent. It is understood that if the sash lock mechanism 132 is used independently of the integrated assembly 30, rotation of the actuator 136 and the cam 144 from the unlocked position to the tiltable position may be possible, but may have no functional effect. In either configuration, the moveable member 101 is adapted to selectively engage the cam 144 when the actuator 136 and the cam 144 are in the locked position.

Figure 47:
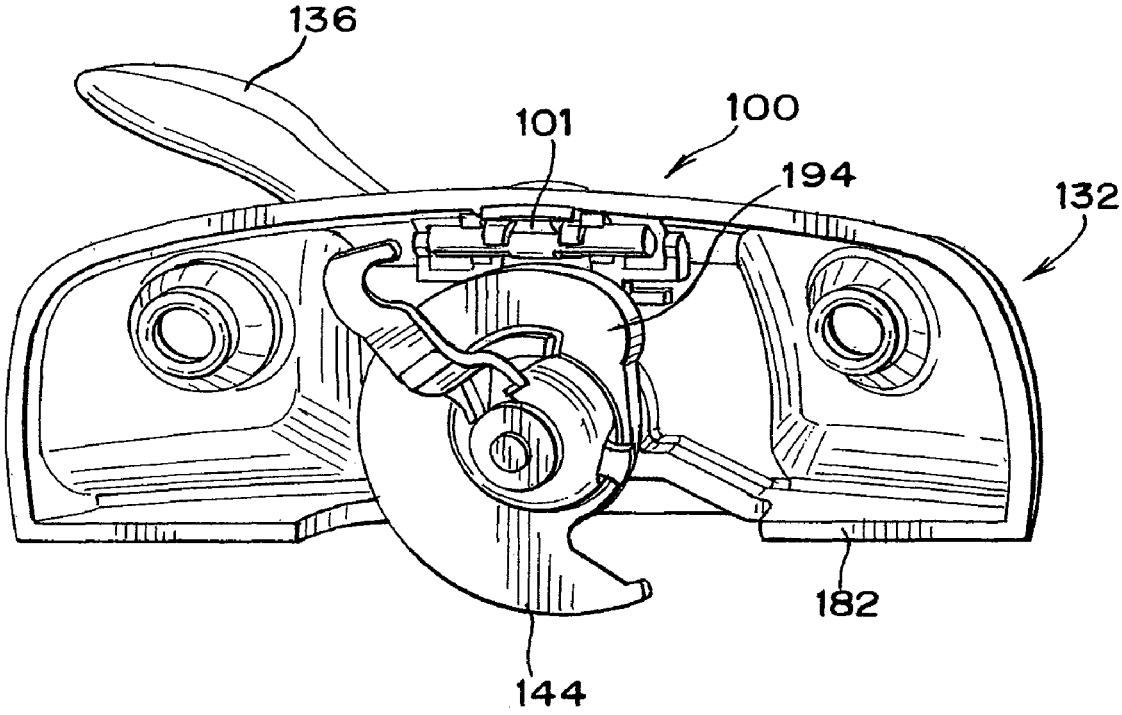
FIG. 47 is a bottom perspective view of the sash lock mechanism of FIG. 40, shown in between the locked position and an unlocked position, with the locking mechanism in a free position.
Figure 48:
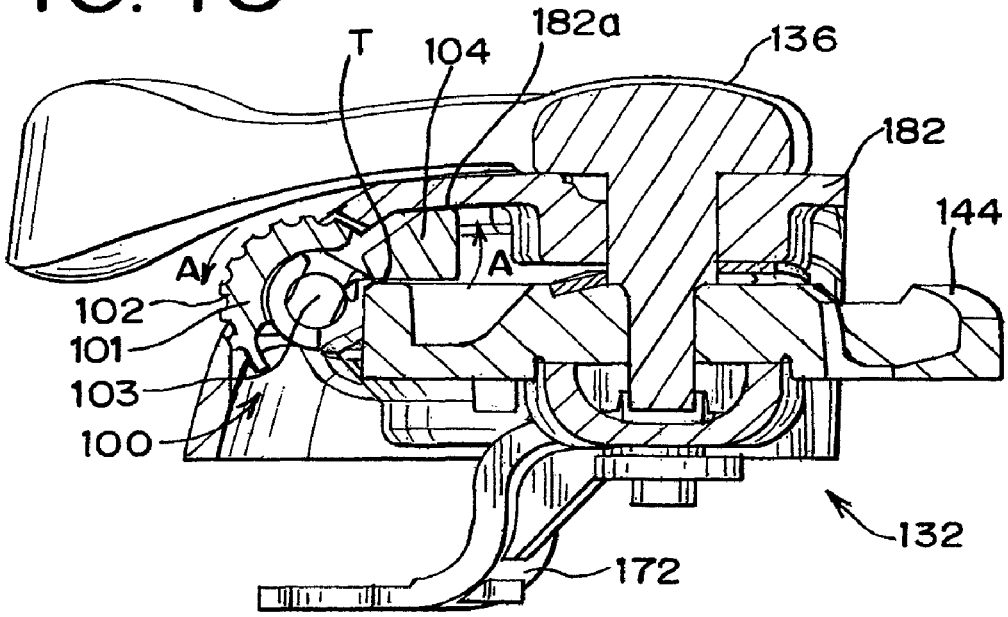
FIG. 48 is a cross-sectional view of the sash lock mechanism as shown in FIG. 47.
Figure 49:
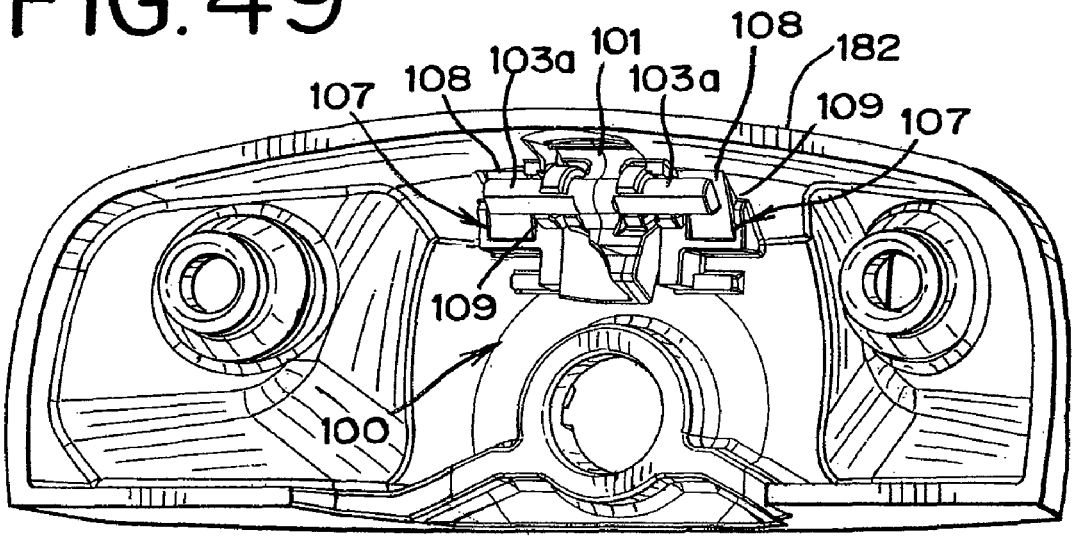
FIG. 49 is a bottom perspective view of the housing and the locking mechanism of the sash lock mechanism of FIG. 40, having a means for biasing the locking mechanism toward the secure position, with the locking mechanism in the secure position.
Figure 50:
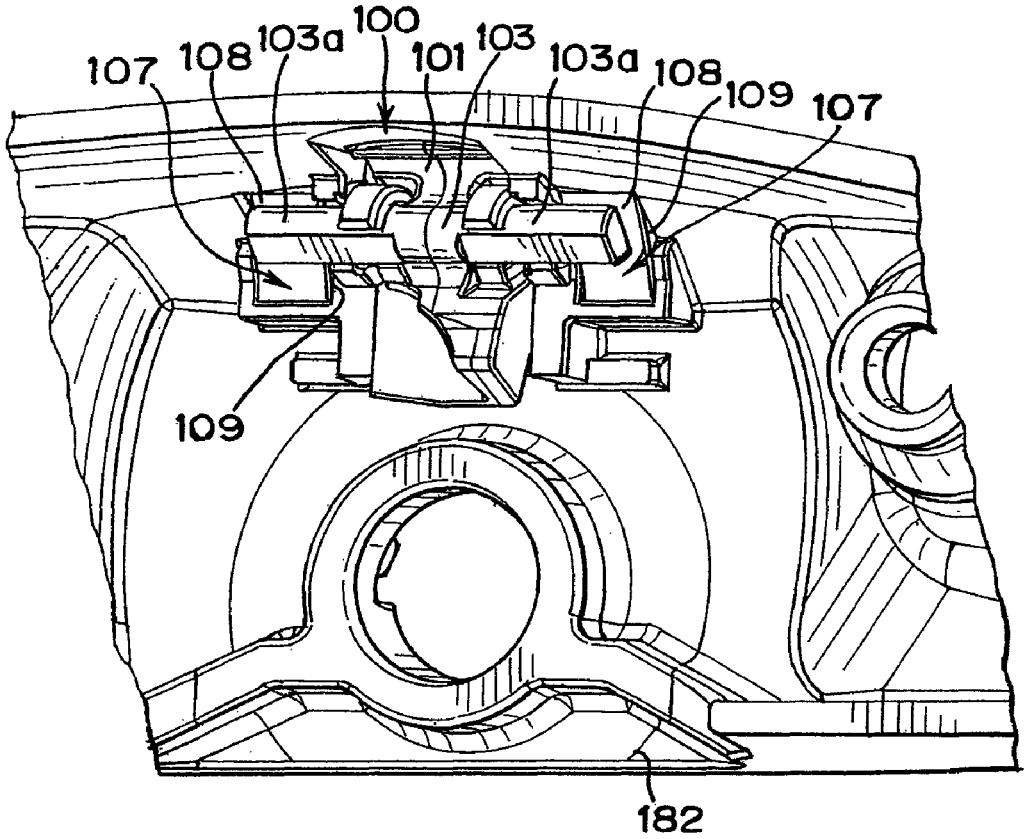
FIG. 50 is a focused bottom perspective view of the housing and locking mechanism of FIG. 49.

As illustrated in FIGS. 41-44 and 47-48, the moveable member 101 is moveable by pivoting or rotating between a first, or secure position and a second, or free position. In the secure position, shown in FIGS. 41-44, the moveable member 101 engages the cam 144 to prevent rotation of the cam 144 from the locked position. In the illustrated embodiment, when the cam 144 is in the locked position and the moveable member 101 is in the secure position, the engagement surface 106 confronts the cam portion 194. More specifically, in this embodiment, the engagement surface 106 confronts a side surface of the cam portion 194. When the cam 144 is rotated toward the unlocked position, the engagement surface 106 engages the cam portion 194, and this engagement prevents rotation of the cam 144 from the locked position. In the free position, shown in FIGS. 47-48, the moveable member 101 is pivoted (as indicated by arrows A) so that the leg 104 moves upward over the top surface (T) of the cam 144, between the cam 144 and the underside of the housing, and the engagement surface 106 no longer engages the cam 144, allowing the cam 144 to be rotated from the locked position to the unlocked position. In the embodiment shown, the actuator portion 102 rotates from the top to the bottom of the housing 182 to move the moveable member 101 from the secure position to the free position. FIGS. 47-48 show the cam 144 rotated part way between the locked position and the unlocked position, with the leg 104 of the moveable member 101 rotated to the free position. In the embodiment shown in FIGS. 47-48, the entire leg 104 is located above the top surface (T) of the cam 144, adjacent the ceiling 182*a* of the housing 182. The moveable member 101 pivots between the secure position and the free position on an axis of rotation 101*a* (FIG. 43) defined by the mounting arm 103. In the embodiment illustrated, the axis of rotation 101*a* of the moveable member 101 is substantially parallel to one or more adjacent surfaces of the housing 182, such as the top surface 183, as shown in FIGS. 43 and 48. In this embodiment, the axis of rotation 101*a* of the moveable member 101 is generally transverse to the axis of rotation 136*a* of the actuator 136 and cam 144. More specifically, in this embodiment, the axis of rotation 101*a* of the moveable member 101 is substantially perpendicular to the axis of rotation 136*a* of the actuator 136 and cam 144. Further, in this embodiment, the leg 104 extends in a direction generally transverse to the axis of rotation 101*a* of the moveable member 101.

The moveable member 101 may be moved from the secure position to the free position by manipulation of the actuator portion 102 by the finger of a user, which exerts a tangential force resulting in a torque on the moveable member 101. In the embodiment illustrated in FIGS. 40-48, the force of gravity moves the moveable member 101 back to the secure position when the cam 144 is returned to the locked position. When the cam 144 is not in the locked position, the bottom of the leg 104 rests against the top surface (T) of the cam 144, which prevents the moveable member 101 from moving back to the secure position. Once the cam 144 has moved to clear the leg 104, gravity will pull the moveable member 101 back to the secure position.

Figure 51:
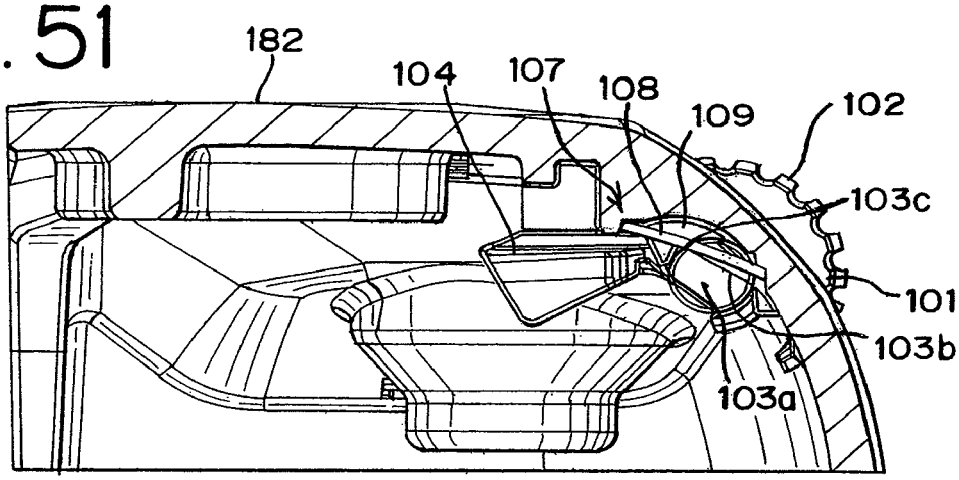
FIG. 51 is a cross-sectional view of the housing and locking mechanism of FIG. 49.
Figure 52:
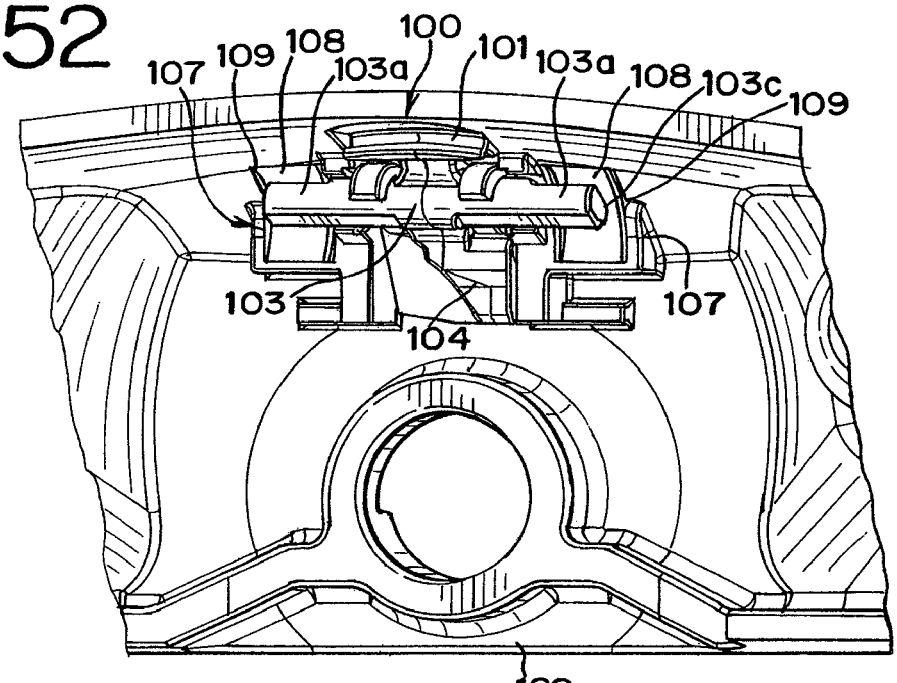
FIG. 52 is a focused bottom perspective view of the housing and locking mechanism of FIG. 49, with the locking mechanism in the free position.
Figure 53:
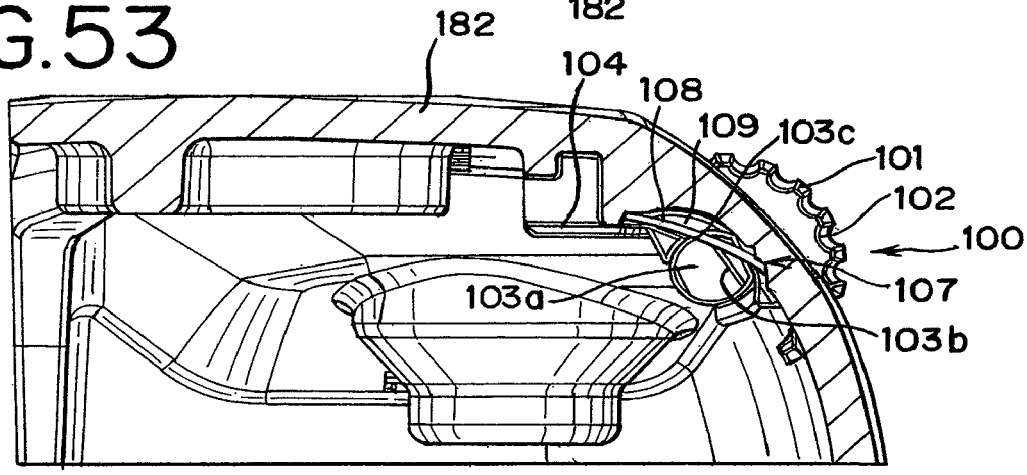
FIG. 53 is a cross-sectional view of the housing and locking mechanism of FIG. 52.
Figure 54:
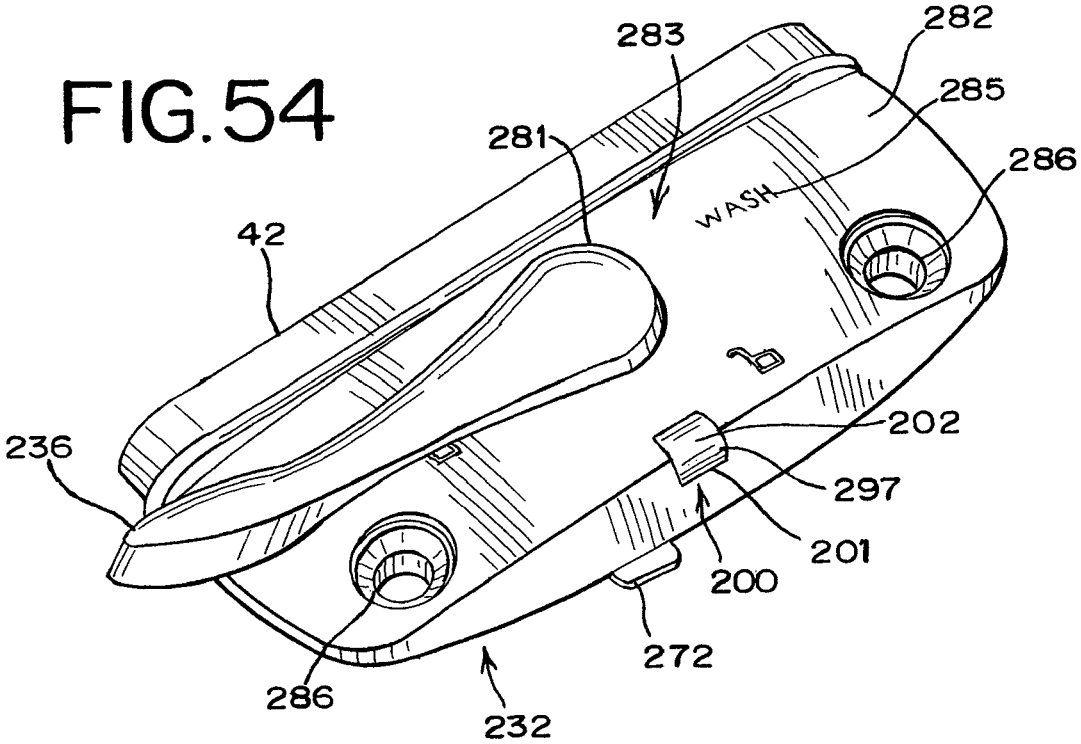
FIG. 54 is a perspective view of another embodiment of a sash lock mechanism having a forced entry resistance mechanism, shown in a locked position, with a keeper.

The embodiment of the sash lock mechanism 132 shown in FIGS. 40-48 is adapted to incorporate a biasing means 107 for biasing the moveable member 101 toward the secure position. As shown in FIGS. 49-53, the biasing means 107 includes two leaf springs 108 that are contained within recesses 109 located on the underside of the housing 182, on either side of the receiver 198. The leaf springs 108 engage the moveable member 101 to bias the moveable member 101 toward the secure position. As described above, the mounting arm 103 of the moveable member 101 has eccentric cam portions 103*a* extending from opposed ends thereof Each cam portion 103*a* has a flat portion 103*b* having an edge 103*c* (FIG. 51). As can be understood from FIGS. 50-51, when the moveable member 101 is in the secure position, each flat portion 103*b* is adjacent a respective spring 108, and the spring 108 may or may not engage the cam portion 103*a* and exerts little to no rotational force on the cam portion 103*a*. It is understood that the moveable member 101 may have a limited range of movement, and that, in some embodiments, the spring 108 may continue to exert force on the moveable member 101 when the moveable member 101 is in the secure position, which is not able to cause further movement of the moveable member 101. When the moveable member 101 is rotated to the free position, the cam portions 103*a* engage and flex the springs 108 into the respective recesses 109. In turn, the springs 108 exert force on the edge 103*c* of the flat portion 103*b* of each cam portion 103*a*, creating torque on the cam portions 103*a* that tends to bias the moveable member 101 toward the secure position. FIGS. 52-53 illustrate the spring 108 flexing when abutted by the edge 103 of the cam portion 103*a*, exerting a response force thereon. Thus, when the moveable member 101 is released, the spring 108 will bias the moveable member 101 back to the secure position. As described above, when the cam 144 is not in the locked position, the leg 104 of the moveable member 101 may rest on the top surface (T) of the cam 144, which would temporarily prevent the moveable member 101 from movement to the secure position. In other embodiments, a different type of rotational biasing means known in the art could be used. For example, a coil spring in a compression arrangement or a twisting arrangement may be used as the biasing means. Integral biasing members could also be formed with the other structures of the moveable member 101. Additionally, it is understood that the sash lock mechanism 132 can operate using only one of the two springs 108. The use of the biasing means 107 provides greater force to the moveable member 101 than gravity alone, which improves performance of the moveable member 101 if problems such as sticking or jamming may occur. Further, the continuous force of the biasing means 107 permits the mechanism 100 to operate when the sash lock mechanism 132 is positioned in an orientation where gravity does not act in the proper direction to return the moveable member 101 to the secure position, such as in a horizontal sliding window assembly.

Another embodiment of a sash lock mechanism 232 is illustrated in FIGS. 54-57. Most of the components of the sash lock assembly 232 shown in FIGS. 54-57 are the same or similar to those of the sash lock assembly 32 shown in FIGS. 2-38, and are consistently numbered using the "200" series of reference numbers. Additionally, most of the components of the sash lock assembly 232 shown in FIGS. 54-57 are the same or similar to those of the sash lock assembly 132 shown in FIGS. 40-53, and thus, for the sake of brevity, the sash lock mechanism 232 will be described mainly with respect to the differences from the sash lock mechanism 132 described above.

Similarly to the sash lock assembly 132 described above, the sash lock assembly 232 of FIGS. 54-57 is adapted for use with the integrated tilt latch and sash lock assembly 30 as described above, and includes an actuator arm or handle 236 connected to a cam or rotor 244 which is operably connected to a pawl 272, and a housing 282 supporting the other components of the sash lock mechanism 232. As also previously described, the sash lock mechanism 232 of FIGS. 54-57 further includes a locking mechanism 200 that operates to selectively prevent rotation of the cam 244 from the locked position. The locking mechanism 200 generally includes a moveable member or rocker 201 pivotably mounted on the housing 282 and operable to engage the cam 244 to selectively prevent rotation of the cam 244 from the locked position. The moveable member 201 includes an actuator portion 202, a mounting arm 203, and a leg 204 extending from the actuator portion 202. The leg 204 has a notch 204*a* with an engagement surface 206 thereon for engaging the cam 244 to prevent rotation thereof, in the manner described above. Additionally, the moveable member 201 is moveable between a secured position, where the engagement surface 206 engages the cam portion 294 to prevent rotation of the cam 244 from the locked position, and a free position, where the engagement surface 206 no longer engages the cam 244, allowing the cam 244 to be rotated from the locked position to the unlocked position. As can be appreciated from FIGS. 55-57 in view of FIG. 48, it is understood that a user pivots the moveable member 201 wherein the leg 204 rotates upward to clear the top of the cam 244, allowing the cam 244 to rotate as described. The assembly and operation of the sash lock mechanism 232, including the locking mechanism 200, are similar to those of the sash lock mechanism 132 described above.

Figure 55:
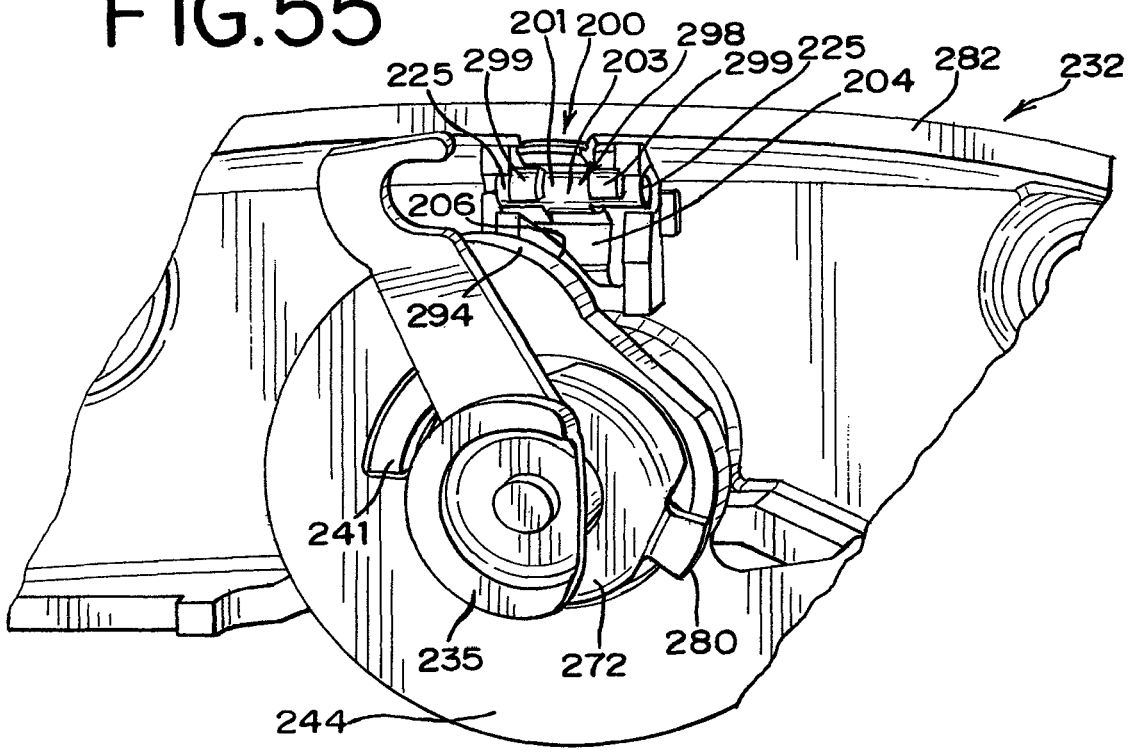
FIG. 55 is a focused bottom perspective view of the sash lock mechanism of FIG. 54.
Figure 56:
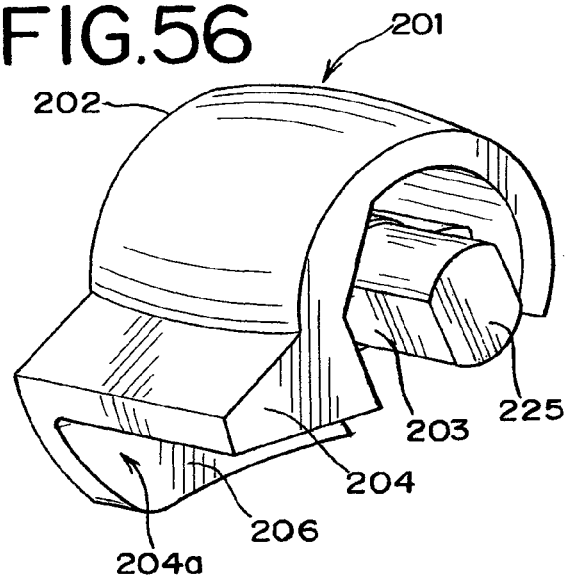
FIG. 56 is a perspective view of a pivotable member of the locking mechanism of the sash lock mechanism of FIG. 54.
Figure 57:
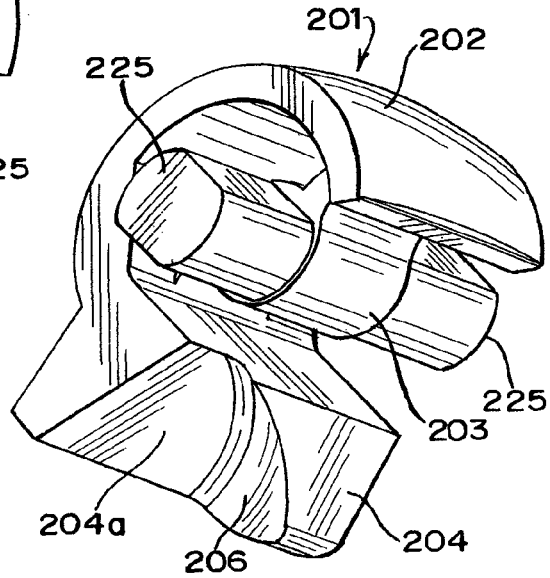
FIG. 57 is a bottom perspective view of the pivotable member of FIG. 56.
Figure 58:
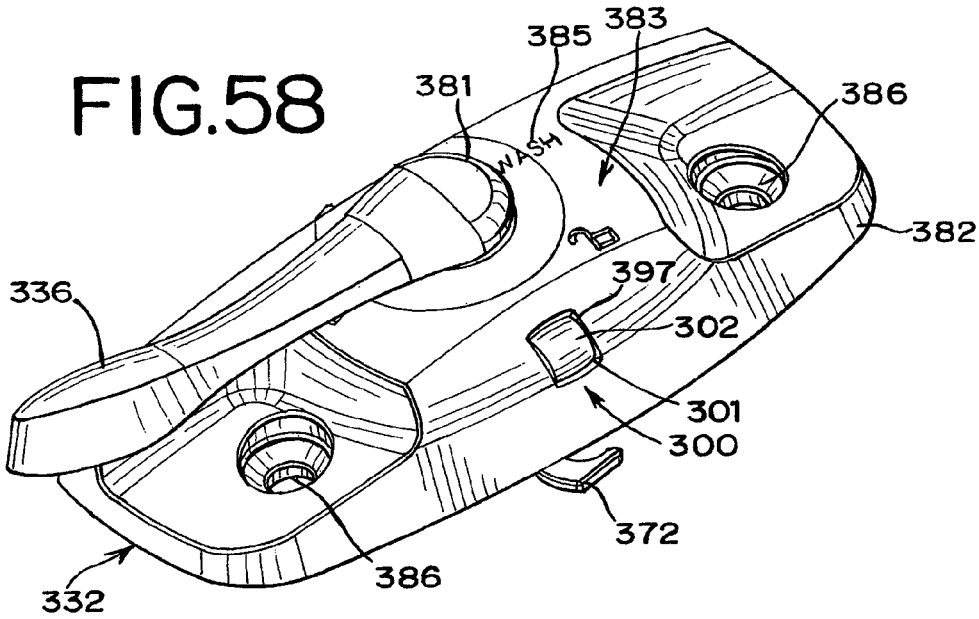
FIG. 58 is a perspective view of another embodiment of a sash lock mechanism having a forced entry resistance mechanism, shown in a locked position.
Figure 62:
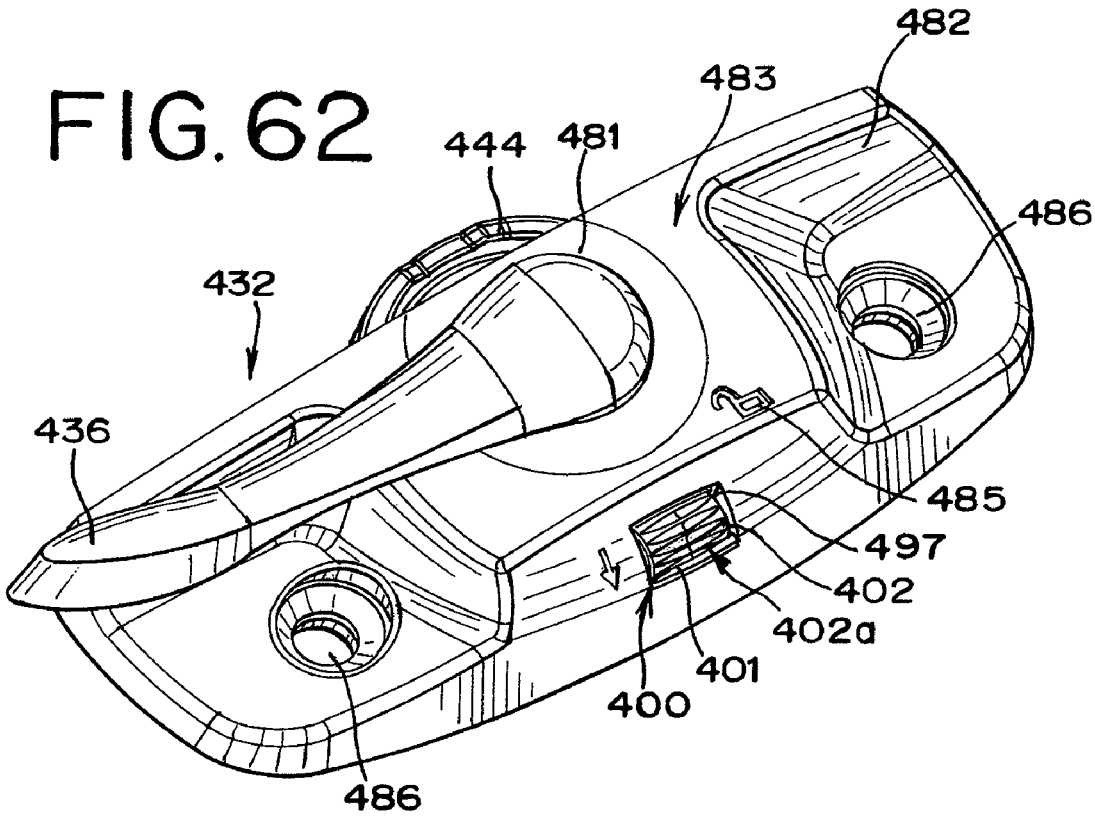
FIG. 62 is a perspective view of another embodiment of a sash lock mechanism having a forced entry resistance mechanism, shown in a locked position.
Figure 63:
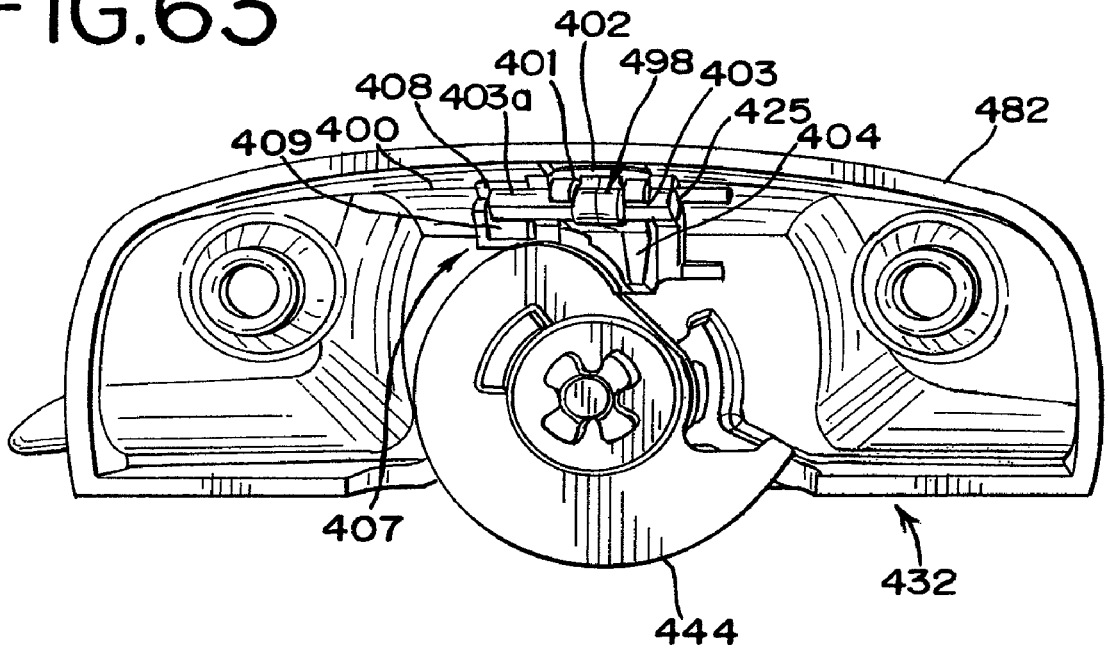
FIG. 63 is a bottom perspective view of the sash lock mechanism of FIG. 62.
Figure 64:
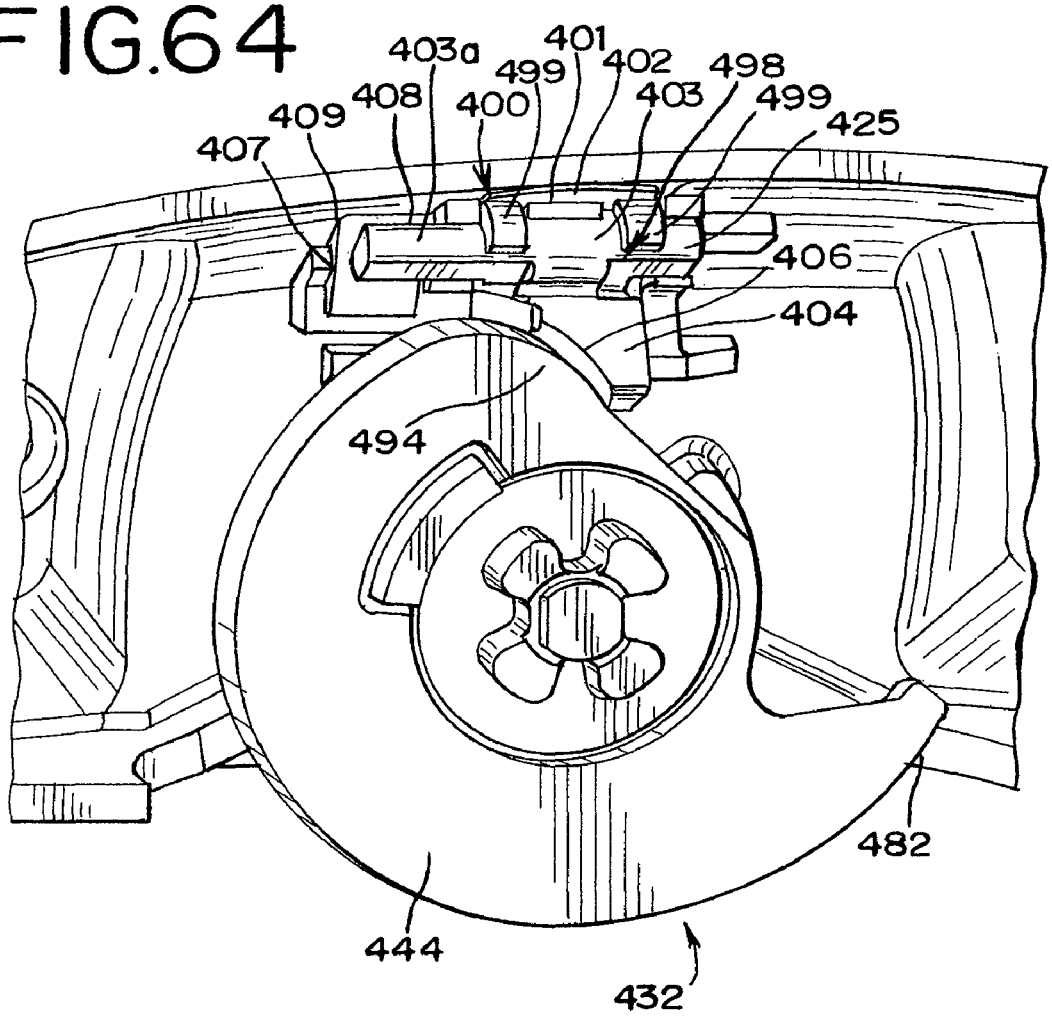
FIG. 64 is a focused bottom perspective view of a housing and a locking mechanism of the sash lock mechanism of FIG. 62, with the locking mechanism in a secure position.
Figure 65:
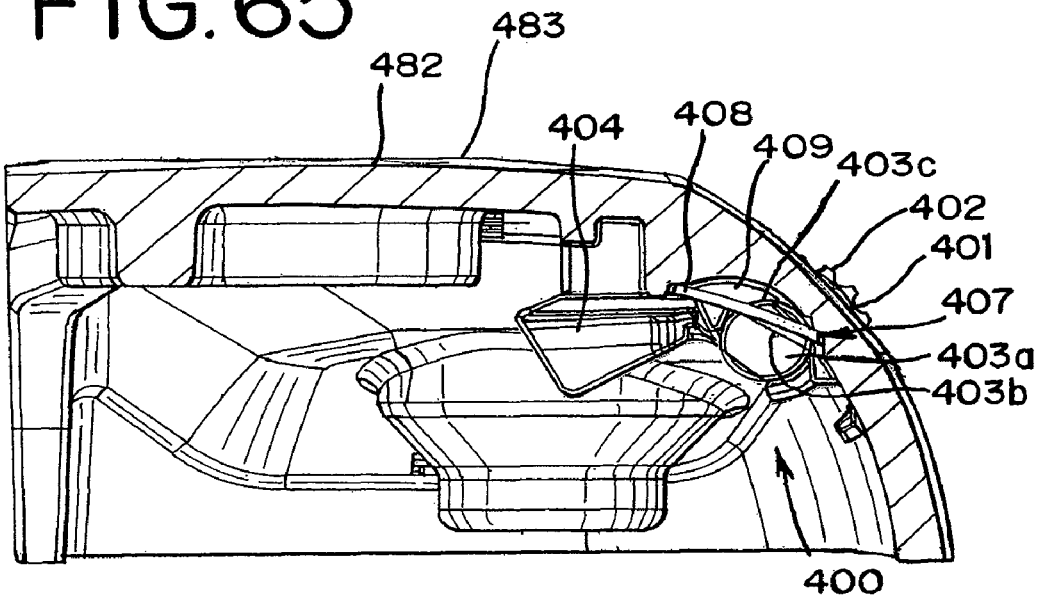
FIG. 65 is a cross-sectional view of the housing and locking mechanism of FIG. 64.
Figure 66:
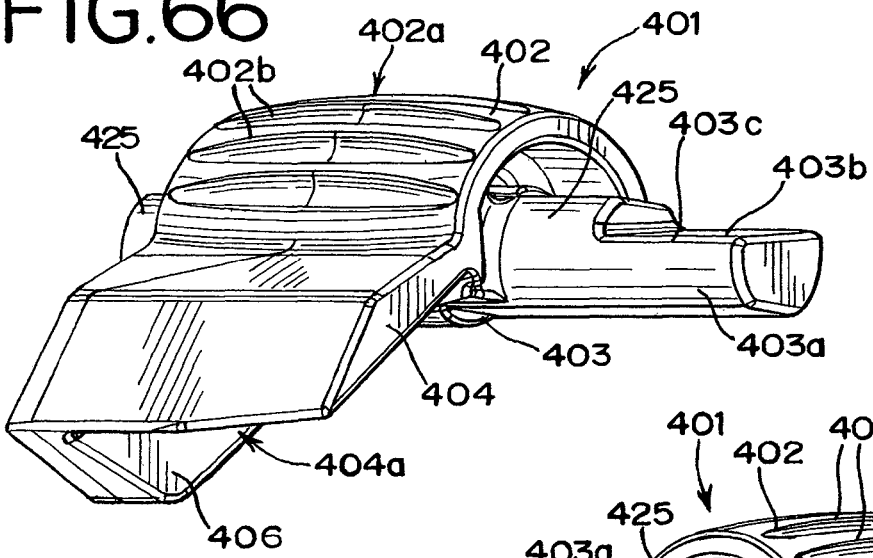
FIG. 66 is a perspective view of a pivotable member of the locking mechanism of the sash lock mechanism of FIG. 62.
Figure 67:
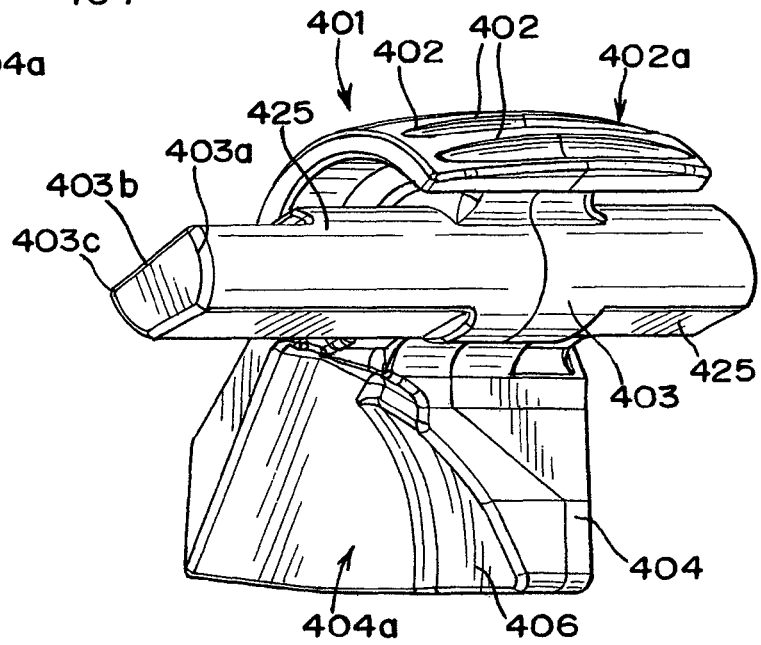
FIG. 67 is a bottom perspective view of the pivotable member of FIG. 66.

One difference between the sash lock mechanism 232 of FIGS. 54-57 and the sash lock mechanism 132 described previously is the shape of the housing 282. For example, the housing 282 shown in FIG. 54 has a more smoothly curved top surface 283 and lower profile than the housing 182 shown in FIG. 40, which has a top surface 183 having a stepped configuration. Another difference between the sash lock mechanisms 132 and 232 is the configuration of the moveable members 101 and 201. The moveable member 201 shown in FIGS. 56-57 does not have eccentric cam portions to engage leaf springs, like the moveable member 101 shown in FIGS. 45-46. Additionally, the moveable member 201 shown in FIGS. 56-57 does not have a tactile surface for enhancing traction. Still other differences between the sash lock mechanisms 132 and 232 include the lack of a stepped or offset configuration of the appending member 278 of the pawl 272 and the presence of an eccentric cap 235 in the sash lock mechanism 232, as shown in FIG. 55. Further differences may exist between the mechanisms that are not described herein.

Another embodiment of a sash lock mechanism 332 is illustrated in FIGS. 58-61. Most of the components of the sash lock assembly 332 shown in FIGS. 58-61 are the same or similar to those of the sash lock assembly 32 shown in FIGS. 2-38, and are consistently numbered using the "300" series of reference numbers. Additionally, most of the components of the sash lock assembly 332 shown in FIGS. 58-61 are the same or similar to those of the sash lock assemblies 132, 232 shown in FIGS. 40-53 and 54-57, and thus, for the sake of brevity, the sash lock mechanism 332 will be described mainly with respect to the differences from the sash lock mechanism 132 described above.

Similarly to the sash lock assembly 132 described above, the sash lock assembly 332 of FIGS. 58-61 is adapted for use with the integrated tilt latch and sash lock assembly 30 as described above, and includes an actuator arm or handle 336 connected to a cam or rotor 344 which is operably connected to a pawl 372, and a housing 382 supporting the other components of the sash lock mechanism 332. As also previously described, the sash lock mechanism 332 of FIGS. 58-61 further includes a locking mechanism 300 that operates to selectively prevent rotation of the cam 344 from the locked position. The locking mechanism 300 generally includes a moveable member or rocker 301 pivotably mounted on the housing 382 and operable to engage the cam 344 to selectively prevent rotation of the cam 344 from the locked position. The moveable member 301 includes an actuator portion 302, a mounting arm 303, and a leg 304 extending from the actuator portion 302. The leg 304 has a notch 304*a* with an engagement surface 306 thereon for engaging the cam 344 to prevent rotation thereof, in the manner described above. Additionally, the moveable member 301 is moveable between a secured position, where the engagement surface 306 engages the cam portion 394 to prevent rotation of the cam 344 from the locked position, and a free position, where the engagement surface 306 no longer engages the cam 344, allowing the cam 344 to be rotated from the locked position to the unlocked position. It is understood that the moveable member 301 pivots similarly as shown in FIG. 48. The assembly and operation of the sash lock mechanism 332, including the locking mechanism 300, are similar to those of the sash lock mechanism 132 described above.

The sash lock mechanism 332 of FIGS. 58-61 and the sash lock mechanism 132 described previously have similarly-shaped housings 182, 382. One difference between the sash lock mechanisms 132 and 332 is the configuration of the moveable members 101 and 301. The moveable member 301 shown in FIGS. 60-61 has a larger leg 304 than the moveable member 101 shown in FIGS. 45-46. Additionally, the moveable member 301 shown in FIGS. 60-61 does not have eccentric cam portions to engage leaf springs, like the moveable member 101 shown in FIGS. 45-46. Further, the moveable member 301 shown in FIGS. 60-61 does not have a tactile surface for enhancing traction. Still further differences may exist between the mechanisms that are not described herein.

Another embodiment of a sash lock mechanism 432 is illustrated in FIGS. 62-67. Most of the components of the sash lock assembly 432 shown in FIGS. 62-67 are the same or similar to those of the sash lock assembly 32 shown in FIGS. 2-38, and are consistently numbered using the "400" series of reference numbers. Additionally, most of the components of the sash lock assembly 432 shown in FIGS. 62-67 are the same or similar to those of the sash lock assemblies 132, 232, 332 shown in FIGS. 40-53, 54-57, and 58-61, and thus, for the sake of brevity, the sash lock mechanism 432 will be described mainly with respect to the differences from the sash lock mechanisms 132, 232, 332 described above.

Similarly to the sash lock assembly 132 described above, the sash lock assembly 432 of FIGS. 62-67 includes an actuator arm or handle 436 connected to a cam or rotor 444, and a housing 482 supporting the other components of the sash lock mechanism 432. However, the sash lock assembly 432 of FIGS. 62-67 does not contain a pawl 172, and thus, is adapted for independent use, rather than use with an integrated tilt latch and sash lock assembly 30. It is understood that the sash lock mechanism 432 could be modified to be used with an integrated assembly 30, such as by adding a pawl 172. The sash lock mechanism 432 of FIGS. 62-67 has a housing 482 that is similar in shape to the housing 182 of the sash lock mechanism 132 shown in FIG. 40. Also, as similarly described above, the sash lock mechanism 432 of FIGS. 62-67 further includes a locking mechanism 400 that operates to selectively prevent rotation of the cam 444 from the locked position. The locking mechanism 400 generally includes a moveable member or rocker 401 pivotably mounted on the housing 482 and operable to engage the cam 444 to selectively prevent rotation of the cam 444 from the locked position. The moveable member 401 includes an actuator portion 402, a mounting arm 403, and a leg 404 extending from the actuator portion 402. Like the moveable member 101 described above, the actuator portion 402 of the moveable member 401 has a tactile surface 402*a* formed by a plurality of ridges 402*b* thereon. The leg 404 has a notch 404*a* with an engagement surface 406 thereon for engaging the cam 444 to prevent rotation thereof, in the manner described above. Additionally, the moveable member 401 is moveable between a secured position, where the engagement surface 406 engages the cam portion 494 to prevent rotation of the cam 444 from the locked position, and a free position, where the engagement surface 406 no longer engages the cam 444, allowing the cam 444 to be rotated from the locked position to the unlocked position. It is understood that the moveable member 401 pivots similarly as shown in FIG. 48. The assembly and operation of the sash lock mechanism 432, including the locking mechanism 400, are similar to those of the sash lock mechanism 132 described above, except that the sash lock mechanism 432 operates independently of a tilt latch mechanism, and thus, functionally has a locked position and an unlocked position.

The sash lock mechanism 432 is adapted to incorporate a biasing means 407 for biasing the moveable member 401 toward the secure position, similarly to the sash lock mechanism 132 described above. However, the sash lock mechanism 432 of FIGS. 62-67 contains only a single leaf spring 408 received in a single recess 409 on the housing 482. Likewise, the moveable member 401 includes only a single eccentric cam portion 403*a* to engage the leaf spring 408 to bias the moveable member 401 to the secure position. Like the moveable member 101 described above, the cam portion 403*a* of the moveable member 401 includes a flat portion 403*b* having an edge 403*c* that engages the spring 408 when the moveable member 401 is pivoted to the free position. It is understood that the sash lock mechanism 432 of FIGS. 62-67 could be used without the biasing means 407. Still further differences may exist between the mechanisms that are not described herein.

Another embodiment of a sash lock mechanism 532 is illustrated in FIGS. 68-73. Most of the components of the sash lock assembly 532 shown in FIGS. 68-73 are the same or similar to those of the sash lock assembly 32 shown in FIGS. 2-38, and are consistently numbered using the "500" series of reference numbers. Additionally, most of the components of the sash lock assembly 532 shown in FIGS. 68-73 are the same or similar to those of the sash lock assemblies 132, 232, 332, 432 shown in FIGS. 40-53, 54-57, 58-61, and 62-67 and thus, for the sake of brevity, the sash lock mechanism 532 will be described mainly with respect to the differences from the sash lock mechanisms 132, 232, 332, 432 described above.

Figure 68:
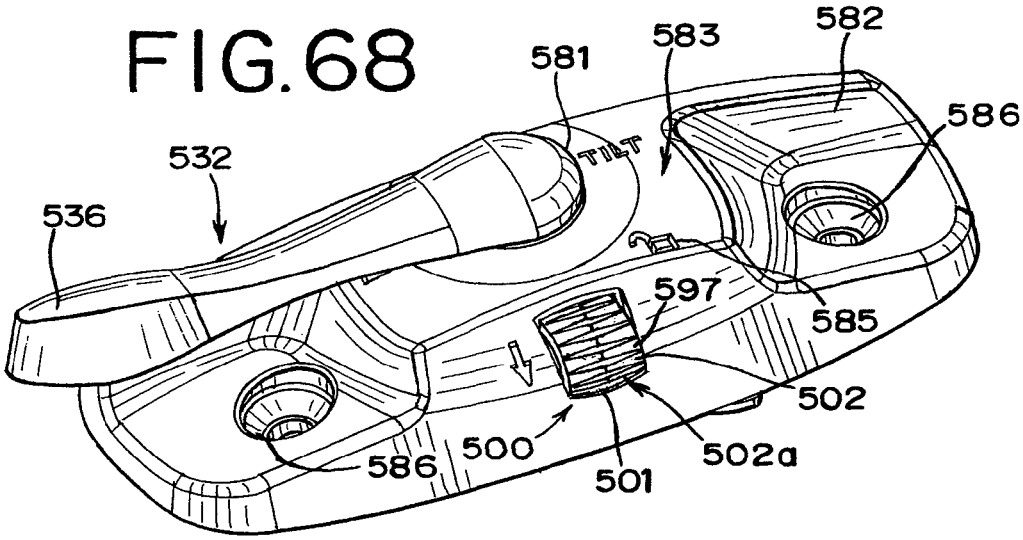
FIG. 68 is a perspective view of another embodiment of a sash lock mechanism having a forced entry resistance mechanism, shown in a locked position.
Figure 69:
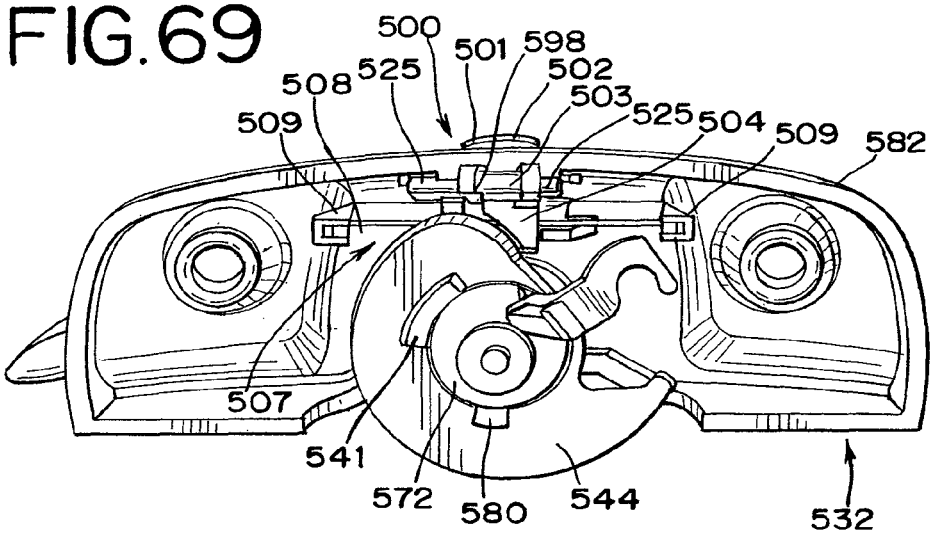
FIG. 69 is a bottom perspective view of the sash lock mechanism of FIG. 68.
Figure 70:
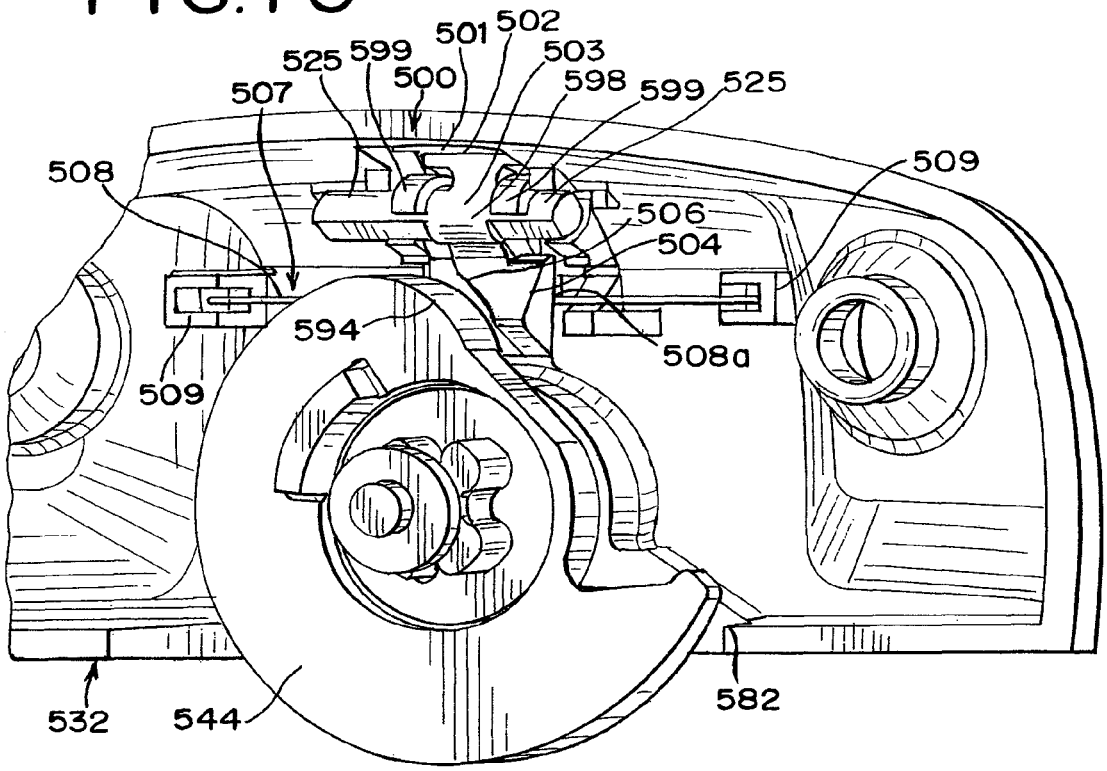
FIG. 70 is a focused bottom perspective view of the sash lock mechanism of FIG. 68, with the pawl removed.
Figure 71:
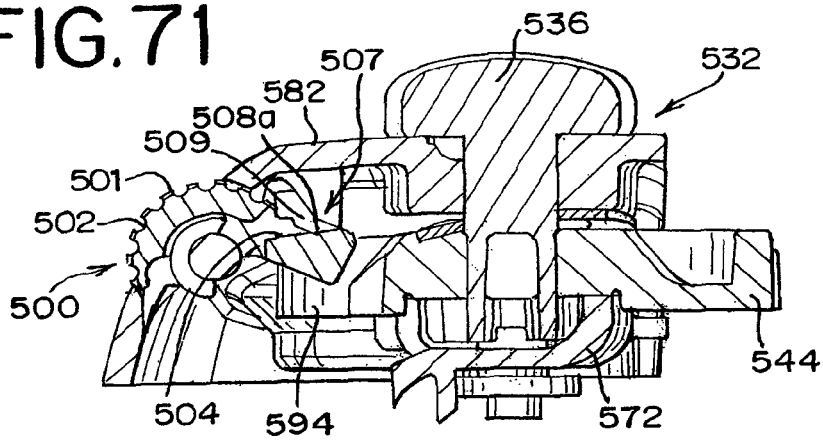
FIG. 71 is a cross sectional view of the sash lock mechanism of FIG. 68.
Figure 72:
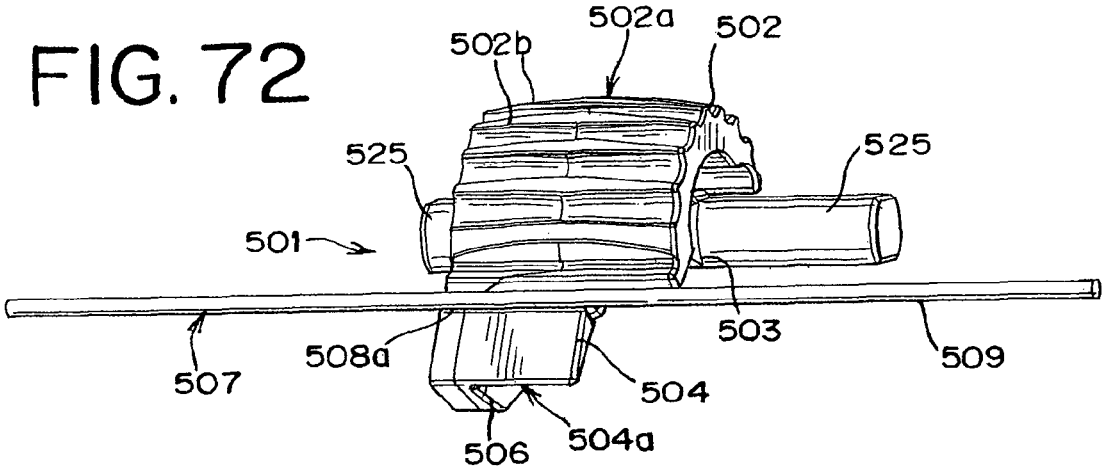
FIG. 72 is a perspective view of a pivotable member and a biasing spring of the sash lock mechanism of FIG. 68.
Figure 73:
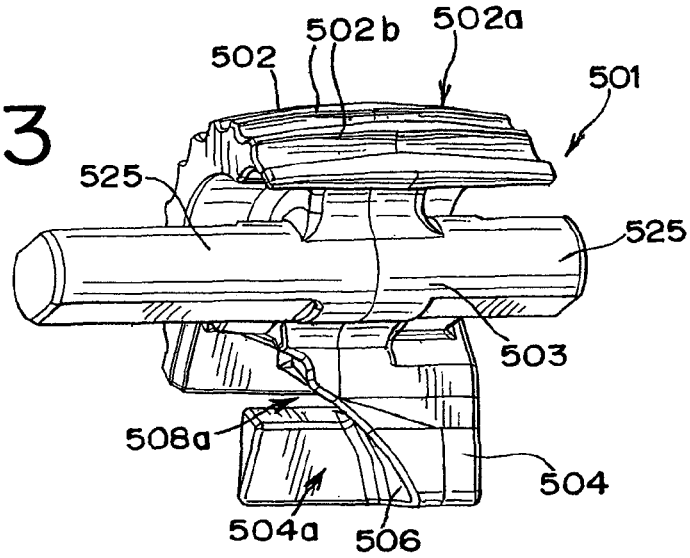
FIG. 73 is a bottom perspective view of the pivotable member of FIG. 66.

Similarly to the sash lock assembly 132 described above, the sash lock assembly 532 of FIGS. 68-73 includes an actuator arm or handle 536 connected to a cam or rotor 544 which is operably connected to a pawl 572, and a housing 582 supporting the other components of the sash lock mechanism 532. The sash lock mechanism 532 of FIGS. 68-73 has a housing 582 that is similar in shape to the housing 182 of the sash lock mechanism 132 shown in FIG. 40. Also, as similarly described above, the sash lock mechanism 532 of FIGS. 68-73 further includes a locking mechanism 500 that operates to selectively prevent rotation of the cam 544 from the locked position. As shown in FIGS. 68 and 69, the locking mechanism 500 generally includes a moveable member or rocker 501 pivotably mounted on the housing 582 and operable to engage the cam 544 to selectively prevent rotation of the cam 544 from the locked position. The moveable member 501 includes an actuator portion 502, a mounting arm 503, and a leg 504 extending from the actuator portion 502. Like the moveable member 101 described above, the actuator portion 502 of the moveable member 501 has a tactile surface 502*a* formed by a plurality of ridges 502*b* thereon. As shown in FIG. 72, the leg 504 has a notch 504*a* with an engagement surface 506 thereon for engaging the cam 544 to prevent rotation thereof, in the manner described above. Additionally, the moveable member 501 is moveable between a secured position, where the engagement surface 506 engages the cam portion 594 to prevent rotation of the cam 544 from the locked position, and a free position, where the engagement surface 506 no longer engages the cam 544, allowing the cam 544 to be rotated from the locked position to the unlocked position. It is understood that the moveable member 501 pivots similarly as shown in FIG. 48. The assembly and operation of the sash lock mechanism 532, including the locking mechanism 500, are similar to those of the sash lock mechanism 132 described above.

The sash lock mechanism 532 is adapted to incorporate a biasing means 507 for biasing the moveable member 501 toward the secure position, similarly to the sash lock mechanism 132 described above. However, the sash lock mechanism 532 of FIGS. 68-73 contains a resilient wire spring 508 that engages the moveable member 501 to bias the moveable member 501, instead of the leaf springs described above. The wire spring 508 is received in two receivers 509 on the underside of the housing 582. The receivers 509 are box-like structures that have open areas to accommodate the wire spring 508. The receivers 509 are positioned in spaced, and confronting relation generally at a central portion of the underside of the sash lock housing 582, and generally at the outer bounds of the outer dimension of the rotor 544. Distal ends of the wire spring 508 are received by the receivers 509. The wire spring 508 extends from the receivers 509 and through a groove 508*a* on the upper side of the leg 504 of the moveable member 501. The groove 508*a* generally corresponds to the wire spring 508. Thus, with this structural configuration, the receivers 509 are not required to be completely closed structures to hold the wire spring 508 although such structure could be employed if desired. It is understood from FIGS. 69-72 that when the moveable member 501 rotates to move the leg 504 upward, the leg 504 engages the wire spring 508 to flex the wire spring 508 toward the underside of the housing 582. The ends of the wire spring 508 are held in place by the receivers 509 to form a three-point flexing arrangement of the wire spring 508. In another embodiment, the wire spring 508 could be arranged differently, such as in a two-point (cantilever) flexing arrangement. When flexed, the wire spring 508 tends to bias the leg 504 away from the top of the housing 582, consequently biasing the moveable member 501 toward the secure position. In still another embodiment, the wire spring 508 could have a cantilevered configuration having a single mounting location such as on the sash lock housing 582 and a free distal end configured to engage the moveable member 501 in biasing fashion. Multiple springs could also be employed in other embodiments. It is understood that other types of biasing members can be used in the sash lock mechanism 532 as well as the other sash lock mechanisms described herein. For example, a coil spring or other spring type could be positioned between the sash lock housing 582 or other structure and the moveable member 501. A resilient member such as an elastic member could also be similarly positioned to bias the moveable member 501 to the secure position. It is understood that the sash lock mechanism 532 of FIGS. 68-73 could be used without the biasing means 507. Still further differences may exist between the mechanisms that are not described herein.

It is understood that the locking mechanism may be configured differently from the locking mechanisms 100, 200, 300, 400, 500 shown and described herein. For example, the locking mechanism may be designed so that the moveable member moves in a different manner or pivots about a different axis of rotation. In one embodiment, the moveable member may be configured to pivot about a vertical axis of rotation, substantially parallel to the axis of rotation 136*a* of the actuator 136 and cam 144. Additionally, the locking mechanism may be incorporated into sash lock mechanisms having different configurations and features than the sash lock mechanisms 32, 132, 232, 332, 432, 532 shown and described herein.

The various embodiments of the locking mechanism of the sash lock mechanism described herein provide benefits and advantages over prior sash lock mechanisms. For example, the locking mechanism provides forced entry resistance by preventing the sash lock mechanism from being unlocked. Since the rotor cannot be moved from the locked position without manipulation of the pivotable member, it is difficult to impossible for a person outside of the window to unlock the window using a diabolical tool of intrusion, such as by picking or other common method. Additionally, the locking mechanism provides great ease of operation as compared to existing forced entry resistance mechanisms. Further, the locking mechanism automatically returns to the secure position whenever the rotor is returned to the locked position, ensuring secure locking at all times. The biasing means employed further enhances this benefit. As discussed, it is understood that any of the various sash lock mechanisms utilizing the locking mechanisms of the present invention can be used in an integrated sash lock and tilt latch assembly or as a stand-alone sash lock mechanism not operably connected to a tilt latch, as known in the art. It is understood that the sash lock mechanism disclosed herein provides these same benefits when used in an integrated sash lock and tilt latch assembly or a stand-alone sash lock mechanism.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is further understood that the invention may be in other specific forms without departing from the spirit or central characteristics thereof The present examples therefore are to be considered in all respects as illustrative and not restrictive, and the invention is not to be limited to the details given herein. The term "plurality," as used herein, indicates any number greater than one, either disjunctively or conjunctively, as necessary, up to an infinite number. Accordingly, while the specific examples have been illustrated and described, numerous modifications come to mind without significantly departing from the spirit of the invention and the scope of protection is only limited by the scope of the accompanying claims.

What is claimed is:

1. A sash lock mechanism for a sash window assembly, the sash window assembly having a lower sash window having a top rail, a bottom rail, and a pair of stiles, and an upper sash window having a keeper, the sash lock mechanism comprising: a handle; a housing adapted to be supported on a top surface of the top rail, the housing having an opening receiving the handle therethrough; a rotor coupled to the handle, the rotor moveable between a locked position and an unlocked position by movement of the handle, wherein the rotor is adapted to engage the keeper in the locked position; and a locking mechanism comprising a pivotable member pivotably connected to the housing, the pivotable member having an engagement surface thereon, wherein the pivotable member is pivotable between a first position, wherein when the rotor is in the locked position, the engagement surface confronts the rotor to prevent movement of the rotor to the unlocked position, and a second position, wherein the pivotable member does not prevent movement of the rotor and wherein the rotor is moveable by rotation about a first axis of rotation and the pivotable member is pivotable about a second axis of rotation and wherein the first axis of rotation is generally transverse to the second axis of rotation.

2. The sash lock mechanism of claim 1, wherein the first axis of rotation is substantially perpendicular to the second axis of rotation.

3. The sash lock mechanism of claim 1, wherein the pivotable member comprises an actuator portion that is movable in a direction from a top of the housing to a bottom of the housing to pivot the pivotable member between the first and second positions.

4. The sash lock mechanism of claim 1, wherein the housing has a second opening therein, and wherein the pivotable member is connected to the housing such that a portion of the pivotable member extends through the opening and is accessible from outside the housing.

5. The sash lock mechanism of claim 1, wherein the pivotable member has a mounting arm pivotably received within a receiver on the housing to pivotably connect the pivotable member to the housing, and wherein the mounting arm defines the second axis of rotation.

6. The sash lock mechanism of claim 5, wherein the housing further comprises a pair of fingers located proximate the receiver, the fingers wrapping around a portion of the mounting arm to retain the mounting arm within the receiver.

* * * * *